US005848926A

United States Patent [19]

Jardetzky et al.

[11] Patent Number: 5,848,926

[45] Date of Patent: Dec. 15, 1998

[54] REMOVABLY ADHERABLE CONSTRUCTION ELEMENTS

[76] Inventors: Alexander M. Jardetzky, 44 Mariposa Ave., Los Gatos, Calif. 95030; Charles P. Weidmann, 2205 Westmoreland Dr., San Jose, Calif. 95124

[21] Appl. No.: 462,411

[22] Filed: Jun. 5, 1995

[51] Int. Cl.[6] ..... A63H 33/04

[52] U.S. Cl. ..... 446/85; 446/901; 273/DIG. 30

[58] Field of Search ..... 446/85, 87, 92, 446/108, 111, 112, 114, 115, 120, 128, 901; 273/DIG. 30

[56] References Cited

U.S. PATENT DOCUMENTS

| | | | |
|---|---|---|---|
| 1,620,574 | 3/1927 | Savage . | |
| 3,659,360 | 5/1972 | Zeischegg . | |
| 3,908,830 | 9/1975 | Skrzelowski . | |
| 4,699,385 | 10/1987 | Bifulco . | |
| 4,884,988 | 12/1989 | McMurray . | |
| 4,978,301 | 12/1990 | Dodge . | |
| 5,458,522 | 10/1995 | Brooks, III | 446/85 |

FOREIGN PATENT DOCUMENTS

| | | | |
|---|---|---|---|
| 1300206 | 6/1962 | France . | |
| 2808436 | 8/1979 | Germany | 446/901 |
| 3726618 | 2/1989 | Germany . | |
| 608397 | 9/1948 | United Kingdom . | |
| 2082925 | 9/1980 | United Kingdom . | |

OTHER PUBLICATIONS

Lilly's Kids, Lillian Vernon Corporation, Virginia Beach, Virginia, November 1994 catalog.

*Primary Examiner*—Robert A. Hafer
*Assistant Examiner*—D. Neal Muir
*Attorney, Agent, or Firm*—Laurence J. Shaw

[57] ABSTRACT

A set of three-dimensional construction elements which removably adhere to one another for use as a construction toy or as a decorative display structure. Surfaces of the elements are substantially covered with hook-and-loop fastener material in accordance with "surfacing patterns" which maximize inter-connection flexibility. The "3-point" surfacing pattern for rectangular prisms, and derivatives of the 3-point pattern for other shapes, provide a unified surfacing system which promotes ease of use. Derivative 3-point patterns may be determined by morphological transformations of a rectangular prism with a 3-point surfacing pattern. The 3-point pattern and its derivatives obey a set of surfacing guidelines which maximizes the number of ways of forming face-to-face, edge-to-face, and point-to-face connections. For an edge-to-face connection to perform optimally, both faces adjacent to the edge must be surfaced with the same fastener material to a minimum distance from the edge, the minimum distance being determined by the nap height of the fastener material and the angle at which the faces adjacent to the edge meet. Similarly, for a point-to-face connection to perform optimally, the surfaces adjacent to the point must be surfaced with a single fastener material to a minimum distance from the point, the minimum distance being determined by the nap height of the fastener material and the angle at which the surfaces adjacent the point meet. Rounded or beveled edges and points further increase the strength of edge-to-face and point-to-face connections. Elements may be solid or hollow, and may have rigid, semi-rigid, resilient, or poseable substrates. The color of the fastener material may be used to indicate the type of surfacing material and/or bond strength of the material.

33 Claims, 32 Drawing Sheets

Number of Ways of Connecting Two Right Rectangular Prisms
In an Edge-To-Surface Orientation

| PrismB FH | PrismB FL | PrismB EH | PrismB EL | Prism A FH FL EH EL: 6 0 12 0 | Prism A FH FL EH EL: 5 1 8 0 | Prism A FH FL EH EL: 4 2 5 1 | Prism A FH FL EH EL: 4 2 4 0 | Prism A FH FL EH EL: 3 3 3 3 |
|---|---|---|---|---|---|---|---|---|
| 6 | 0 | 12 | 0 | **0** | 12 | 30 | 24 | 54 |
| 5 | 1 | 8 | 0 | 12 | **16** | 26 | 20 | 42 |
| 4 | 2 | 5 | 1 | 30 | 26 | **28** | 22 | 36 |
| 4 | 2 | 4 | 0 | 24 | 20 | 22 | **16** | 30 |
| 3 | 3 | 3 | 3 | 54 | 42 | 36 | 30 | **36** |
| 3 | 3 | 2 | 2 | 48 | 36 | 30 | 24 | 30 |
| 2 | 4 | 0 | 4 | 72 | 52 | 38 | 32 | 30 |
| 2 | 4 | 1 | 5 | 78 | 58 | 44 | 38 | 36 |
| 1 | 5 | 0 | 8 | 108 | 80 | 58 | 52 | 42 |
| 0 | 6 | 0 | 12 | **144** | 108 | 78 | 72 | 54 |

| PrismB FH | PrismB FL | PrismB EH | PrismB EL | Prism A FH FL EH EL: 3 3 2 2 | Prism A FH FL EH EL: 2 4 0 4 | Prism A FH FL EH EL: 2 4 1 5 | Prism A FH FL EH EL: 1 5 0 8 | Prism A FH FL EH EL: 0 6 0 12 |
|---|---|---|---|---|---|---|---|---|
| 6 | 0 | 12 | 0 | 48 | 72 | 78 | 108 | **144** |
| 5 | 1 | 8 | 0 | 36 | 52 | 58 | 80 | 108 |
| 4 | 2 | 5 | 1 | 30 | 38 | 44 | 58 | 78 |
| 4 | 2 | 4 | 0 | 24 | 32 | 38 | 52 | 72 |
| 3 | 3 | 3 | 3 | 30 | 30 | 36 | 42 | 54 |
| 3 | 3 | 2 | 2 | **24** | 24 | 30 | 36 | 48 |
| 2 | 4 | 0 | 4 | 24 | **16** | 22 | 20 | 24 |
| 2 | 4 | 1 | 5 | 30 | 22 | **28** | 26 | 30 |
| 1 | 5 | 0 | 8 | 36 | 20 | 26 | **16** | 12 |
| 0 | 6 | 0 | 12 | 48 | 24 | 30 | 12 | **0** |

Fig. 18

| 1 | 2 | 3 | 4 | 5 | 6 | 7 | 8 | 9 | 10 |
|---|---|---|---|---|---|---|---|---|---|
| # | FH | FL | Comments | 104 | 101 | 106 | 105 | 102 | 103 |
| | | | | | | | | | |
| 1 | 6 | 0 | | H | H | H | H | H | H |
| | | | | | | | | | |
| 2 | 5 | 1 | | L | H | H | H | H | H |
| 3 | 5 | 1 | | H | H | L | H | H | H |
| 4 | 5 | 1 | | H | H | H | L | H | H |
| | | | | | | | | | |
| 5 | 4 | 2 | | L | L | H | H | H | H |
| 6 | 4 | 2 | | H | H | L | H | L | H |
| 7 | 4 | 2 | | H | H | H | L | H | L |
| 8 | 4 | 2 | | L | H | L | H | H | H |
| 9 | 4 | 2 | | L | H | H | L | H | H |
| 10 | 4 | 2 | | H | H | L | L | H | H |
| | | | | | | | | | |
| 11 | 3 | 3 | 3&3, 3Line | L | L | L | H | H | H |
| 12 | 3 | 3 | 3&3, 3Line | L | L | H | L | L | H |
| 13 | 3 | 3 | 3&3, 3Line | L | H | L | H | L | H |
| 14 | 3 | 3 | 3&3, 3Line | H | H | L | L | L | H |
| 15 | 3 | 3 | 3&3, 3Line | L | H | H | L | H | L |
| 16 | 3 | 3 | 3&3, 3Line | H | H | L | L | H | L |
| 17 | 3 | 3 | 3&3, 3Point | L | H | L | L | H | H |
| 18 | 3 | 3 | 3Point, mirror of 18 | L | H | L | H | H | L |
| | | | | | | | | | |
| 19 | 2 | 4 | | H | H | L | L | L | L |
| 20 | 2 | 4 | | L | L | H | L | H | L |
| 21 | 2 | 4 | | L | L | L | H | L | H |
| 22 | 2 | 4 | | H | L | H | L | L | L |
| 23 | 2 | 4 | | H | L | L | H | L | L |
| 24 | 2 | 4 | | L | L | H | H | L | L |
| | | | | | | | | | |
| 25 | 1 | 5 | | H | L | L | L | L | L |
| 26 | 1 | 5 | | L | L | H | L | L | L |
| 27 | 1 | 5 | | L | L | L | H | L | L |
| | | | | | | | | | |
| 28 | 0 | 6 | | L | L | L | L | L | L |
| Notes: H = Hook; L = Loop; | | | | | | | | | |

Fig. 28

| | | | | | | | | | | | | | | | | |
|---|---|---|---|---|---|---|---|---|---|---|---|---|---|---|---|---|
| | | | Number of Ways of Connecting Two Right Rectangular Prisms | | | | | | | | | | | | | |
| | | | | | In a Face-To-Face Orientation | | | | | | | | | | | |
| | | | | | | | | | | | | | | | | |
| | | | | | PrismA | | | | | | | | | | | |
| | | | | | | | | | | | | | | | | |
| | | | FH FL | | FH FL | | FH FL | | FH FL | | FH FL | | FH FL | | FH FL | |
| | | | 6 0 | | 5 1 | | 4 2 | | 3 3 | | 2 4 | | 1 5 | | 0 6 | |
| PrismB | | | | | | | | | | | | | | | | |
| FH | FL | | | | | | | | | | | | | | | |
| 6 | 0 | | **0** | | 6 | | 12 | | 18 | | 24 | | 30 | | **36** | |
| 5 | 1 | | 6 | | **10** | | 14 | | 18 | | 22 | | 26 | | 30 | |
| 4 | 2 | | 12 | | 14 | | **16** | | 18 | | 20 | | 22 | | 24 | |
| 3 | 3 | | 18 | | 18 | | 18 | | **18** | | 18 | | 18 | | 18 | |
| 2 | 4 | | 24 | | 22 | | 20 | | 18 | | **16** | | 14 | | 12 | |
| 1 | 5 | | 30 | | 26 | | 22 | | 18 | | 14 | | **10** | | 6 | |
| 0 | 6 | | **36** | | 30 | | 24 | | 18 | | 12 | | 6 | | **0** | |

Fig. 29

REMOVABLY ADHERABLE CONSTRUCTION ELEMENTS

BACKGROUND OF THE INVENTION

1. Field of the Invention

The present invention relates to general purpose construction elements which removably adhere to one another, such as are popularly used in toy construction sets, or the creation of decorative displays.

2. Prior Art

There has long been a desire and continuing need for toys which are educational, safe, and fun to use. More specifically, recent emphasis has been placed on toys which aid in development of coordination, stimulate a child's imagination and creativity, and provide continuing play value. There is also a desire and continuing need for toys which are equally attractive to both boys and girls, and are interesting to children of a wide range of ages and abilities. Toys within the category of construction sets meet these criteria, and have become increasingly popular in recent years.

Existing construction sets use a wide variety of interconnection mechanisms. Simple building blocks are extremely easy to use and come in a wide range of sizes, shapes, and materials, but have inherent limitations. They provide no means of removably adhering elements, so when blocks are stacked upon one another they are unstable and can easily collapse. Significant coordination is required to balance the blocks to create anything more than a simple structure.

Many types of construction sets which expand on the capabilities of building blocks are available. They generally all include some means of removably adhering one element to another. The simplest forms of such sets (such as Lincoln Logs™, manufactured by Playskool, Inc. of Pawtucket, R.I.) have elements containing specially cut grooves or slots into which other elements fit. This provides some additional stability, but severely restricts the orientation freedom of interconnected blocks, so the types of structures which can be constructed are limited.

Many popular sets have interconnection components molded into the elements. For instance, Lego™ toys (manufactured by LEGO Systems, Inc. of Enfield, Conn.) have pins protruding from the top faces of the elements which mate with holes molded into the lower faces. These precise connections require significant coordination to interface, making them difficult to use for individuals with limited dexterity, such as young children. Interconnection orientations are limited, since only the top and bottom surfaces can attach to other elements. This system of interconnection does not easily allow elements of different sizes and shapes to be interconnected, and does not work at all with curved surfaces. Other products (such as Flexiblocks™, manufactured by Flexitoys of St. Helena, Calif.) have added special hinges to provide additional connection options. However the interconnection orientations are still limited (they cannot attach at arbitrary angles), and they require significant manual dexterity to manipulate.

Some types of construction toys (such as Tinker Toys™, manufactured by Playskool, Inc. of Pawtucket, R.I.) provide specialized elements which do allow interconnections between elements of different shapes. But again these have limited interconnection orientations, because a number of holes are placed in cylindrical pieces to allow interconnections using connector rods. This again limits the types of structures which can be created. Metal construction sets (such as ERECTOR™, manufactured by MECCANO, Inc. of New York City, N.Y.) include many separate fastening pieces (i.e., nuts and bolts), but allow modeling of real-world structures. However, they are cumbersome and complex, requiring highly developed coordination to use the special tools for assembly, making them completely unsuitable for young children. The types of interconnections are still limited, since connections to arbitrary points on curved surfaces, such as spheres and cylinders, are not accommodated.

Several forms of construction sets have been outlined in the prior art which attempt to address some of the above-mentioned problems, although none of the prior art addresses the entire scope of the problems in an effective manner.

The construction set disclosed by Savage in U.S. Pat. No. 1,620,574 (1927) uses an adhesive mechanism constructed by coating the outer fibers of a fibrous material, such as felt, cloth or flock, with an adhesive material such as unvulcanized rubber. Blocks covered with this material adhere to one another, but do not adhere to uncoated items, since unvulcanized rubber has a cohesive affinity for itself, but has little affinity for other materials. This interconnect system results in several problems: the bond strength cannot be varied in a predictable way, and the adhesive system is subject to contamination by fine particulate matter such as dust, significantly reducing its effectiveness.

The construction set disclosed by Dodge in U.S. Pat. No. 4,978,301 (1990) consists of a set of semi-rigid planar construction pieces with various geometric shapes, such as circles, squares and triangles. The pieces are covered with hook-and-loop type interconnection material, such as Velcro™, manufactured by Velcro U.S.A. Inc., of Manchester, N.H. One side of each piece is covered with hook material and the other side is covered with loop material, allowing the pieces to be removably attached to one another. Specially designed connector strips with hook material on one side and loop material on the other are used to connect the pieces to form three-dimensional structures. Dodge deals exclusively with two-dimensional pieces, and specifically discourages the use of three-dimensional elements due to perceived safety concerns. The interconnection orientations between pieces are limited: pieces must be adhered edge-to-edge, using the connector strips, or surface-to-surface. Creation of three-dimensional structures requires using the special connecting pieces, and such structures have limited integrity. It should also be noted that Dodge's set does not allow for the interconnection of three-dimensional elements of multiple sizes, shapes, and material substrate properties.

The construction toy disclosed by O'Mahoney in United Kingdom patent application GB 2,082,925 A (1982) consists of components which interlock through the interaction of hook-and-loop materials on the contact faces on the components. The components can be building blocks of regular or irregular shape, or specially designed composite figures. Some of the suggested material deposition patterns, such as those which alternate rows of hook fastener material and loop fastener material, do not allow elements to adhere to one another in certain orientations. These same elements may be extremely difficult for children to disengage in other situations, since the bond strength does not have a maximum limit. Also, elements can not adhere to one another in certain orientations, such as an edge-to-surface orientations, with any reliability, nor can elements pivot relative to one another in such a position.

Other toys use hook-and-loop fasteners simply as a means of attachment, but are not designed to optimize the performance of a set of three-dimensional construction elements. For example, hook-and-loop material is used to create attachable building panels by MacMurray in U.S. Pat. No. 4,884,988 (1989), to create a dart board by Lemelson in U.S. Pat. No. 3,857,566 (1974), as part of a catch toy by Lee in U.S. Pat. No. 4,995,617 (1991), and in a combination of chess game and puzzle by Bifulco in U.S. Pat. No. 4,699,385 (1987).

The desire for construction toys which improve upon the basic building block is evidenced by this large array of prior art. However the continuing need for further improvement is evidenced by the fact that all the aforementioned items still contain many of the following significant limitations:

(i) They require considerable dexterity to use.

(ii) They require specific orientations between interconnected elements, limiting the types of structures which can be created.

(iii) They do not make it possible to connect the edge of one three-dimensional element to the surface of another three-dimensional element.

(iv) They do not allow such an edge-connected element to pivot around this connection.

(v) They do not allow elements to be easily attached to a structure at arbitrary angles and positions, such as side-hanging, under-hanging, or cantilevered positions.

(vi) They do not enable the creation of structures that can be lifted or rotated without the use of special, limiting connector elements.

(vii) They do not allow the interconnection of elements of significantly different geometric shapes and different sizes.

(viii) Elements made of radically different base materials (such as attaching a plush cube to a rigid base block) cannot be easily connected.

(ix) They do not allow children to create easily changeable structures large enough to play within.

(x) They do not provide connections of varying strength enabling the creation of structures with different load-bearing characteristics.

It is therefore a general object of the present invention to create construction elements, which when combined in sets, can overcome the many previously identified problems of existing construction sets.

More particularly, it is an object of the present invention to provide a set of three-dimensional construction elements that are versatile, easy to use, and have a wide variety of applications. Another object of the present invention is to provide construction elements that are a means of amusement that is safe, fun, educational, and easy to use for individuals of all ages and abilities.

An additional object of the present invention is to provide arbitrarily sized and shaped three-dimensional construction elements that can easily adhere to each other without the need for special orientation-limiting features on the elements themselves (such as mating pins and depressions), and without the use of separate connecting elements.

Another object of the present invention is to provide three-dimensional construction elements that can be easily and quickly adhered together in arbitrary orientations, which can retain such orientations until adjusted, and which can be easily and repeatedly repositioned.

A further object of the present invention is to provide construction elements that can be connected in edge-to-surface orientations, as well as surface-to-surface and partial surface-to-partial surface orientations.

Another object of the present invention is to provide construction elements that can pivot about the edge of connection, without the use of special connecting elements, when connected in an edge-to-surface orientation.

A further object of the present invention is to provide construction elements that can create structures with a virtually infinite variety of shapes, including overhanging structures, under-hanging structures and side-hanging structures, simply by placing an element where desired, without the need for special connector mechanisms.

An additional object of the present invention is to provide construction elements of a variety of sizes and shapes that can be removably adhered to one another using a common interconnect mechanism.

Another object of the present invention is to provide three-dimensional construction elements that maximize the number of ways elements can be joined to one another while minimizing the number of types of elements.

An additional object of the present invention is to provide construction elements that create three-dimensional structures that can be lifted, and arbitrarily oriented in space while maintaining structural integrity, without the use of special limiting connector mechanisms.

A further object of the present invention is to provide construction elements that enable the creation of structures composed of elements having a variety of substrates, including substrates which are rigid, or semi-rigid, or resilient, or bendable, that are connected through a common interconnecting mechanism.

Another object of the present invention is to provide construction elements and/or construction sets with mating strengths appropriate for specific applications, such as creating sturdy structures which can support the weight of small children, or providing elements which are extremely easy to pull apart for very young children or the elderly.

Another object of the present invention is to provide construction elements which allow for the creation of structures sufficiently large that children can play inside of them.

An additional object of the present invention is to provide construction elements that can be used to create aesthetically pleasing structures that have sufficient strength to support loads, for use in display applications such as in store-front window merchandise displays or in-home decorations.

An additional object of the present invention is to provide construction elements which make it easy to visually identify mating surfaces through the use of color.

A further object of the present invention is to provide construction elements which make it easy to identify elements with different mating strength characteristics through the use of color.

Further objects and advantages of the present invention will become apparent from a consideration of the drawings and the ensuing detailed description.

The preferred embodiment of the present invention has multiple three-dimensional elements of various geometric solids with both curved and planar surfaces. Either hook fastener material or loop fastener material is deposited on a substantial portion of each surface of an element. The elements adhere to one another by pressing a hook-covered surface of one element against a loop-covered surface of another element. The performance of the construction elements is optimized, and the invention objectives achieved, through the combination of components and design guidelines discussed in the following overview.

One goal of the present invention is the maximization of the number of ways in which elements can be attached to one another—this is termed the "orientation flexibility" of the elements. The orientation flexibility is measured by:

(i) The number of different surface-to-surface connections which can be made between the two elements ("combinations").

(ii) Given two elements in full surface contact, the degree to which one element can be re-positioned translationally away from the center of the other element, while still maintaining surface connection ("translational flexibility").

(iii) Given two elements in full surface contact, the degree to which one element can be re-positioned rotationally relative to the other ("rotational flexibility").

(iv) The degree to which the surface of one element can be attached at a range of angles relative to the surface of the another element ("angular flexibility").

The elements can include objects of virtually any shape. However, in the preferred embodiment, the elements are three-dimensional solids, including prisms, pyramids, cylinders, cones, and spheres. This promotes several objectives: it maximizes the opportunity for the users to apply personal creativity; it maximizes the flexibility of combinations and arrangements of the elements, allowing them to be used in a wide variety of structures and applications; and it simplifies manufacturing considerations.

One major objective of the present invention is to allow elements of widely differing sizes, shapes, and substrate characteristics to be easily attached to one another in any orientation. The physical means by which two elements attach to one another is called the "interconnect mechanism." To achieve the stated objectives, the interconnect mechanism must be extremely versatile and conceptually simple. To ensure the ready inter-connectability of elements fabricated from different substrate materials, the interconnect mechanism cannot be an integral part of the element itself. For example, protruding pins and mating depressions which are molded into the element will not function equally well for both rigid and resilient substrates. The interconnect mechanism must operate in a similar manner for all the elements, and must have predictable performance characteristics. One method for ensuring this is to make the interconnect mechanism a separately attached material common to all elements. The interconnect mechanism must meet several additional requirements. It must allow elements to adhere to one another simply by pressing one surface against another, and must make elements simple to detach and re-position. It must not interact with, or adhere to, anything outside of the construction set in an undesirable way. It must not rely on chemical adhesive means, it must be safe, and it must have a long useful life. The interconnect mechanism that meets these criteria is a separately manufactured mechanical adhesive, which in the preferred embodiment of the invention is permanently attached to the surfaces of the construction elements. While several mechanical adhesives can be used in different embodiments of the invention, the preferred embodiment of the invention uses hook and loop fastener material.

Having a mechanical adhesive substantially covering all surfaces of an element allows any type of surface to be attached to any other type of surface through a broad range of orientations. This includes attaching a planar surface of one element to a planar surface of another element, an edge of one element with a planar surface of another, the curved surface of one element with the planar surface of another, the curved surface of one element with the curved surface of another element, and even more complex connections, such as a curved edge to a planar surface, a sharp edge to a curved surface, a curved edge to a curved surface, a point to a planar surface, a point to a curved surface, or a rounded edge to a curved surface.

Hook and loop material allows the bond strength between elements to be controlled. The actual strength of a bond ($t_d$) between two elements is dependent on the strength of the fastener material (t) and the total area of contact ($a_c$), i.e., $t_d = t * a_c$. Varying the bond strength and the available bonding area are two means used to maintain a balance between the competing goals of ease of use and structural integrity. Strong bonds allow elements to adhere to one another in a wide range of orientations with minimal surface area contact. However bonds above a certain strength will be difficult for users to separate. Fastener material of relatively low bond strength will be desirable for products intended for use by young children with limited strength, and for elements with very large surface areas, to ensure that elements can be disengaged easily. High strength fastener material will be desirable for elements with small surface areas, and applications where structures with relatively high structural integrity are needed.

Two methods of limiting the bond strength between surfaces are described herein. One of the methods, termed "partial hook material deposition," is to deposit hook material on a "hook surface" in a regular pattern interspersed with uncovered areas, while loop material is substantially deposited over the entirety of each "loop surface." This method reduces the average density of hook material deposited over an entire surface (and hence reduces $t_d$), while ensuring that even relatively small areas of the hook covered surface are adherable to any portion of a loop-covered surface, thereby optimizing the tradeoff between maximizing orientation flexibility and limiting the maximum tensile disengagement force.

A construction element will have either only hook material or only loop material deposited on each surface. The particular assignment of hook and loop materials to the surfaces of a three-dimensional solid provides a "surfacing pattern." It should be noted that the term "surfacing pattern" is not meant to refer to ways of depositing both hook material and loop material on a single surface, such as dividing the square face of a cube into a checkerboard and having adjacent squares alternating between hook material and loop materials.

Certain surfacing patterns for each type of three-dimensional solid can be shown to optimize the operational capabilities of the invention by enhancing ease of use and orientation flexibility in the following ways:

(i) Limiting the number of surfacing patterns for a class of solid simplifies the manufacturing of the product, and limits the amount of learning required on the part of the user, thereby enhancing ease of use.

(ii) Applying a uniform set of surfacing guidelines to all classes of solids further minimizes the learning required on the part of the user.

(iii) For the case in which all elements have the same surfacing pattern, providing an equal number of surfaces covered in hook material and loop material optimizes the orientation flexibility, since it maximizes the number of ways in which identically surfaced elements can be connected.

(iv) For the case in which elements have different surfacing patterns, providing elements where all surfaces are covered in hook material and elements where all surfaces are covered in loop material optimizes orientation flexibility, since it maximizes the number of ways in which non-identically surfaced elements can be connected.

The present invention is also directed to the use of a mechanical adhesive and certain surfacing patterns to enable elements to be connected in an edge-to-surface configuration. This capability is created when two planar faces intersecting in an edge are covered with the same material (either hook or loop) and the edge is then adhered to the face of another element covered with the mating material. The line of contact of the edge and the surface allows the two elements to pivot. To function as a pivot, the faces of the element "on edge" need only be covered for a short distance in both directions from the edge. The performance of a pivot edge is optimized by certain surfacing patterns, as will be discussed below.

In a similar fashion, with certain surfacing patterns elements can be connected at a "pivot point." A point of an element occurs at the intersection of three or more planes, or at the tip of a converging curved surface, such as the tip of a cone. The pivot point is created when the area around the point is covered with one material (either hook or loop) and the point is adhered to the face of another element covered with the mating material. The mechanical interaction between the hook material and the loop material holds the point to the plane, but is sufficiently mobile to enable the element "on point" to pivot about that point. To function as a "pivot point," all surfaces adjoining the point need to be covered uniformly with one material from the point to some short distance away. The performance of a pivot point is optimized by certain surfacing patterns, as will be discussed below.

Color can be used to easily identify surfaces covered with mating materials, making the set of the preferred embodiment easier to use. Color can also be used to easily identify the bonding strengths of fastener materials, again facilitating ease of use. The interconnect mechanism used in the preferred embodiment of the present invention enables three-dimensional elements of arbitrary size and shape to be attached and removed with ease. However, elements outside of a certain size range are not practical, so size and weight must be constrained to ensure that relatively young children are able to easily manipulate the elements. Maintaining size and weight limits also helps to ensure the structural integrity of the resulting structures, since elements which are too heavy may not be able to maintain connections in some positions, such as under-hanging or cantilevered. Size and weight limits are necessary to insure safety, since very small elements could pose a choking hazard if swallowed, while falling heavy elements could hurt a child or damage a breakable object.

The preferred embodiment of the present invention is comprised of rigid construction elements. However alternate embodiments can be fabricated from semi-rigid, resilient and bendable materials, all of which can be interconnected through the use of the common mechanical adhesive using the surfacing patterns of the present invention, enabling the creation of a greater variety of three-dimensional structures. Structures could be formed from elements having the same type of substrate material, or different types of substrate materials. Some substrates may be more appropriate in certain applications, or for certain age groups of children. These various embodiments and their ramifications are addressed in greater detail in the Detailed Description.

BRIEF DESCRIPTION OF DRAWINGS

The accompanying drawings, which are incorporated in and form a part of the present specification, illustrate embodiments of the invention and, together with the Detailed Description, serve to explain the principles of the invention:

FIG. 18 provides a table enumerating the number of ways of connecting two right rectangular prisms in an edge-to-planar-surface arrangement for all hook-and-loop surfacing patterns.

FIG. 28 provides a table enumerating all possible hook-and-loop fastener material surfacing combinations for a right rectangular prism.

FIG. 29 provides a table enumerating the number of ways of connecting two right rectangular prisms in a face-to-face orientation for every combination of hook-and-loop surfacing.

DETAILED DESCRIPTION

Figure 1A:
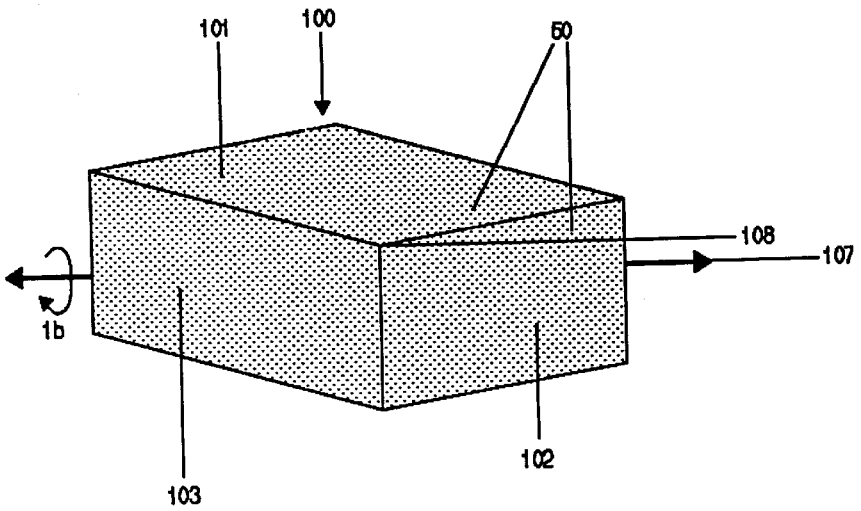
FIGS. 1*a* and 1*b* are perspective views of a right rectangular prism construction element showing the optimal hook and loop fastener material surfacing pattern.

The shapes of the elements of the preferred embodiment of the present invention are substantially comprised of geometric solids, and more specifically of cubes, right rectangular prisms, right triangular prisms, right cylinders, right rectangular pyramids, right circular cones, and spheres. These elements physically attach to one another by means of an interconnect mechanism which is common to all elements. The preferred embodiment of the invention uses hook-and-loop fastener material as the interconnect mechanism. Each three-dimensional construction element is substantially covered in hook-and-loop material, but will have either only hook material or only loop material on any given planar surface of the element, or on any given section of a curved surface. An assignment of either hook material or loop material to each surface of a three-dimensional solid provides a "surfacing pattern." (It is to be understood that the surfacing patterns of the present invention include elements having surfaces substantially or entirely covered in the specified hook-and-loop material patterns.) The surfacing pattern of a construction element is a key factor governing the performance of the present invention, since certain surfacing patterns can be shown to optimize operational capabilities by enhancing ease of use and orientation flexibility. (It should be noted that although preferred surfacing patterns will be described as having loop material assigned to a first set of surfaces and hook material assigned to the remaining surfaces, the "inverse" surfacing pattern where hook material is assigned to the first set of surfaces and loop material is assigned to the remaining surfaces will generally also be a preferred surfacing pattern.) The surfacing pattern of a right rectangular prism where three faces that meet at a corner are covered in the same fastener material, and necessarily the other three faces which meet at the opposite corner are covered in the mating material, (hereinafter referred to as the "3-Point" surfacing pattern), will be shown to optimize orientation flexibility since it provides the greatest number of ways of attaching any two identically surfaced right rectangular prisms in both face-to-face and edge-to-face orientations. The preferred surfacing patterns for three-dimensional solids other than right rectangular prisms is determined by a morphological transformation (or "morphing") of a right rectangular prism surfaced in the 3-Point pattern. Color may be used to easily identify surfaces which can removably adhere to one another, and/or to indicate the bonding strength of an interconnect material.

Operation of the Invention

The construction elements of the present invention are used by selecting the construction elements to be removably adhered to one another; identifying the mating surfaces of each element by noting which surfaces are covered in hook material and loop material, possibly by noting the colors of the surfaces; deciding which surfaces to removably adhere; and pressing the surfaces to be connected together with the desired orientation. No separate connecting elements are necessary to removably adhere elements. Detaching the elements is accomplished by pulling or prying them apart.

According to the present invention, more complex structures can be created by: varying the structural integrity by varying the bond strengths between elements using the aforementioned color identification means; varying the structural properties by interconnecting construction elements fabricated from different substrates, for instance by interspersing poseable substrate elements in a structure and posing them by bending them in the desired configurations; connecting an edge surfaced in one material on a first element to a surface covered in the mating material on a second element to create a pivot edge, as described below; and pressing a point surfaced in one material on a first element to the surface covered in the mating material on a second element to create a pivot point, as described below.

The 3-Point Surfacing Pattern

The key factor governing the performance of a set of the construction elements of the present invention is the pattern in which the elements are surfaced in fastener material. The distinct benefits of specific surfacing patterns can easily be seen by an analysis of the right rectangular prism. The right rectangular prism has three sets of two identical faces. If each face is covered with either hook material or with loop material, but not with both, the number of possible surfacing patterns is 64 ($=2^6$). However, because of the symmetry of the right rectangular prism, not all of these surfacing patterns are unique. As listed in the table of FIG. 28, there are actually 28 unique surfacing patterns for a right rectangular prism. (It can easily be seen that a right rectangular prism with a square base, ie., a square prism, has only two types of faces, thereby creating additional symmetries and reducing the number of unique surfacing patterns to 16. Furthermore, the special case of a right rectangular prism with six identical faces, i.e., a cube, reduces the number of unique surfacing patterns to 10.) Column 1 of FIG. 28 lists reference numerals to be associated with each surfacing pattern. Column 2 indicates the number of faces covered in hook material, and column 3 indicates the number of faces covered in loop material. Column 4 provides shorthand 5comments regarding unique features of the surfacing patterns. With reference to the right rectangular prism (100) shown in FIGS. 1*a* and 1*b*, columns 5 through 10 indicate the material assignment for each of the six faces (101), (102), (103), (104), (105) and (106) of the right rectangular prism (100). The 28 different surfacing patterns fall into seven groups according to the number of faces covered in hook material and the number of faces covered in loop material.

Figure 1B:
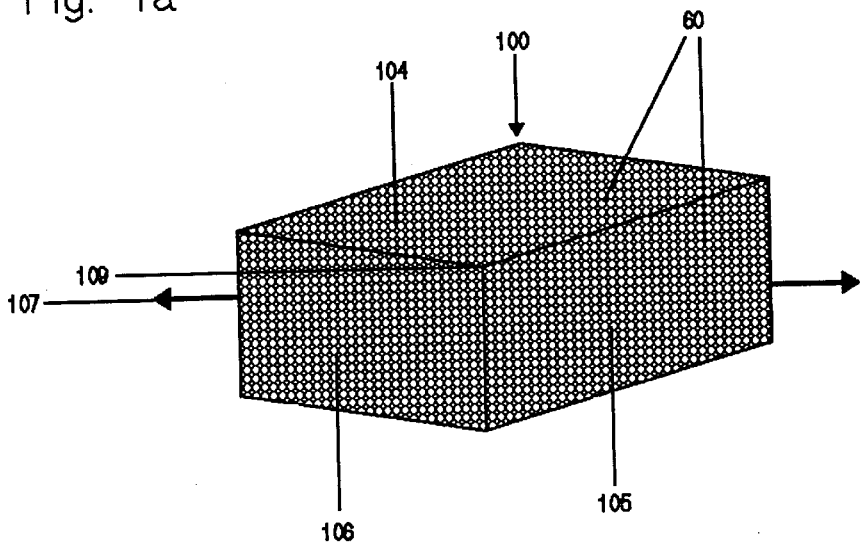

The 3-Point surfacing pattern (pattern number 17 in the table of FIG. 28) is illustrated in two orientations of a right rectangular prism (100) in FIGS. 1*a* and 1*b*, the orientation of FIG. 1*b* being achieved by a rotation of the right rectangular prism (100) of FIG. 1*a* by 180 degrees about a horizontal axis (107). Hook material (50) (represented in the figures as a fill pattern of small dots) substantially covers three surfaces (101), (102), and (103) which intersect at a first point (108). Loop material (60) (represented in the figures as a fill pattern of a square lattice of abutting circles) substantially covers the opposite three surfaces (104), (105), and (106) which intersect at a second point (109) opposite the first point (108). This surfacing pattern illustrated by the prism (100) in FIGS. 1*a* and 1*b* optimizes the number of different face-to-face and edge-to-surface connections which can be made between two identically surfaced prisms, as will be discussed in detail below. It will further be shown how the preferred surfacing patterns for other three-dimensional objects are related to this optimal surfacing pattern for the right rectangular prism (100).

Consider two prisms, prism A and prism B, each face of each prism being covered with either hook material or loop material, but not both. The two prisms can be rotated so that any two faces can be contacted to one another, and if a hook-covered face is placed in contact with a loop-covered face, a connection will occur. The number of different ways in which the prisms can be connected will depend on the surfacing pattern of the prisms. If $FH_A$ is the number of faces of prism A covered in hook material, $FH_B$ is the number of faces of prism B covered in hook material, $FL_A$ is the number of faces of prism A covered in loop material, and $FL_B$ is the number of faces of prism B covered in loop material, then the number of different ways in which prism A and prism B can be connected is given by $$(FH_A \times FL_B)+(FL_A \times FH_B).$$

The number of ways of connecting two right rectangular prisms face-to-face is listed in the table of FIG. 29 for all combinations of surfacing patterns. For Prism A, the number of faces covered in hook material, FH, and the number of faces covered in loop material, FL, is given at the top of each column of the table. For Prism B, the number of faces covered in hook material, FH, and the number of faces covered in loop material, FL, are given in the leftmost columns of the table. For example, for Prism A having 4 faces covered in hook material and 2 faces covered in loop material, and Prism B having 5 faces covered in hook material and 1 face covered in loop material, there are 14 different ways of connecting the two prisms, as shown by the entry in the second row of the third column. The cases where each prism has the same surfacing pattern correspond to the entries along the major diagonal in bold-faced type. It can be seen that a surfacing pattern of three faces covered in hook material and three faces covered in loop material (hereinafter referred to as a "3&3" surfacing pattern) will yield the greatest number of ways of connecting two identically surfaced prisms, thereby maximizing the orientation flexibility. (One unique feature of the rectangular prism surfaced in a 3&3 pattern is that it can connect to a second rectangular prism in 18 ways regardless of the surfacing pattern on the second prism.)

The 3-Point surfacing pattern shown in FIGS. 1*a* and 1*b*, in which three faces of a right rectangular prism that meet at a corner are substantially covered in the same fastener material (and necessarily the other three faces meet at the opposite corner and are substantially covered in the mating material), has several unique features. One unique feature of the 3-Point pattern is that a right rectangular prism surfaced in a 3-Point pattern has hook-covered faces and loop-covered faces oriented in all three axial directions. Therefore any size face of a right rectangular prism surfaced in a 3-Point pattern can be connected to any size face of any other rectangular prism surfaced in any other pattern. As shown above, the 3&3 surfacing pattern provides the maximum number of face-to-face connections between two identically surfaced rectangular prisms. And for two identically-surfaced right rectangular prisms, the 3-Point surfacing pattern provides the greatest number of unique connections, since it allows each of the three different sized faces of one prism to be connected to each of the different sized faces of the other prism.

With the 3-Point surfacing pattern, the surfaces of the right rectangular prism covered in hook material are contiguous and the surfaces covered in loop material are also contiguous, and opposite faces of the right rectangular prism are covered in mating materials. These features may be applied to the surfacing of geometric solids other than right rectangular prisms, resulting in a generalized 3-Point pattern which also provides ease of operability, as will be discussed below.

One of the unique features of the present invention is the ability to adhere an edge of one element to a planar surface of another element. Maximizing the number of such edge-to-planar-surface configurations requires maximizing the number of edges located between surfaces which are surfaced in the same fastener material. Referring back to FIGS. 1*a* and 1*b*, the right rectangular prism (100) has 12 edges. Edges formed between faces covered with like material will be referred to as "like-material edges." Similarly, like-material edges surfaced in loop material will be referred to as "loop-material edges," and like material edges covered in hook will be referred to as "hook-material edges." Edges formed between faces covered with mating material will be referred to as "material-transition edges."

The 3-Point pattern uniquely maximizes the number of ways of attaching two identically surfaced right rectangular prisms in edge-to-planar-surface configurations. A right rectangular prism has three sets of four edges, the edges of each set generally having a different length, and three sets of two faces, the faces of each set generally having a different size. A right rectangular prism covered in a 3-Point pattern is the only pattern which provides hook-material edges of all three lengths, loop-material edges of all three lengths, hook-covered faces of all three sizes and loop-covered faces of all three sizes. The number of different ways in which Prism A can be connected to Prism B in an edge-to-planar-surface orientation can be calculated with the formula:

$$(EH_A \times FL_B)+(EL_A \times FH_B)+(EH_B \times FL_A)+(EL_B \times FH_A),$$

where $EH_A$ is the number of hook-material edges of prism A, $EL_A$ is the number of loop-material edges of prism A, $E_{HB}$ is the number of hook-material edges of prism B, and $EL_B$ is the number of loop-material edges of prism B. ($FH_A$, $FL_B$, $FH_B$, and $FL_A$ have been previously defined.)

The number of ways of connecting two right rectangular prisms in an edge-to-surface orientation is listed in the table of FIG. 18. For Prism A, the number of faces covered in hook material, FH, the number of faces covered in loop material, FL, the number of hook-material edges EH, and the number of loop-material edges EL are given at the top of each column of the table. For Prism B, the number of faces covered in hook material, FH, and the number of faces covered in loop material, FL, the number of hook-material edges EH, and the number of loop-material edges EL are given in the leftmost column of the table. For example, for Prism A having 4 faces covered in hook material and 2 faces covered in loop material (so that there are 5 hook-material edges, and 1 loop-material edge), and for Prism B having 5 faces covered in hook material and 1 face covered in loop material (so that there are 8 hook-material edges and no loop-material edges), there are 26 different ways of connecting the two prisms in edge-to-surface orientations, as shown by the entry in the second row of the third column.

The number of different ways of connecting two identically surfaced right rectangular prisms in an edge-to-surface orientation is shown in bold-faced type along the major diagonal of the table in FIG. 18 (the matrix of entries has been broken up into two tables for ease of display). It can be seen that the 3-Point surfacing pattern provides a total of 36 edge-to-surface connections, which is the maximum number of edge-to-surface connections possible for two identically surfaced right rectangular prisms. (The alternative 3&3 surfacing pattern, in which the three like-material faces do not meet at a point, provides only 2 hook-material edges and 2 loop-material edges, and therefore provides only 24 edge-to-surface connections.)

Figure 26A:
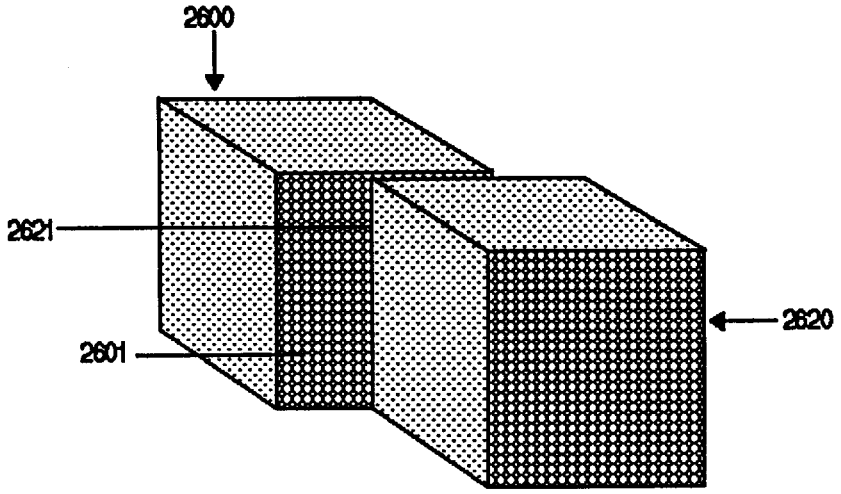
FIG. 26*a* is a perspective view of two cubes in partial surface contact where the first cube is offset horizontally with respect to the second.

The faces of the elements are substantially covered in a single fastener material, as mentioned above, since this maximizes the capability for making partial surface connections. As shown in FIG. 26*a*, a hook-covered back face (2621—the numeric designator lead line ends at the left edge of the back face since it is hidden from view) of the front cube (2620) is adhered to roughly half of the loop-covered front face (2601) of the rear cube (2600). Because the faces (2601) and (2621) are substantially covered, the front cube (2620) can be detached, moved along the face of the back cube (2600) by a small amount in any direction, and reattached to the back cube (2600). There would not be as much freedom to move and reattach the front cube (2620) if the face (2601) of the back cube (2600) was not substantially covered in fastener material. It should also be noted that having all one material on the contact face of the back cube (2600) and all mating material on the contact face (2621) of the front cube (2620) ensures that the bonding strength per unit contact area is constant for any area of contact.

Figure 26B:
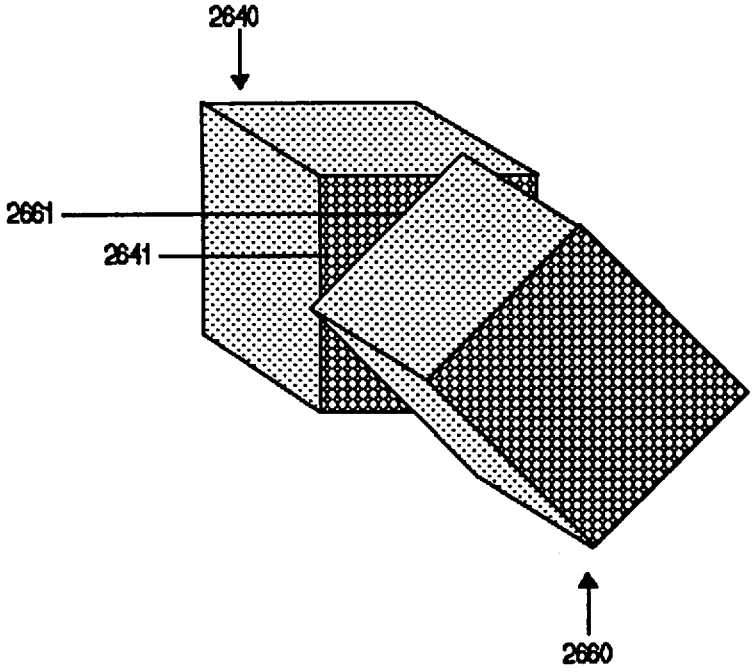
FIG. 26*b* is a perspective view of two cubes in partial surface contact where the first cube is rotated 45 degrees with respect to the second.

Assuming every surface of an element is substantially covered in fastener material, substantially covering each surface in either only hook material or only loop material maximizes the rotational flexibility of the elements. As shown in FIG. 26*b*, the front cube (2660) is rotated roughly 45 degrees relative to the rear cube (2640) to which it is attached. Having all one material on the contact face (2641) of the rear cube (2640), and all mating material on the contact face (2661—the numeric designator lead line ends at the left back face since it is hidden from view) of the rotated prism (2660) again ensures that the bonding strength per unit contact area is constant throughout 360 degrees of rotation of the prism (2660).

The benefits of 3&3 surfacing patterns, and particularly the 3-Point pattern, are that they optimize the balance between two offsetting major objectives: maximizing orientation flexibility and maximizing ease of use. Consider a set of construction elements comprised of right rectangular prisms. Providing the absolute maximum orientation flexibility in the set would require providing elements covered in all possible surfacing patterns (therefore requiring at least 28 different elements). But ease of use is maximized when all elements are identically surfaced, so that the user can pick any element from the set and know precisely how it will operate. The 3-Point pattern is the surfacing pattern which provides the greatest orientation flexibility for identically surfaced elements, hence optimizing this tradeoff between orientation flexibility and ease of use.

Substantially surfacing right rectangular prisms in 3&3 patterns maximizes orientation flexibility in several ways. As discussed above and shown in the table in FIG. 29, for two right rectangular prisms with identical surfacing patterns, a 3&3 pattern provides the maximum number of different face-to-face connections (maximum combinatorial flexibility). For any of these face-to-face combinations, one prism can be re-positioned rotationally relative to the other prism through 360 degrees of rotation (maximum rotational flexibility). For any of these face-to-face combinations, the two prisms can be attached with (practically) any portion of their faces overlapping (maximum translational flexibility). The 3-Point surfacing pattern provides still greater orientation flexibility than the other 3&3 patterns, since it is the only 3&3 pattern which allows for face-to-face connections in all three axial directions. Furthermore, the 3-Point pattern maximizes the number of edge-pivoting configurations for two identically surfaced prisms. The 3-Point surfacing pattern is also the only 3&3 surfacing pattern which has three planes surfaced in the same fastener material intersecting in a point. This also makes 3-Point the only 3&3 pattern which allows the prism to be placed in a point-to-planar-surface configuration.

Ease of use is enhanced by limiting the number of surfacing patterns, since this reduces the amount of learning. It also simplifies the manufacturing of the product by limiting the number of different types of surfacing patterns which must be fabricated.

Surfacing Pattern Guidelines

A set of general principles or guidelines for surfacing any three-dimensional solid with hook and loop material has been developed by drawing parallels to the 3-Point and 3&3 surfacing patterns used for right rectangular prisms. This leads to benefits similar to those demonstrated for right rectangular prisms. These guidelines for surfacing an element are:

(i) Every planar surface of an element has either only hook material deposited upon it or only loop material deposited on it.

(ii) The surface area covered in hook material and the surface area covered in loop material are roughly equal.

(iii) The surfaces covered in hook material are contiguous, and the surfaces covered in loop material are contiguous.

(iv) Opposing planar surfaces, or points on a curved surface separated by 180 degrees of rotation of the element about some axis, are covered in mating materials. For example, one base of a hexagonal prism is covered with hook material and one base is covered with loop material. In the case of the lateral surface of a cylinder, two points which are separated by 180 degrees of rotation about the major axis of the cylinder are covered in mating materials.

(v) Curved surfaces covering greater than 180 degrees of curvature are divided into two roughly equal, contiguous sections, with one section being substantially covered in hook material and the other section being substantially covered in loop material. Curved surfaces covering 180 degrees or less of curvature are covered in just one fastener material.

(vi) When possible, the number of surfaces with hook material and the number of surfaces with loop material is equal. Elements with an odd number n of planar surfaces will have two alternative surfacing patterns: one with (n−1)/2 faces covered in hook material and (n+1)/2 faces covered in loop material; and one with (n+1)/2 faces covered in hook material and (n−1)/2 faces covered in loop material.

(vii) Each class of three-dimensional solids will have a small number of surfacing patterns, preferably one.

It should be noted that not every shape class allows for compliance with all of the guidelines listed above. For example, a pentagonal prism has an odd number of faces, so it must either have an unequal number of hook faces and loop faces (and therefore not have equal areas of hook-covered surface and loop-covered surface), or one face must be vertically divided, with one-half hook-covered and one-half loop-covered.

The surfacing patterns for all solids other than rectangular prisms based on these parallels are termed "3-Point derivatives." In the present discussion of 3-Point derivatives, the three-dimensional solids are divided according to six shape classes: pyramids, cones, cylinders, ellipsoids, prisms, and regular polyhedra. Within these classes are special cases. For instance, right rectangular prisms and cubes are special cases of the prism class, and spheres are a special case of the ellipsoid class. Other three-dimensional solids can be created by cutting or truncating one of the previously listed solids. For example, hemispheres are created by dividing a sphere along its equator.

The preferred surfacing pattern for any three-dimensional solid can be determined by applying the general surfacing pattern rules listed above. The preferred surfacing pattern can also be seen as a morphological transformation (morphing) of the 3-Point pattern for a right rectangular prism. Maintaining these parallels to the 3-Point pattern reduces the amount of learning required of the user, since all elements interact with one another in a consistent fashion.

Figure 10:
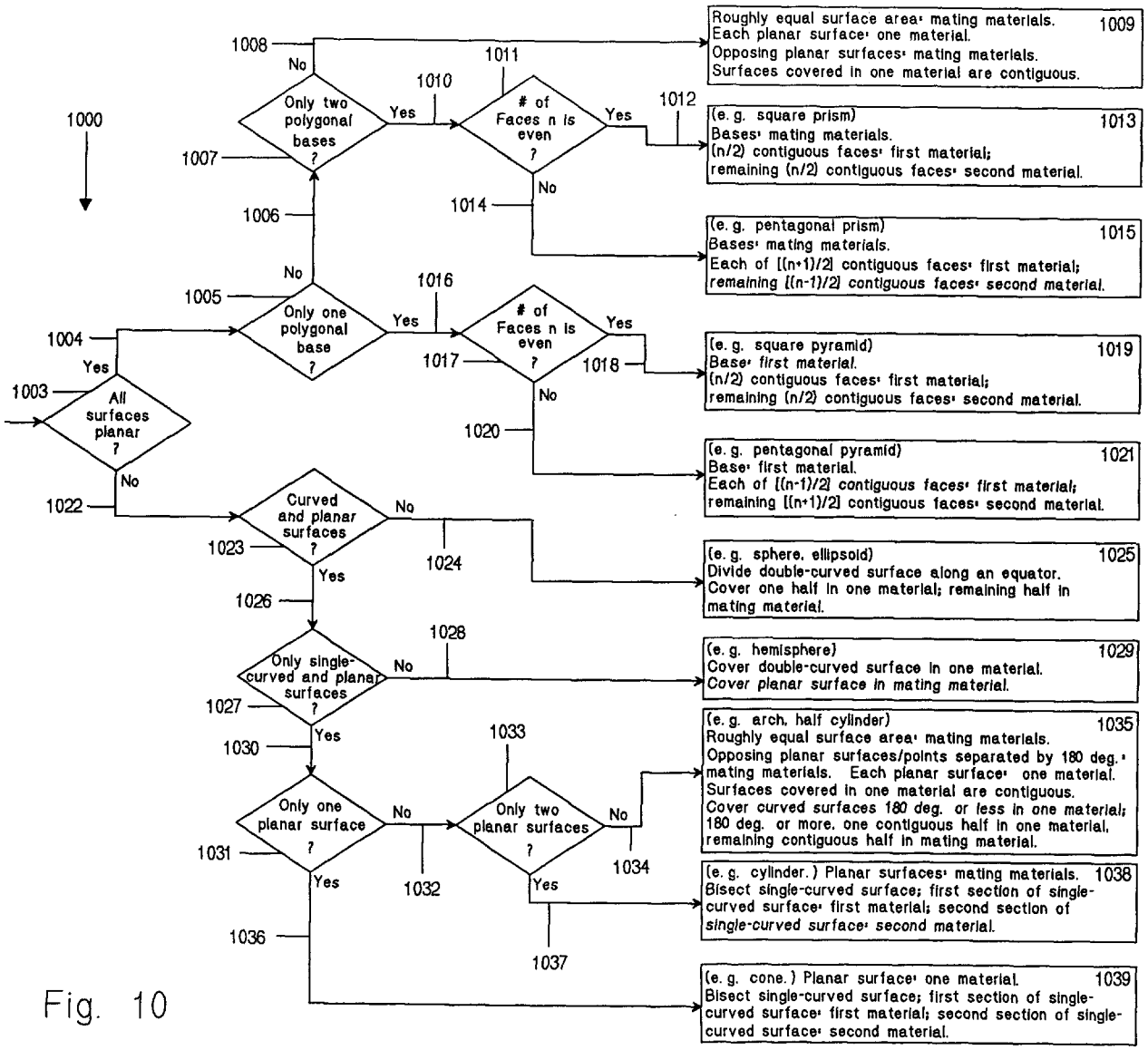
FIG. 10 is a flow chart depicting the rules for selecting the preferred surfacing pattern for any three-dimensional construction element.

The decision tree (1000) depicted in FIG. 10 provides the means to apply the general surfacing pattern rules listed above. Beginning with any three-dimensional object, the logic progresses through a series of diamond-shaped decision boxes. Each decision box has one entry path and two exit paths, the appropriate exit path being determined by the response to the question in the box. At the end of each path is a rectangular box containing a surfacing rule. The surfacing rules separate the surfaces of an object into three general classifications: planar surfaces, single-curved surfaces, and double curved surfaces. Single-curved surfaces are surfaces that may be generated by a straight line moving in contact with a curve, the most common examples being cylinders and cones, which are generated by revolving a straight line segment about a circle. A double-curved surface is generated by a moving curved line and contains no straight-line elements, a common example being the sphere, which is generated by revolving a circle about one of its diameters. The analysis provided by the flowchart can be applied to any three-dimensional solid, as will be demonstrated in the following discussion of the preferred surfacing patterns.

A prism has two bases, which are parallel congruent polygons, and three or more lateral faces, which are parallelograms. For example, a right square prism has two square bases and four rectangular faces. The preferred surfacing pattern for a right square prism can be determined from the methodology specified in the flowchart in FIG. 10 in the following manner. It is first determined if all the surfaces of the object are planar (1003). For a prism the answer is yes (1004), so it is next determined if the object has only one polygonal base (1005). In the case of a prism the answer is no (1006), so it is then ascertained if the object has only two polygonal bases (1007). Since the answer is yes (1010), it is next determined if the number of faces on the object is even (1011). Since the right square prism has four faces, the answer is yes (1012), so the surfacing rule (1013) for a prism with an even number of faces n is: one base is substantially surfaced in a first fastener material; the opposite base is substantially surfaced in a second mating material; n/2 contiguous faces are substantially surfaced in a first fastener material; and the remaining n/2 contiguous faces are substantially surfaced in the second mating material.

Figure 6A:
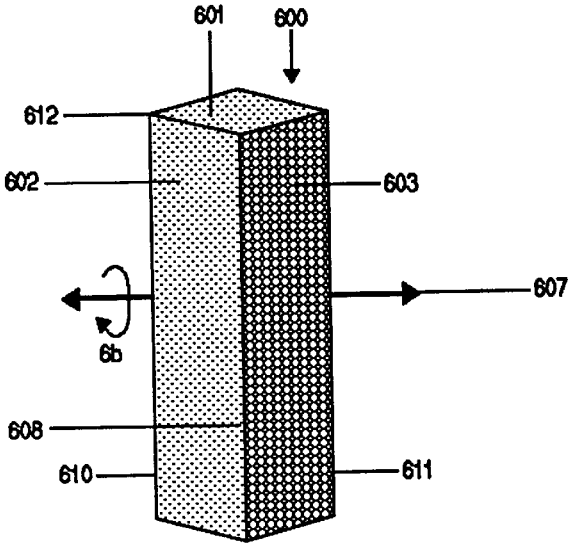
FIGS. 6*a*, 6*b*, 6*c*, and 6*d* are perspective views illustrating the relationship between the preferred surfacing patterns for a right square prism and a cylinder.
Figure 6B:
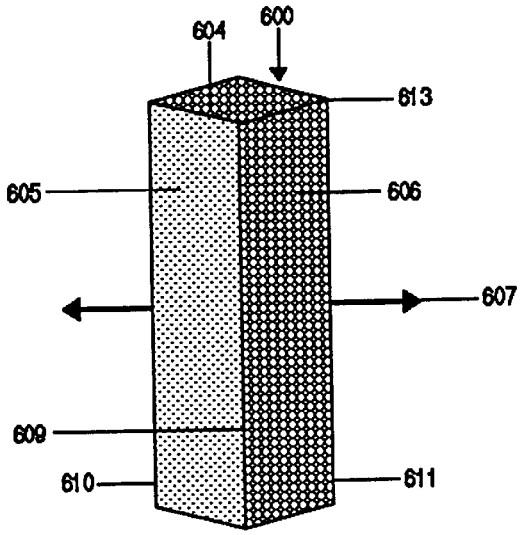

This surfacing pattern is illustrated in FIGS. 6*a* and 6*b*, which show two orientations of a right square prism (600), the orientation of FIG. 6*b* being achieved by a rotation of the right square prism (600) of FIG. 6*a* by 180 degrees about a horizontal axis (607). Hook material covers three surfaces (601), (602), and (605) which intersect at a first point (612). Loop material covers the opposite three surfaces (603), (604), and (606) which intersect at a second point (613) opposite the first point (612). There are six like-material edges and six material-transition edges on the right rectangular prism (600). For instance, the intersection of the face (602) covered in hook material and the face (603) substantially covered in loop material creates a material-transition edge (608), and the intersection of the face (605) covered in hook material and the face (606) substantially covered in loop material creates a material-transition edge (609).

Figure 5A:
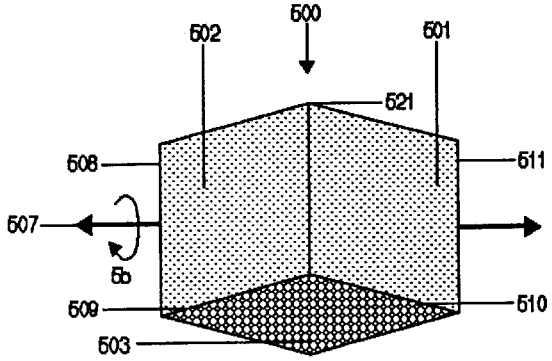
FIGS. 5*a*, 5*b*, 5*c*, and 5*d* are perspective views illustrating the relationship between the preferred surfacing patterns for a cube and a sphere.
Figure 5B:
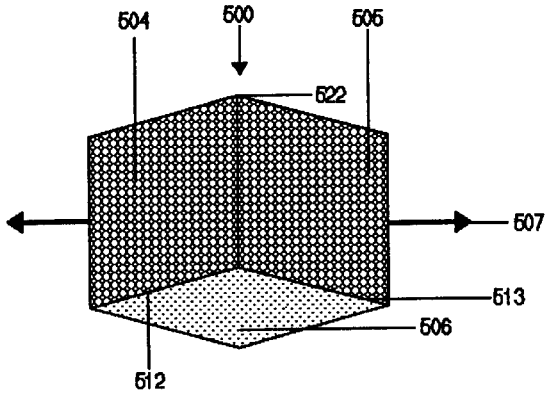

The cube is a special case of the rectangular prism where all edges are of equal length, so the preferred surfacing pattern for a cube can be determined from the preferred surfacing pattern for a rectangular prism, as previously described. FIGS. 5*a* and 5*b* show two orientations of a cube (500), the orientation of FIG. 5*b* being achieved by a rotation of the cube (500) of FIG. 5*a* by 180 degrees about a horizontal axis (507). Hook material covers three surfaces (501), (502), and (506) which intersect at a first point (521), and loop material substantially covers the opposite three surfaces (503), (504), and (505) which intersect at a second point (522) opposite the first point (521).

The preferred surfacing pattern for a prism with an odd number of faces, such as a triangular prism, which has two congruent triangular bases, and three rectangular faces, can similarly be determined by following the methodology in the flowchart in FIG. 10. All the surfaces of the triangular prism are planar (1003/1004), and the prism has more than one polygonal base (1005/1006), but not more than two polygonal bases (1007/1010). Therefore, it is then determined if the number of faces on the object is even (1011). Since the right triangular prism has three faces, the answer is no (1014), so the surfacing rule (1015) for a prism with an odd number of faces n is: one base is substantially surfaced in a first fastener material; the opposite base is substantially surfaced in a second mating material; (n+1)/2 contiguous faces are substantially surfaced in a first fastener material; and the remaining (n−1-)/2 contiguous faces are substantially surfaced in the second mating material.

Two orientations of a right triangular prism (800) surfaced as described above are shown in FIGS. 8*a* and 8*b*, the orientation of FIG. 8*b* being achieved by a rotation of the right triangular prism (800) of FIG. 8*a* by 180 degrees about a horizontal axis (806). The triangular prism (800) consists of five planar surfaces: two bases (801) and (805) which are scalene right triangles and three generally non-equivalent rectangular faces: a small rectangular face (803), a larger rectangular face (802) perpendicular to the smaller face (803), and a large rectangular face (804). Loop material substantially covers one triangular base (801) and the largest rectangular face (804). Hook material substantially covers the opposite triangular base (805) and the two smaller rectangular adjacent faces (802) and (803).

This surfacing pattern for the triangular prism (800) maximizes the operational flexibility similar to the 3-Point pattern for right rectangular prisms. It can be shown that there are 32 ways to cover the surfaces of a right triangular prism in hook and loop material. Providing three surfaces covered in hook material and two surfaces covered in loop material (hereinafter designated as a "3&2" surfacing pattern) maximizes the combinatorial flexibility for identically surfaced right triangular prisms according to an analysis similar to that described above for the rectangular prism. (The inverse surfacing pattern of two substantially hook-covered surfaces and three substantially loop-covered surfaces, termed a "2&3" surfacing pattern, provides an equal number of combinatorial possibilities.) Neither of these surfacing patterns provides equal amounts of hook-covered surface area and loop-covered surface area. However, for a solid with an odd number of faces, these patterns follow as nearly as possible the general surfacing rules. Also, these surfacing patterns do loosely obey the rule of having opposite surfaces covered in mating materials.

Figure 8A:
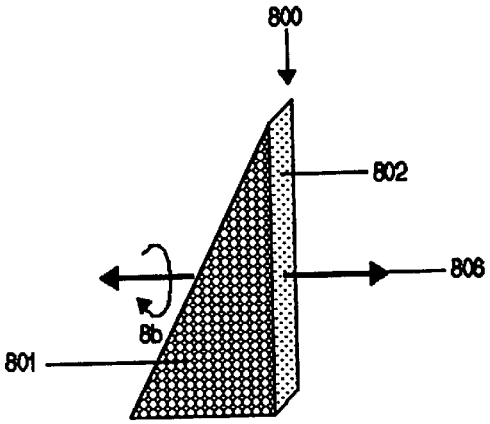
FIGS. 8*a* and 8*b* are perspective views illustrating a preferred surfacing pattern for a right triangular prism.
Figure 8B:
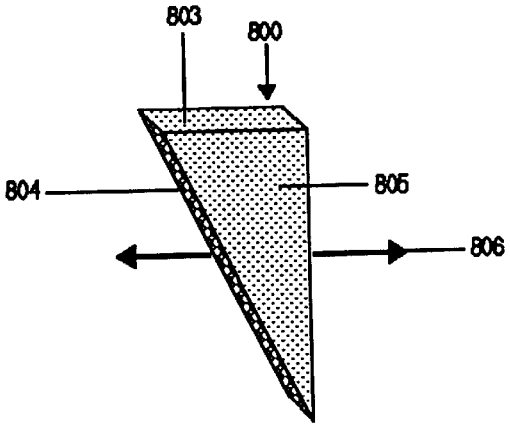
Figure 8C:
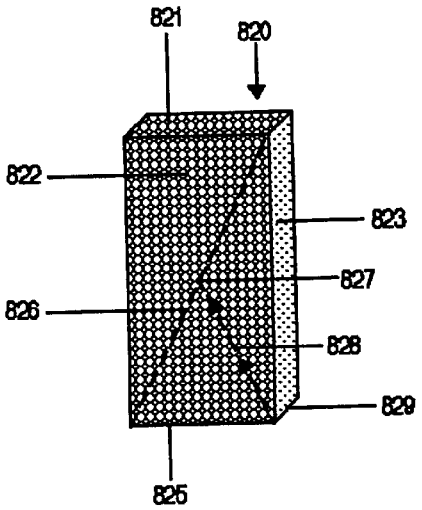
FIGS. 8*c* and 8*d* are perspective views of two right triangular prisms illustrating the relationship between the preferred surfacing patterns for right triangular prisms and a right rectangular prism.
Figure 8D:
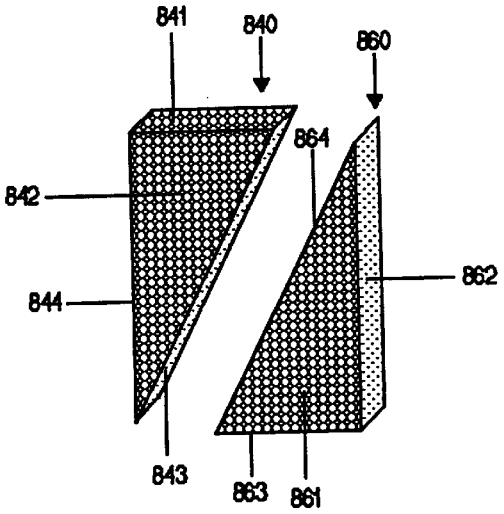

The parallel between the 3-Point surfacing pattern for right rectangular prisms and the 3-Point derivative surfacing for right triangular prisms is shown in FIG. 8*c*. If the edge (829) formed between the right-hand and bottom hook-covered rectangular faces (823) and (825—the bottom surface is hidden from view so the numeric designator lead line ends at the front edge of the surface) is deformed inward along a diagonal path (828) in the direction of the arrows to the center point (827), the right-hand and bottom hook-covered rectangular faces (823) and (825) merge into a single face, resulting in a triangular prism, such as the triangular prism (840) shown on the left side of FIG. 8*d*. Another parallel between the preferred surfacing patterns for triangular prism and rectangular prisms can be seen by cutting the right rectangular prism (820) of FIG. 8*c* in half along the diagonal (826) of its largest face (822) to provide two right triangular prisms (840) and (860), as shown in FIG. 8*d*. The right triangular prism (840) on the left has its largest rectangular face (843) substantially covered in hook material since it is opposite the two smaller rectangular faces (841) and (844) substantially covered in loop material, creating a 2&3 surfacing pattern. The right triangular prism (860) on the right has its largest rectangular face (864—the numeric designator lead line ends at the front edge of the surface since the surface is hidden from view) covered in loop material since it is opposite the smaller right-hand and bottom rectangular faces (862) and (863—the numeric designator lead line ends at the front edge of the surface since the bottom surface is hidden from view) covered in hook material, creating a 3&2 surfacing pattern. The 2&3—covered prism (840) can be connected to the 3&2—covered prism (860) along their respective diagonal faces (843) and (864) to create a rectangular prism with a 3-Point surfacing pattern. These surfacing patterns for triangular prisms are clearly related to that of the rectangular prism, thereby enhancing the ease of use of the elements.

Surfacing patterns for other prisms can be determined via a transformation of a rectangular prism covered in a 3-Point surfacing pattern in a similar manner. Consider the square prism (600) shown in FIGS. 6*a* and 6*b*. If the like-material edge (610) between the two hook-covered rectangular faces (602) and (605) is beveled parallel to the longitudinal axis of the prism (600), an additional rectangular face is created. If the like-material edge (611) between the two loop-covered rectangular faces (603) and (606) is similarly beveled, the resulting solid is a hexagonal prism. Following rule (iii) of the surfacing pattern guidelines, the first new face would be substantially covered with hook material, since it is between faces (602) and (605) covered in hook material, and the second new face would be substantially covered with loop material, since it is between faces (603) and (606) covered in loop material. This provides a hexagonal prism with opposite faces covered in mating materials, equal number of faces with hook material and loop material, and the hook-covered surfaces and the loop-covered surfaces being contiguous. This surfacing pattern also maximizes the number of potential pivot edge configurations by maximizing the number of like-material edges. The generalization of this transformation to any prism whose base is a polygon with an even number of sides (such as an octagonal prism), can easily be seen.

A pyramid has a single polygonal base and triangular lateral faces meeting at an apex. The preferred surfacing pattern for a square pyramid, which has a square base and four triangular faces, can be determined from the methodology specified in the flowchart in FIG. 10. Since all surfaces are planar (1003/1004), it is determined if the object has a single polygonal base (1005). Since the answer is yes (1016), it is then determined if the number of faces on the square pyramid is even (1017). The answer is yes (1018), so the surfacing rule (1019) for a pyramid with an even number of faces n is: the base is surfaced in one fastener material; (n/2) contiguous faces are surfaced in a first fastener material; and the remaining (n/2) contiguous faces are surfaced in a second mating material.

Figure 7A:
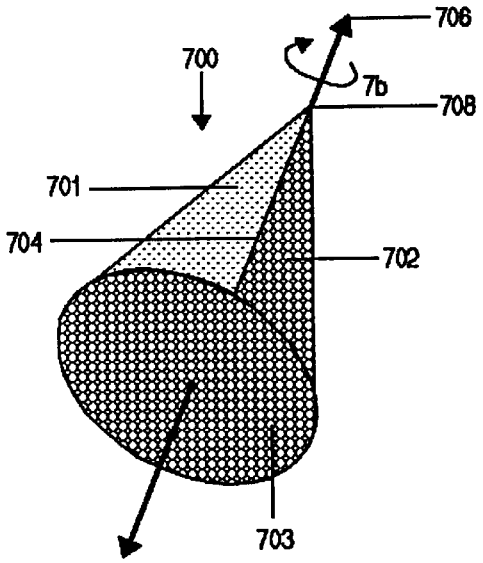
FIGS. 7*a* and 7*b* are perspective views showing a preferred surfacing pattern for a cone.
Figure 7B:
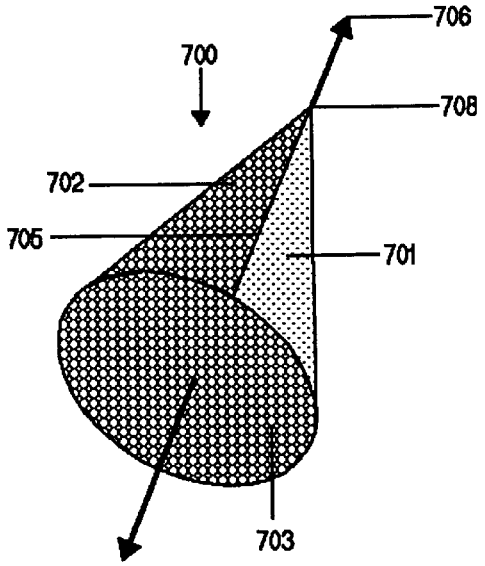
Figure 7C:
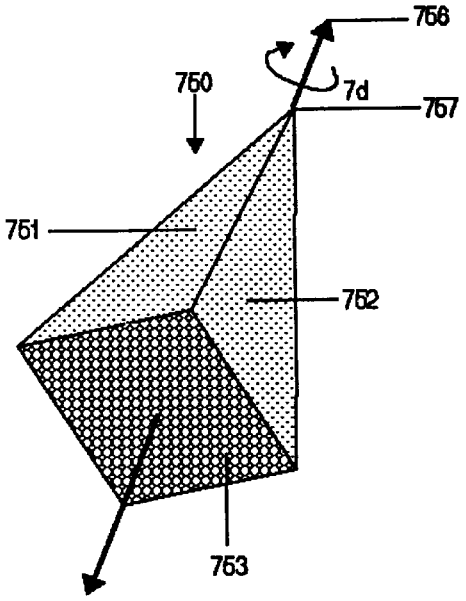
FIGS. 7*c* and 7*d* are perspective views showing a preferred surfacing pattern for a pyramid.
Figure 7D:
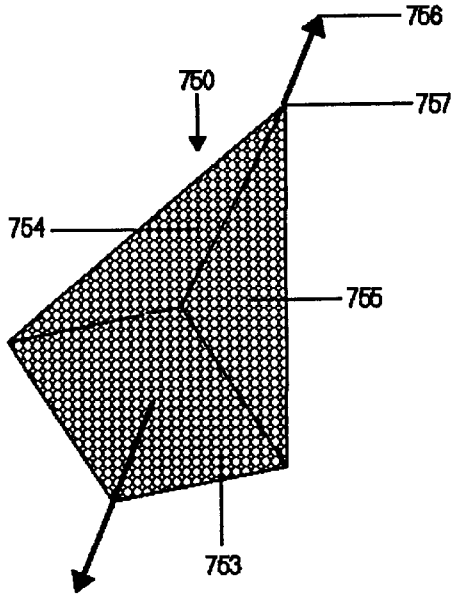

An example of this surfacing pattern is illustrated in FIGS. 7*c* and 7*d* which show two orientations of a right square pyramid (750), the orientation of FIG. 7*d* being achieved by a rotation of the right square pyramid (750) of FIG. 7*c* by 180 degrees about a vertical axis (756). Loop material covers the square base (753) and the two adjacent triangular faces (754) and (755), and hook material covers the opposite two adjacent triangular faces (751) and (752).

This surfacing pattern can be obtained by a transformation of the right square prism (600) of FIG. 6*a*, by removing the hook-covered base (601) and merging the corners of the rectangular faces (602), (603), (605) and (606) adjacent the removed base (601) into a point to produce the apex (757) of the four triangular faces (751), (752), (754), and (755). Because the pyramid (750) has only one base (753), its preferred surfacing pattern has two forms, a first pattern having a hook-covered rectangular base, an inverse pattern having a loop-covered rectangular base. The surfacing patterns provide mating materials on opposite triangular faces, and provides a contiguous hook-covered area and a contiguous loop-covered area. It can be shown that there are 20 unique ways of surfacing a rectangular pyramid, and that the surfacing patterns with three surfaces of a first material and two surfaces of a second material provide the greatest number of possible connections to other right rectangular pyramids surfaced in the same pattern.

The preferred surfacing pattern for a pyramid with an odd number of faces, such as a heptagonal pyramid, which has one heptagonal base and seven triangular faces, can similarly be determined by following the methodology in the flowchart in FIG. 10. Since all the surfaces of the heptagonal pyramid are planar (1003/1004), it is determined if the object has a single polygonal base (1005). Since the answer is yes (1016), it is then determined if the number of faces is even (1017). Since the heptagonal pyramid has seven faces, the answer is no (1020), so the surfacing rule (1021) for a pyramid with an odd number of faces n is: the base is covered in a first fastener material; (n−1)/2 contiguous faces are surfaced in a first fastener material; and the remaining (n+1)/2 contiguous faces are surfaced in a second mating material. This provides, as nearly as possible, equal surface areas covered in the first material and the second material.

The preferred surfacing pattern for a cylinder (having two parallel circular bases and a single-curved lateral surface) can be determined from the methodology specified in the flowchart in FIG. 10. It is first determined if all surfaces are planar (1003). Since for a cylinder the answer is no (1022), it is next ascertained if both curved and planar surfaces are present (1023). Since the answer is yes (1026), it is next determined if only single-curved surfaces and planar surfaces are present on the object (1027) (i.e., there are no double-curved surfaces). For a cylinder this is true (1030) (the lateral surface is a single-curved surface), so it is then ascertained if the object has only one planar surface (1031). Since the answer is no (1032), it is next determined if the object has only two planar surfaces (1033). The cylinder has two circular planar bases, so the answer is yes (1037), leading to the rule (1038) for surfacing the object: the single-curved lateral surface is bisected by a plane which also bisects the bases; one half of the lateral surface is covered in a first fastener material, and the other half is covered in a second mating material; one planar surface is covered in the first fastener material, and the other planar surface is covered in the second mating material.

Figure 6C:
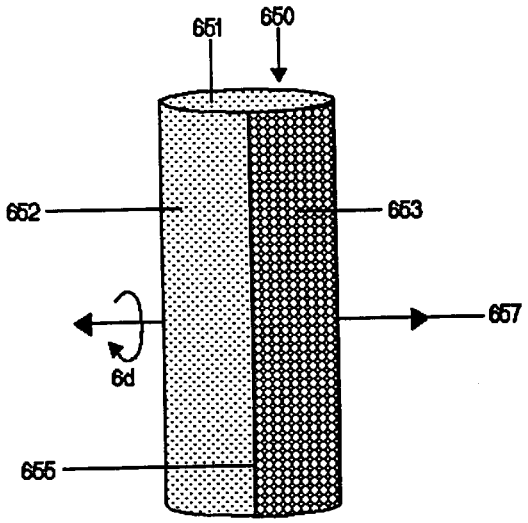
Figure 6D:
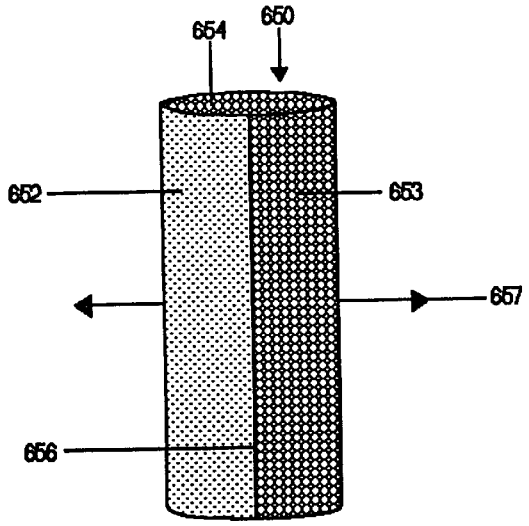

An example of this surfacing pattern is illustrated in FIGS. 6*c* and 6*d* which show two orientations of a right cylinder (650), the orientation of FIG. 6*d* being achieved by a rotation of the right cylinder (650) of FIG. 6*c* by 180 degrees about a horizontal axis (657). Hook material substantially covers one circular base (651), while loop material substantially covers the opposite circular base (654). Hook material substantially covers one-half the lateral curved surface (652), while loop material substantially covers the opposite half of the lateral curved surface (653), with the two curved surfaces intersecting in two material-transition edges (655) and (656) which are 180 degrees opposed from each other.

The preferred surfacing pattern for a right cylinder can also be determined by a transformation of a right square prism covered in a 3-Point surfacing pattern, as shown in FIGS. 6*a* and 6*b*. The surfacing pattern on the cylinder (650) results from taking the right square prism (600) of FIGS. 6*a* and 6*b* and "rounding" the edges (608), (609), (610) and (611) and faces (602), (603), (605) and (606) so that bases (601) and (604) become circles. The longitudinal material-transition lines (655) and (656) between the two sectors (652) and (653) of the cylinder (650) is directly analogous to the material-transition edges (608) and (609) of the square prism (600). This surfacing pattern for the cylinder has the desired properties of: equal areas of hook-covered surface and loop-covered surface; opposite surfaces covered in mating materials; and like material surfaces being contiguous. This parallel between the cylinder (650) and the right square prism (600) enhances ease of use, since the cylinder (650) and prism (600) connect to other elements in a consistent fashion.

The preferred surfacing pattern for a cone (having one circular base and a single-curved lateral surface which tapers from the base to an apex) can be determined from the methodology specified in the flowchart in FIG. 10. All the surfaces are not planar (1003/1022), there are both curved and planar surfaces (1023/1026), and the surfaces are only single-curved and planar surfaces (1027/1030). Since the cone has just one circular planar base (1031/1036), the rule (1039) for surfacing a cone is: the single-curved lateral surface is bisected by a planar surface which also bisects the base; one half of the lateral surface is covered in a first fastener material; the other half is covered in a second mating material; and the planar surface is covered in only one fastener material.

FIGS. 7*a* and 7*b* show two orientations of a right cone (700) with this surfacing pattern, the orientation of FIG. 7*b* being achieved by a rotation of the right cone (700) of FIG. 7*a* by 180 degrees about a vertical axis (706). Loop material covers the circular base (703) and one-half of the lateral curved surface (702), and hook material covers the opposite lateral curved surface (701). The two curved surfaces intersect at two material-transition edges (704) and (705) which are 180 degrees opposed from each other.

This surfacing pattern for the cone (700) can be obtained by a transformation of the surfacing pattern for the right cylinder (650) depicted in FIGS. 6*c* and 6*d* by removing the hook-covered circular base (651) and tapering the lateral surfaces (652) and (653) adjacent to the removed base (651) to a point, the apex (708) of the cone (700). Because a cone has only one base, the preferred surfacing pattern has two forms, one surfacing pattern has a substantially hook-covered base and the inverse surfacing pattern has a substantially loop-covered base. The preferred surfacing pattern for a cone complies with the surfacing pattern guidelines, and allows a cone to connect to other elements in a fashion consistent with the other elements, enhancing ease of use.

It can be noted that the surfacing pattern for a cone can also be derived from the surfacing pattern for a pyramid by "rounding" the edges, faces and base of a pyramid. This transformation process is analogous to the process described above relating a cylinder to a square prism.

The preferred surfacing pattern for a sphere can also be determined from the methodology specified in the flowchart in FIG. 10. Since all the surfaces are not planar (1003/1022), it is next determined if the sphere has both curved and planar surfaces (1023). The answer is no (1024), which leads to the rule (1025) for covering an object which has only double-curved surfaces: divide the double-curved surface along an equator; one half of the surface is covered in a first fastener material; and the remaining half is covered in a second mating material.

Figure 5C:
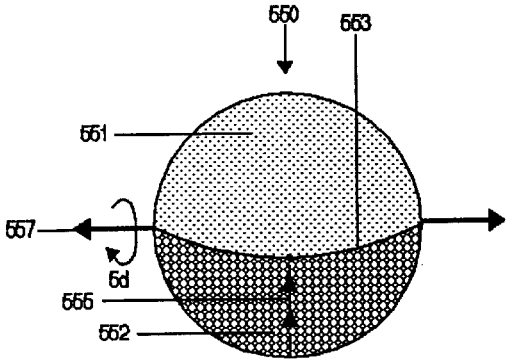
Figure 5D:
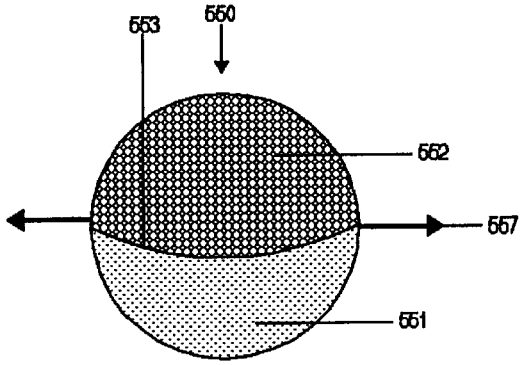

This surfacing pattern is illustrated in FIGS. 5*c* and 5*d* which show two orientations of a sphere (550), the orientation of FIG. 5*d* being achieved by a rotation of the sphere (550) of FIG. 5*c* by 180 degrees about an equatorial axis (557). Hook material substantially covers one hemisphere (551) and loop material substantially covers the other hemisphere (552), creating a material transition line (553) around the equator of the sphere (550).

The preferred surfacing pattern for a sphere can also be determined by a transformation of a cube surfaced in a 3-Point pattern. Referring to FIGS. 5*a* and 5*b*, two views of a cube (500) covered in a 3-Point surfacing pattern are shown, as discussed above. The three hook-covered faces (501), (502) and (506) are equivalent, and likewise the loop-covered faces (503), (504) and (505) are equivalent. Referring to FIGS. 5*c* and 5*d* two similar views of a sphere (550) are shown. The view on the left shows the hook-covered hemisphere (551) on top and the loop-covered hemisphere (552) on the bottom. In the view on the right, the sphere has been rotated 180 degrees about the equatorial axis (557), so that the loop-covered hemisphere (552) is on top, and the hook-covered hemisphere (551) is on the bottom. This surfacing pattern for the sphere (550) would result from taking the cube (500) and "rounding" each of the 12 edges and six surfaces to create a sphere. The circumferential material-transition line (553) between the hemispheres (551) and (552) is analogous to the connected material-transition edges (508), (509), (510), (511), (512) and (513) of the cube (500). This surfacing pattern for the sphere (550) provides equal areas of hook-covered surface (551) and loop-covered surface (552), opposite surfaces are covered in mating materials, the area covered in hook material is contiguous, and the area covered in loop material is contiguous, just as for the cube (500) covered in the 3-Point pattern. This parallel between the surfacing of the sphere (550) and the cube (500) enhances ease of use, since the sphere (550) and cube (500) connect to other elements in a consistent fashion.

Figure 14A:
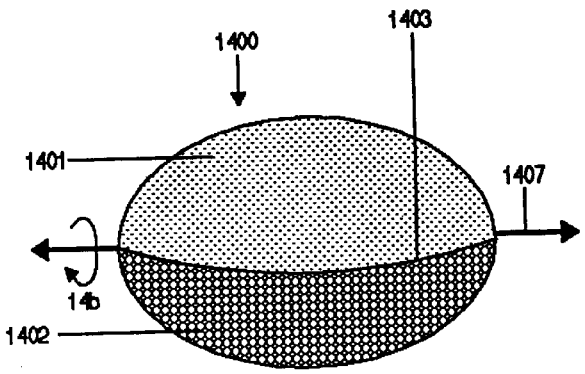
FIGS. 14*a*, 14*b*, 14*c*, and 14*d* are perspective views illustrating two preferred surfacing patterns for ellipsoids.
Figure 14B:
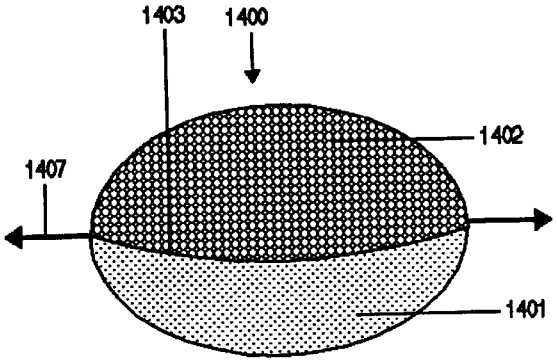

The preferred surfacing pattern for an ellipsoid can also be determined from the methodology specified in the flowchart in FIG. 10, and follows the exact same path as that for the sphere, resulting again in rule (1025). For an ellipsoid, the curved surface is divided into two halves along an equator, with one half being substantially hook-covered and the other half being substantially loop-covered. This surfacing pattern is illustrated in FIGS. 14*a* and 14*b*, which show two orientations of an ellipsoid (1400), the orientation of FIG. 14*b* being achieved by a rotation of the ellipsoid (1400) of FIG. 14*a* by 180 degrees about the major axis (1407). Hook material substantially covers the top half (1401) of the ellipsoid and loop material substantially covers the bottom half (1402) of the ellipsoid (1400), creating a material transition line (1403) around the large equator of the ellipsoid (1400), the equator being in the same plane as the major axis of the ellipsoid.

Figure 14C:
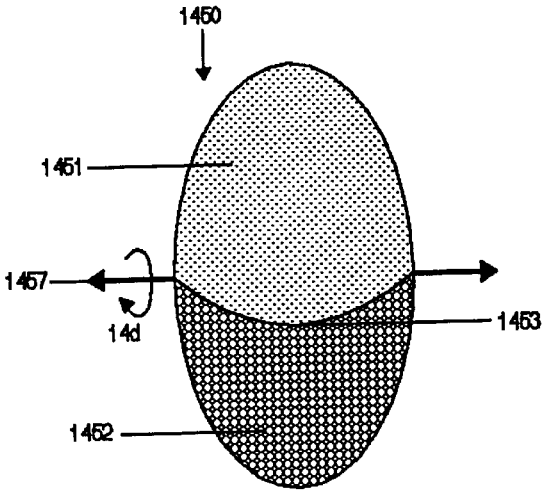
Figure 14D:
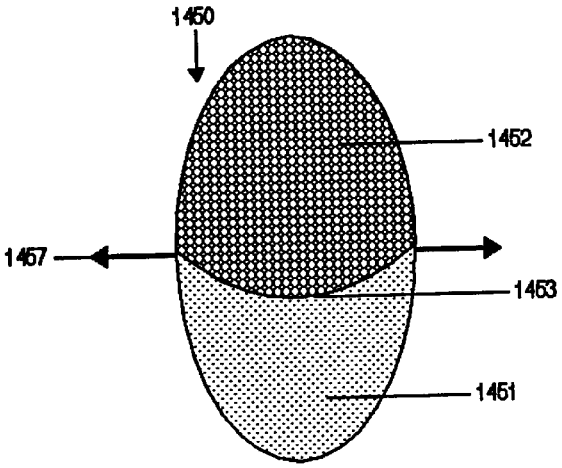

The ellipsoid has a second equally preferred surfacing pattern which also follows the general surfacing pattern guidelines specified above. This surfacing pattern is illustrated in FIGS. 14*c* and 14*d* which show two orientations of an ellipsoid (1450), the orientation of FIG. 14*d* being achieved by a rotation of the ellipsoid (1450) of FIG. 14*c* by 180 degrees about the minor axis (1457). Hook material substantially covers the top half (1451) of the ellipsoid and loop material substantially covers the bottom half (1452) of the ellipsoid (1450), creating a material transition (1453) around the small equator of the ellipsoid (1450), the small equator being in the same plane as the minor axis of the ellipsoid (1450).

The preferred surfacing pattern for a hemisphere can be also be determined from the methodology specified in the flowchart in FIG. 10. Since all the surfaces of a hemisphere are not planar (1003/1022), it is next determined that the hemisphere has both curved and planar surfaces (1023/1026). It is then determined if it has both single-curved and planar surfaces. Since the hemisphere consists of a double-curved surface and a circular planar base, the answer is no (1028), which leads to the rule (1029): cover the double-curved surface in a first fastener material, and the planar surface in the mating material.

Figure 5E:
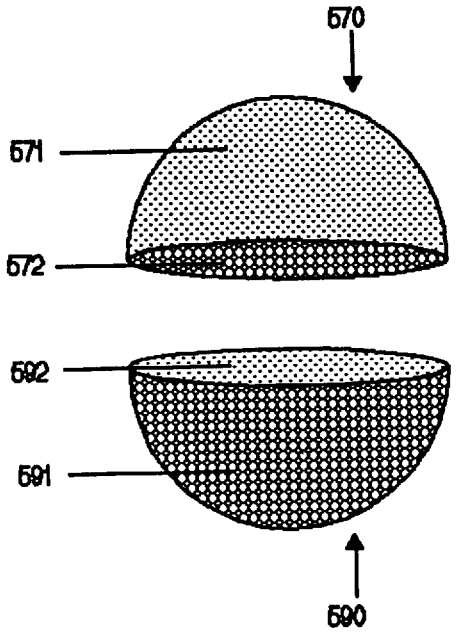
FIG. 5*e* is a perspective view illustrating the preferred surfacing pattern for hemispheres.

FIGS. 5*c* and 5*e* illustrate a relationship between the surfacing pattern for a sphere (550) and the surfacing patterns for two hemispheres (570) and (590). Referring to FIG. 5*c*, the top half (551) of the sphere (550) is substantially covered in hook material, and the bottom half (552) of the sphere (550) is substantially covered in loop material. The hook-covered top half of the surface (551) and the loop-covered bottom half of the surface (552) meet at the equator of the sphere (550) creating a material-transition edge (553). As shown in FIG. 5*e*, hook material substantially covers the spherical surface (571) of the top hemisphere (570), and loop material substantially covers the circular base (572) of the top hemisphere (570). On the bottom hemisphere (590), loop material substantially covers the spherical surface (591) and hook material substantially covers the circular base (592) of the bottom hemisphere (590). When the circular bases (572) and (592) of the top and bottom hemispheres (570) and (590) are connected, the two hemispheres (579) and (590) have the appearance of the sphere (550) of FIG. 5*c*.

Alternatively, the preferred surfacing of the upper hemisphere (570), shown in FIG. 5*e*, can be obtained by a transformation of the sphere (550) with a preferred surfacing pattern, shown in FIG. 5*c*. The hemisphere (570) can be obtained by "flattening out" the loop-covered lower hemisphere (552) of the sphere (550) along the path (555) in the direction of the arrows. Similarly, flattening the upper hook-covered half (551) of the sphere (550) results in the bottom hemisphere (590) with the spherical surface covered (591) in loop material, and a circular planar surface (592) covered in hook material.

A preferred surfacing pattern for an object which consists of only planar surfaces, but which is not one of the above-identified classes of geometric solids, can still be determined from the methodology specified in the flowchart in FIG. 10. For example, for an octahedron (a polyhedron which has eight triangular planar surfaces) it is first determined if all the surfaces of the object are planar (1003). Since the answer is yes (1004), it is next determined if the object has only one polygonal base (1005). Since an octahedron may be considered to have no bases or eight base, the answer is no (1006), and it is then ascertained if the object has only two polygonal bases (1007). The answer is no (1008), so an octahedron is surfaced in accordance with the general rule set (1009) for composite planar elements: each planar surface is surfaced in just one fastener material; opposing planar surfaces are covered in mating fastener materials; roughly equal amounts of surface area are covered in each fastener material; and the surfaces covered in one fastener material are contiguous. Thus the preferred surfacing pattern for an octahedron has four faces which intersect at a point substantially covered with hook material, and the remaining four faces which intersect at an opposing point substantially covered in loop material.

Similarly, the preferred surfacing pattern for a three-dimensional object which has curved surfaces but is not one of the above-identified classes of geometric solids, can still be determined from the methodology specified in the flowchart in FIG. 10. Consider the example of a half-cylinder, created by bisecting a right cylinder perpendicular to a circular base along a diameter of the circular base and the longitudinal axis of the cylinder, creating a solid with two semi-circular planar bases, a rectangular planar face, and a single-curved lateral surface. It is first determined if all surfaces are planar (1003) and the answer is no (1022). It is then determined if the object has both curved and planar surfaces (1023) and the answer is yes (1026). It is next determined if the object contains only singled curved and planar surfaces (1027) (i.e., the object contains no double-curved surfaces), and since the lateral surface of the half-cylinder is single-curved, the answer is yes (1030). It is then determined if the half-cylinder has only one planar surface (1031), and the answer is no (1032). It is then determined if the half-cylinder has only two planar surfaces (1033), and since the half-cylinder has two planar bases and a rectangular planar face, the answer is no (1034), so the half-cylinder is surfaced in accordance with the general rule (1035) for composite curved and planar elements: curved surfaces consisting of 180 degrees of curvature or less are surfaced in one fastener material; curved surfaces consisting of more than 180 degrees of curvature are bisected, with one half of the curved surface covered in a first fastener material and the remaining half of the curved surface covered in a second mating fastener material; each planar surface is covered in just one fastener material; opposing planar surfaces are covered in mating material; points on surfaces separated by 180 degrees of rotation of the element about an axis are covered in mating fastener materials; surfaces covered in one fastener material are contiguous; and roughly equal surface areas of the element are covered in each fastener material. Thus, the preferred surfacing pattern for a half-cylinder is: one planar semi-circular surface is covered in a first fastener material; the opposing planar semi-circular surface is covered in a second mating material; the single-curved lateral surface is covered in a first fastener material; and the rectangular face is covered in a second mating material. As a result, the hook material surfaces are contiguous, the loop material surfaces are contiguous, each surface is covered in just one fastener material, the number of surfaces covered in hook material are equal to the number of surfaces covered in loop material, and the surface area covered in hook material is roughly equal to the surface area covered in loop material.

Figure 9A:
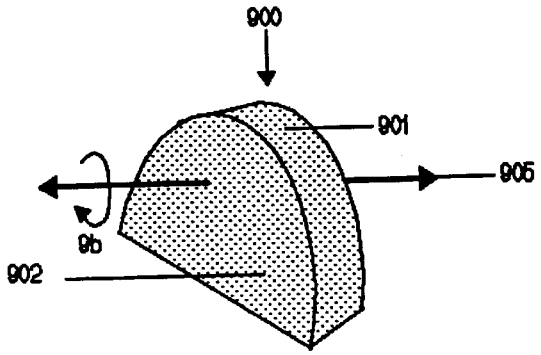
FIGS. 9*a* and 9*b* are perspective views illustrating a preferred surfacing pattern for a half-cylinder element.
Figure 9B:
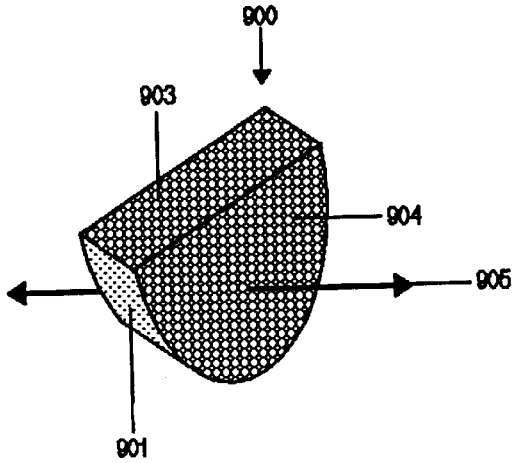

This surfacing pattern is illustrated in FIGS. 9*a* and 9*b*, which show two orientations of a half-cylinder (900), the orientation of FIG. 9*b* being achieved by a rotation of the half-cylinder (900) of FIG. 9*a* by 180 degrees about a horizontal axis (905). Hook material covers one semi-circular surface (902) and the lateral curved surface (901), and loop material covers the rectangular surface (903) and the other semi-circular surface (904).

Similarly, the surfacing pattern for an arch (a right rectangular prism with a half-cylindrical section removed from the central portion of one of the faces of the prism) can be determined from the methodology specified in the flowchart in FIG. 10. Not all the surfaces are planar (1003/1022), and the object has both curved and planar surfaces (1023/1026). So it is next ascertained that the arch has only planar and single-curved surfaces (1027/1030) (the lateral concave surface of the arch is a single-curved surface), and has more than one planar surface (1031/1032). It is then determined that it has more than two planar surfaces (1033/1034), so the arch is surfaced in accordance with the general rule set (1035) for composite curved and planar elements, as described above.

Figure 9C:
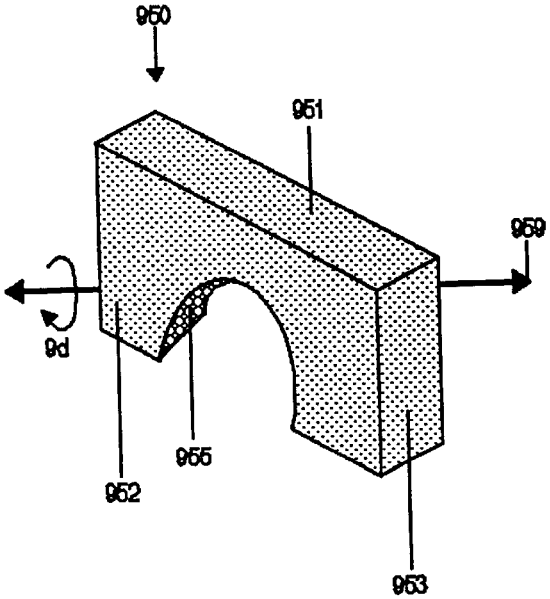
FIGS. 9*c* and 9*d* are perspective views illustrating a preferred surfacing pattern for an arch element.
Figure 9D:
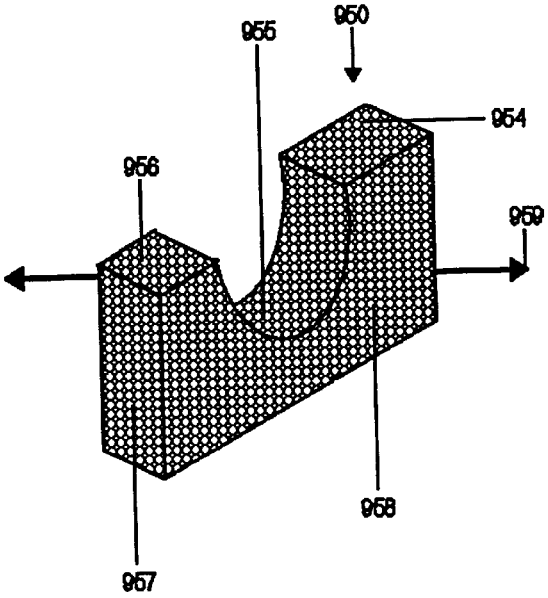

The preferred surfacing pattern for an arch (950) is illustrated in FIGS. 9*c* and 9*d* which show two orientations of the arch (950), the orientation of FIG. 9*d* being achieved by a rotation of the arch (950) of FIG. 9*c* by 180 degrees about a horizontal axis (959). Hook material covers the large side surface (952), the small rectangular end surface (953), and the large rectangular top surface (951). Loop material covers the concave arch surface (955), the other large side surface (958), the small rectangular end surface (957), and the two small rectangular top surfaces (954) and (956).

The arch (950) can be viewed as a right rectangular prism from which the half-cylindrical section (900) of FIGS. 9*a* and 9*b* has been removed. If the hook-covered curved lateral surface (901) of the half-cylindrical section (900) is attached to the interior concave surface (955) of the arch covered in loop material with the half-cylindrical section (900) oriented so that the hook-covered semi-circular base (902) faces the same direction as the hook-covered face (952) of the arch (950) (and necessarily the loop covered semi-circular base (904) faces the same direction as the loop-covered face (958) of the arch (950)), the resulting object appears as a right rectangular prism covered in a 3-Point surfacing pattern.

It should be noted that if a surfacing pattern obeys the above-listed surfacing rules, then the inverse of the surfacing pattern (created by inverting the assignments of hook and loop material for each surface of an element) also obeys the surfacing rules. It is therefore to be understood that when any surfacing pattern is described as included in the preferred embodiment of the present invention, its inverse is also included. In some cases, the inverse surfacing pattern is identical to the preferred surfacing pattern (such as for the cube), while in other cases the inverse surfacing pattern is distinctive (such as with a cone or a pyramid). It should also be noted if a surfacing pattern obeys the surfacing rules, then its mirror images also obey the rules.

It should also be noted that surfacing patterns which obey some, but not all, the surfacing guidelines still provide significant advantages over the prior art. For example, having 60% hook-covered area and 40% loop-covered area (rather than the preferred equal areas of both material) still provides a high degree of orientation flexibility and ease of use.

It should also be noted that some benefits of a specific surfacing pattern are not dependent on fully covering a surface with hook material or loop material. For three-dimensional objects comprised completely of planar surfaces, it can be shown that depositing even a limited amount of fastener material on each face in the optimal surfacing pattern still maximizes the number of ways of connecting two elements in a face-to-face alignment. However, in general, substantially covering the surfaces of elements increases the orientation flexibility by increasing the degree of rotational and translational freedom for connecting elements.

Figure 4A:
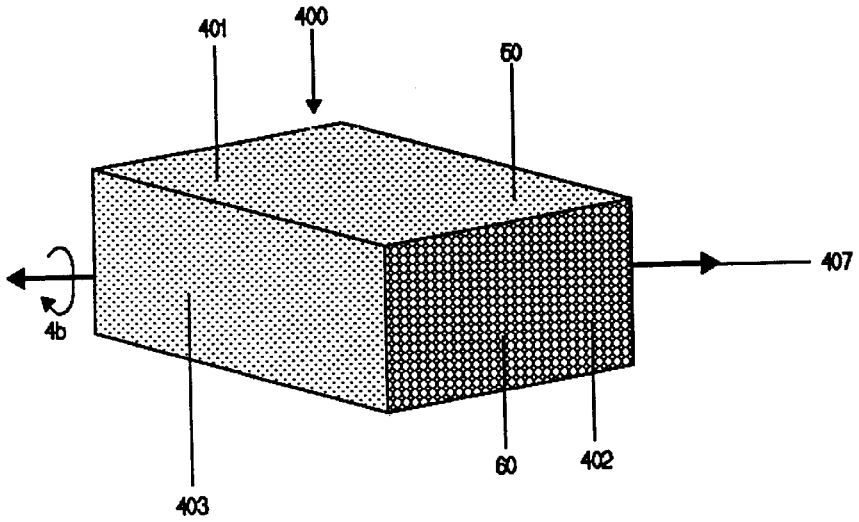
FIGS. 4*a* and 4*b* are perspective views of a right rectangular prism showing a preferred surfacing pattern.
Figure 4B:
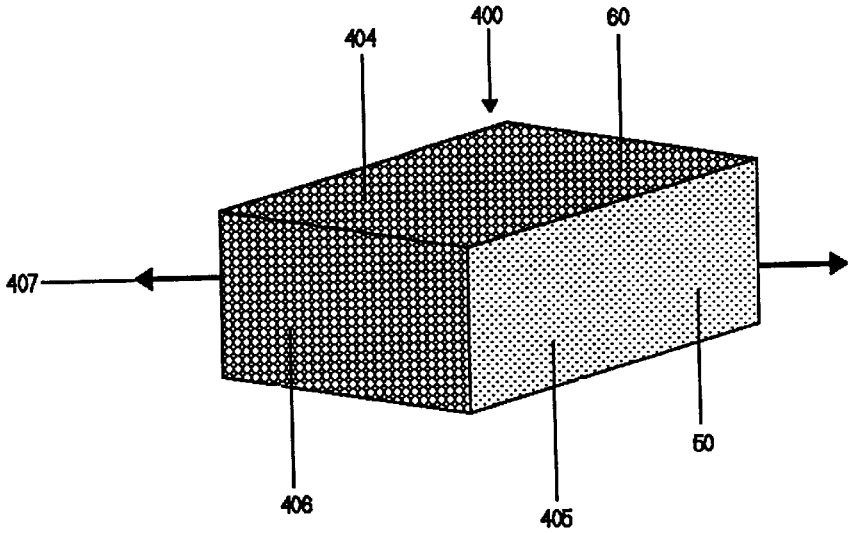

Some alternative surfacing patterns, while not fully complying with the 3-Point derivative surfacing guidelines, have other beneficial attributes, and are within the scope of the present invention. These alternative surfacing patterns include:

(i) For a prism, the bases are designated as $Base_1$ and $Base_2$, and the n faces are designated as $F_i$, with face $F_i$ being between face $F_{i-1}$ and face $F_{i+1}$ (modulo n). For prisms with n faces, where n is an even number, $Base_1$ and $Base_2$ are substantially hook covered, faces $F_1$ to $F_{(n-2)/2}$ are substantially hook-covered, and faces $F_{(n/2)}$ to $F_n$ are substantially loop covered. For the right rectangular prism, this is a 3&3 pattern, but not a 3-Point pattern. This surfacing pattern is illustrated in FIGS. 4*a* and 4*b*, which show two orientations of a right rectangular prism (400), with the orientation of FIG. 4*b* being achieved by a rotation of the right rectangular prism (400) of FIG. 4*a* by 180 degrees about a horizontal axis (407). The prism (400) in FIGS. 4*a* and 4*b* has three surfaces (401), (403) and (405) covered in hook material (50), and these surfaces (401), (403) and (405) do not intersect at a point. The remaining three surfaces (402), (404) and (406) are substantially covered in loop material (60), and these also do not intersect at a point.

Figure 11A:
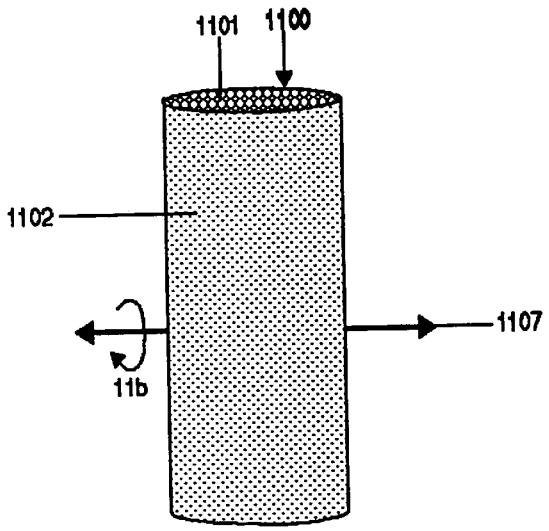
FIGS. 11*a* and 11*b* are perspective views of a right cylinder illustrating an alternative surfacing pattern.
Figure 11B:
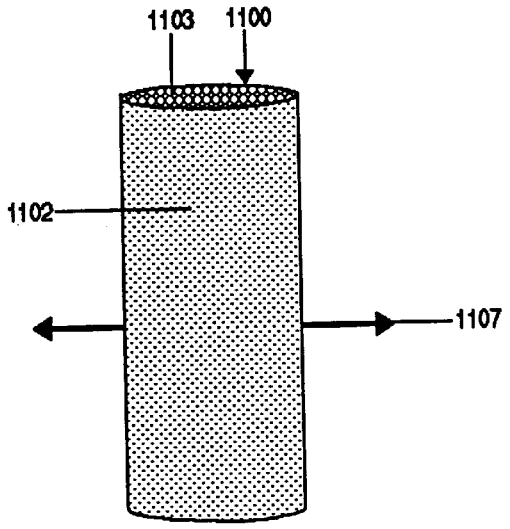

(ii) For a cylinder, the circular bases are substantially loop-covered, and the curved lateral surface is substantially hook covered. This is illustrated in FIGS. 11*a* and 11*b*, which show two orientations of a right cylinder (1100), the orientation of FIG. 11*b* being achieved by a rotation of the right cylinder (1100) of FIG. 11*a* by 180 degrees about a horizontal axis (1107). Loop material substantially covers both circular bases (1101) and (1103), while hook material substantially covers the entire lateral curved surface (1102).

Figure 17A:
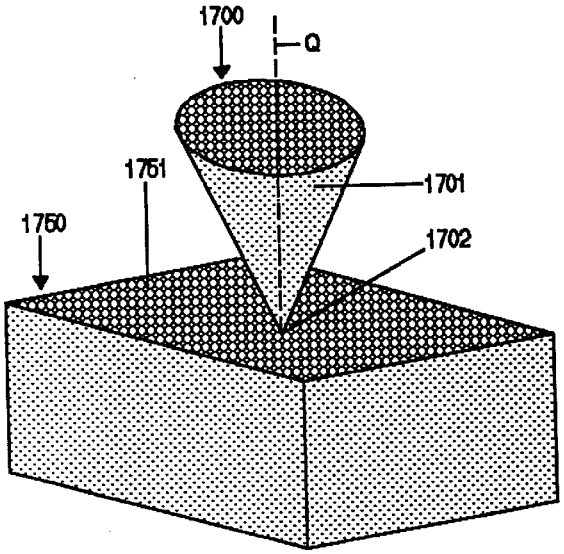
FIG. 17*a* is a perspective view of a right cone and a right rectangular prism in a point-to-planar-surface connection.

(iii) For a cone, the base is loop-covered and the entire curved surface is hook-covered, such as for the cone (1700) shown in FIG. 17*a*.

Figure 12:
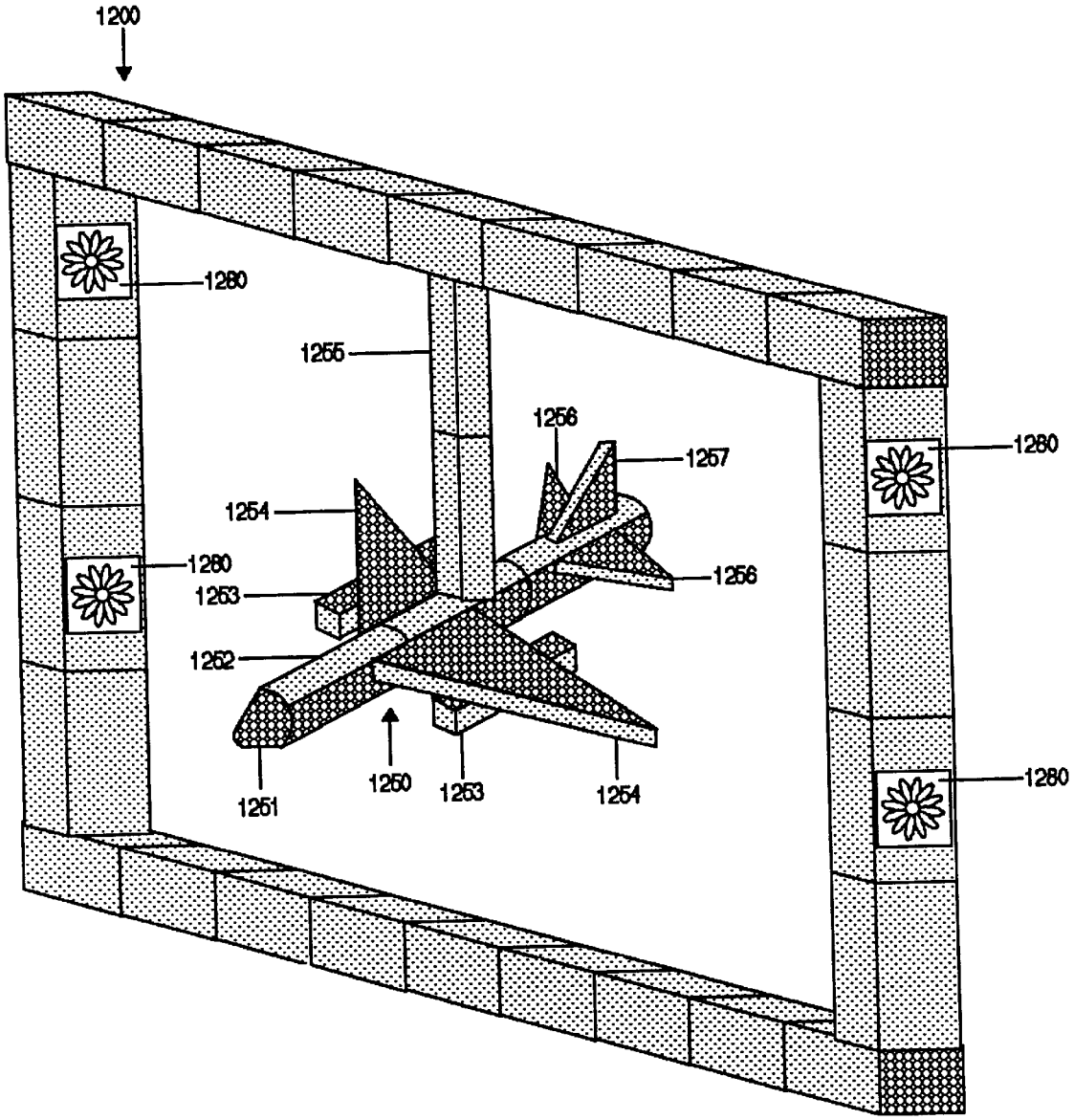
FIG. 12 is a perspective view of an examplary structure illustrating the use of three-dimensional construction elements in combination with two-dimensional decorative elements.

The construction elements which comprise the preferred embodiment of the present invention can be used to create interesting and complex structures. FIG. 12 illustrates a complex figure constructed with some of the three-dimensional construction elements of the present invention. Referring to FIG. 12, the frame (1200) which encircles the jet airplane (1250) is comprised of 26 identical right rectangular prisms surfaced as shown in FIGS. 1*a* and 1*b*. The nose (1251) of the jet airplane (1250) is a right cone with a rounded apex. The fuselage (1252) of the jet airplane (1250) is constructed from three right cylinders, surfaced as shown in FIGS. 6*c* and 6*d*. The wings (1254) of the jet airplane (1250) are two large right triangular prisms, surfaced as shown in FIGS. 8*a* and 8*b*. The stabilizers (1256) at the tail of the airplane (1250) are two small right triangular prisms, surfaced as shown in FIGS. 8*a* and 8*b*. The rudder (1257) of the jet airplane (1250) is a small right triangular prism, surfaced as shown in FIGS. 8*a* and 8*b*. The two engines (1253) of the jet airplane (1250) are comprised of two right square prisms, surfaced as shown in FIGS. 6*a* and 6*b*. The jet airplane (1250) is suspended from the top center of the frame (1200) by a column (1255) constructed of two right square prisms, surfaced as shown in FIGS. 6*a* and 6*b*. Four two-dimensional decorative elements (1280) are shown adhered to the frame (1200), demonstrating the potential for ornamentation.

The preferred embodiment of the present invention is comprised of construction elements substantially surfaced in 3-Point or 3-Point derivative patterns, as described previously. An additional embodiment of the present invention consists of construction elements whose surfaces are substantially covered either in only hook material or in only loop material. In this alternate embodiment, since arbitrary elements do not necessarily adhere to one another, a person must select an element substantially covered in hook material and an element substantially covered in loop material to removably attach one to another. Given the appropriate selection of elements, all other descriptions of operation apply to this alternate embodiment of the invention as well.

Figure 25A:
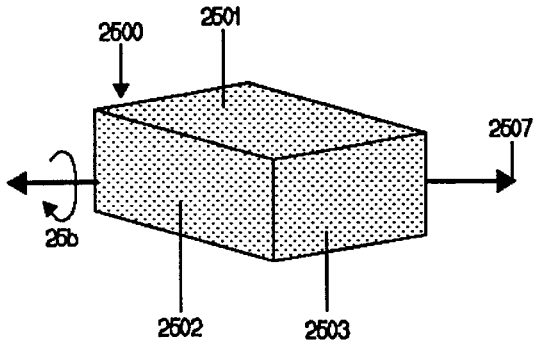
FIGS. 25*a* and 25*b* are perspective views of a right rectangular prism surfaced in hook material.
Figure 25B:
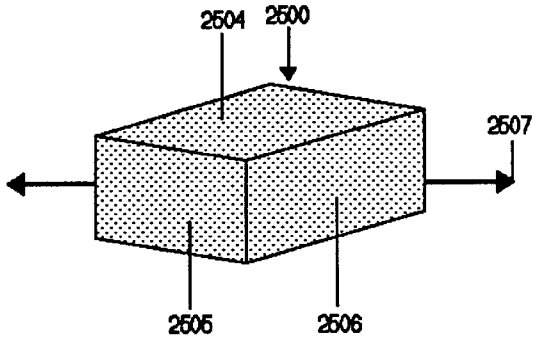
Figure 25C:
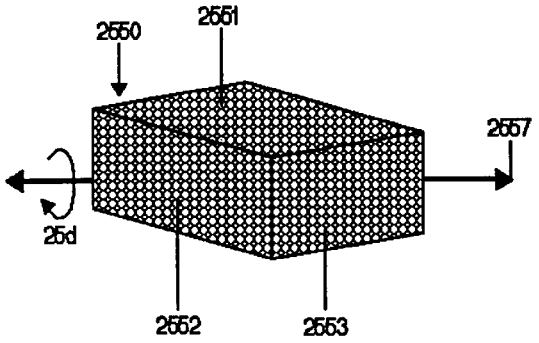
FIGS. 25*c* and 25*d* are perspective views of a right rectangular prism surfaced in loop material.
Figure 25D:
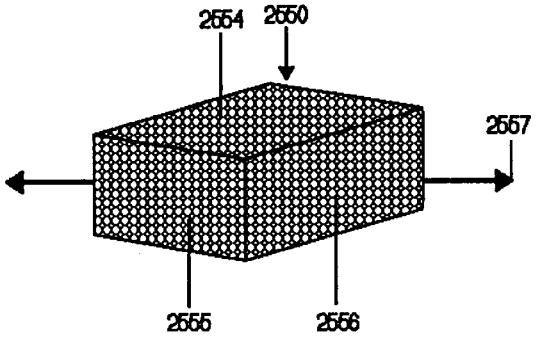

Referring to FIGS. 25*a* and 25*b*, two views are shown of a right rectangular prism (2500) with six faces (2501), (2502), (2503), (2504), (2505), and (2506) covered in hook material, and no faces covered in loop material. The orientation of FIG. 25*b* is achieved by a rotation of the right rectangular prism (2500) of FIG. 25*a* by 180 degrees about the horizontal axis (2507). Likewise, FIGS. 25*c* and 25*d* show two views of a right rectangular prism (2550) with six faces (2551), (2552), (2553), (2554), (2555) and (2556) substantially covered in loop material, and no faces covered in hook material. The orientation of FIG. 25*d* is achieved by a rotation of the right rectangular prism (2500) of FIG. 25*c* by 180 degrees about the horizontal axis (2557). The number of unique face-to-face connections between the right rectangular prism (2500) with all hook-covered faces and the right rectangular prism (2550) with all-loop-covered faces is 36, which is the maximum number achievable, as the table of FIG. 29 shows. This is the only surfacing pattern combination in which each face of one prism can connect with any face of another prism.

All-hook and all-loop covered elements also maximize the number of like-material edges, which maximizes the number of edge-to-surface connections. The number of unique edge-to-surface connections between two such right rectangular prisms is 144, which is the maximum achievable for any surfacing pattern of two right rectangular prisms, as is shown in the table of FIG. 18. This also maximizes the number of points in which planar surfaces surfaced in like fastener material meet, thereby maximizing point-to-planar surface connectability. In general, for any two three-dimensional elements having only planar surfaces, the maximum number of ways of connecting the two elements in face-to-face and edge-to-face orientations is produced by having one element surfaced only in hook material and the other element surfaced only in loop material. It should also be noted that the orientation flexibility between two elements is maximized by covering one element entirely is hook material and the other element entirely in loop material, since then any point on the surface of one element can be connected to any point on the surface of the other element.

Size and Weight

Although the present invention includes three-dimensional construction elements of arbitrary size, the preferred embodiment is directed to a construction toy or elements for the construction of small displays. As a result, the size of the construction elements must be bounded to ensure that people—particularly children—can easily and safely handle them.

By carefully selecting the size, substrate materials, and means of construction of the elements which comprise the preferred embodiment of the present invention, it is possible to achieve a balance between structural integrity and weight. The heavier the construction elements are, the stronger the bond between the elements must be to ensure that they will stay together. However, the stronger the bond between the elements, the harder it will be to disassemble them once they are attached. By designing even the larger construction elements to be structurally sound but light in weight, it is possible to ensure that the weight of the construction elements is not a significant factor in the operation of the invention. Elements in the preferred embodiment weigh just a few ounces.

Pivot Edges

The present invention provides the ability to adhere an edge of one element to a planar surface of another. Once such an edge-to-planar surface connection is made, the element whose edge is connected to a planar surface may then be pivoted about the edge while remaining mechanically connected to the planar surface. A "pivot edge" is created when two planar faces intersecting in a line are substantially covered with the same material (either hook or loop), and this edge is then adhered to the face of another element substantially covered with the mating material. The line of intersection then creates an edge about which the elements can pivot.

Figure 13A:
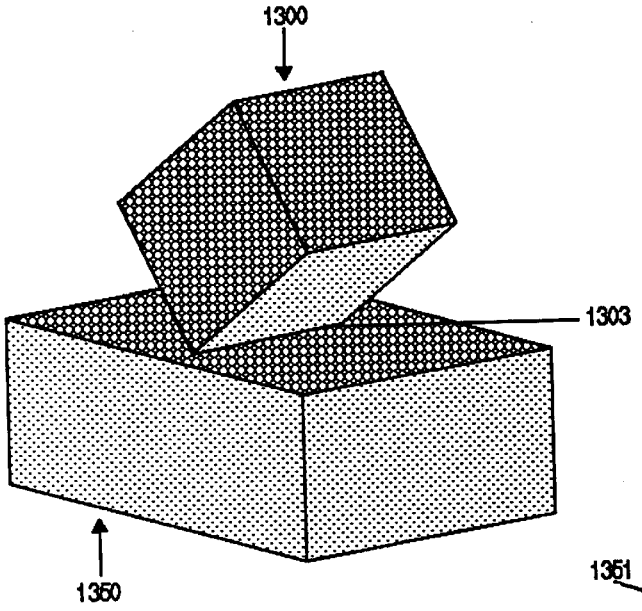
FIG. 13*a* is a perspective view of a cube and a right rectangular prism in an edge-to-planar-surface configuration.
Figure 13B:
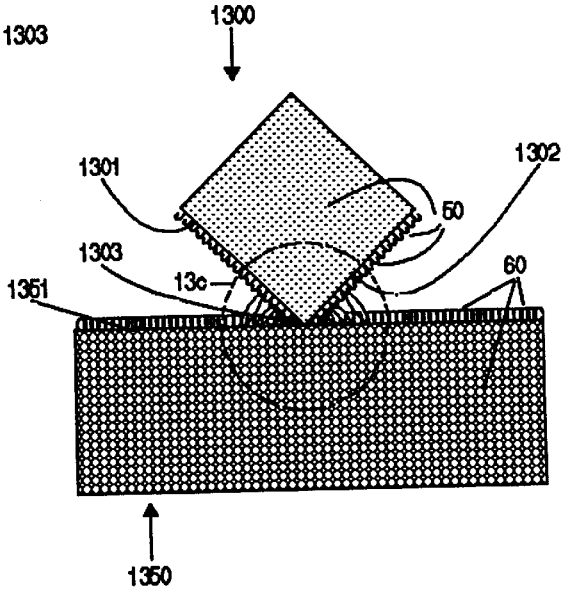
FIG. 13*b* is a front view of the edge-to-planar-surface configuration of FIG. 13*a*.

The cube (1300) and right rectangular prism (1350) shown in perspective in FIG. 13*a* and in a side view in FIG. 13*b* provides an example of a pivot-edge connection. The cube (1300) has two surfaces (1301) and (1302) covered in hook material (50) which intersect in a line, creating a like-material edge (1303). The top surface (1351) of the right rectangular prism (1350) is substantially covered in loop material (60). As shown in FIG. 13*b* and the close-up cross-sectional view of FIG. 13*c*, pressing the like-material edge (1303) of the cube (1300) to the top surface (1351) of the prism (1350) engage engages hooks (50) near the like-material edge (1303) with loops (60) on the prism (1350), resulting in a mechanical connection. The cube (1300) can be pivoted about this edge (1303) while remaining mechanically connected to the surface (1351) of the prism (1350).

Figure 3A:
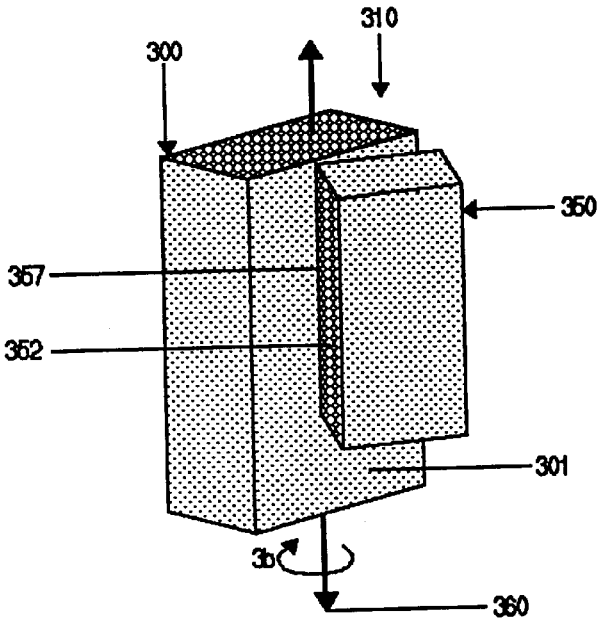
FIGS. 3*a* and 3*b* are perspective views of two right rectangular prisms connected in an edge-to-planar surface configuration.
Figure 3B:
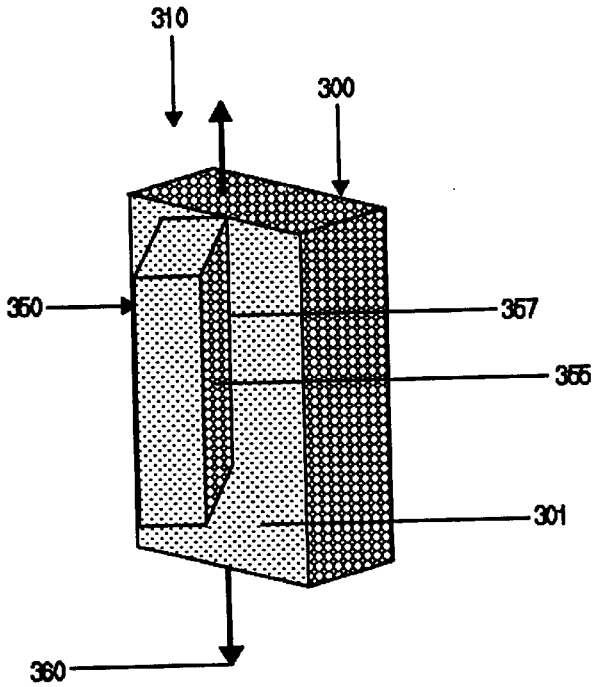

It should be noted that pivot-edge connections can occur for any orientation of elements. For instance, FIGS. 3*a* and 3*b* show two orientations of a structure (310) comprised of a small right rectangular prism (350) connected to a large right rectangular prism (300) in an edge-to-planar-surface configuration. The view of FIG. 3*b* is a clockwise rotation of the structure (310) of FIG. 3*a* by 90 degrees about a vertical axis (360). Both right rectangular prisms (300) and (350) are surfaced as in FIGS. 1*a* and 1*b*. A large planar surface (301) of the large right rectangular prism (300) is surfaced in hook material. The long side surface (352) and the large planar surface (355) of the small right rectangular prism (350) are both surfaced in loop material, and these surfaces (352) and (355) intersect to form a loop-material edge (357). The loop-material edge (357) of the small right rectangular prism (350) is mechanically connected to the large hook-covered planar surface (301) of the large right rectangular prism (300), making it possible for the small right rectangular prism (350) to be pivoted about the loop-material edge (357). The small right rectangular prism (350) is supported only by the edge-to-planar-surface connection, i.e., it is not supported from below.

To maximize the pivoting capabilities of a like-material edge, each of the intersecting surfaces must have like fastener material extending substantially the entire length of the edge of intersection, and extending some distance perpendicular to the edge of intersection. The optimal distance perpendicular to the edge is dependent on the type of loop material used and the angle between the two surfaces. The performance of the pivot edge will depend on the size and weight of the element—if an element is too heavy or too large, it may not be possible to place it in an edge-to-planar-surface orientation.

As shown in FIG. 13*b*, the cube (1300) is held in position by the connections between the hooks (50) and loops (60), provided the strength of the hook and loop connections is sufficient to offset the torque created by the mass of the cube (1300) when the center of mass of the cube (1300) is not directly above the contact edge (1303). It should be noted that it is not necessary to surface the entire like-material edge (1303) to create edge-to-planar-surface attachment capability—surfacing only a portion of the distance along the edge (1303) is sufficient to support an element of some mass and dimensions. However, surfacing the entire length of the edge has the advantages of allowing the element on edge to pivot through the largest possible range of motion, and maximizing the strength of the bond between the elements, and thereby maximizing the mass and size of element which can be held fixed in an edge-to-planar-surface orientation.

The performance of the pivot edge is affected by the angle between the two faces. Increasing the angle between two intersecting faces increases the potential area of connection. However, this decreases the potential arc through which the element can be pivoted. There is some minimum interior angle below which an element will have insufficient interaction to be held in place, and there is some maximum interior angle above which an element on edge would effectively be in face-to-face contact with the other element. To create an edge-to-planar-surface interaction which still affords reasonable pivoting action, the interior angle between the two intersecting faces which create the like-material edge must be more than 30 degrees and less than 150 degrees, more preferably between 60 and 120 degrees, and most preferably between 75 and 105 degrees.

Figure 13C:
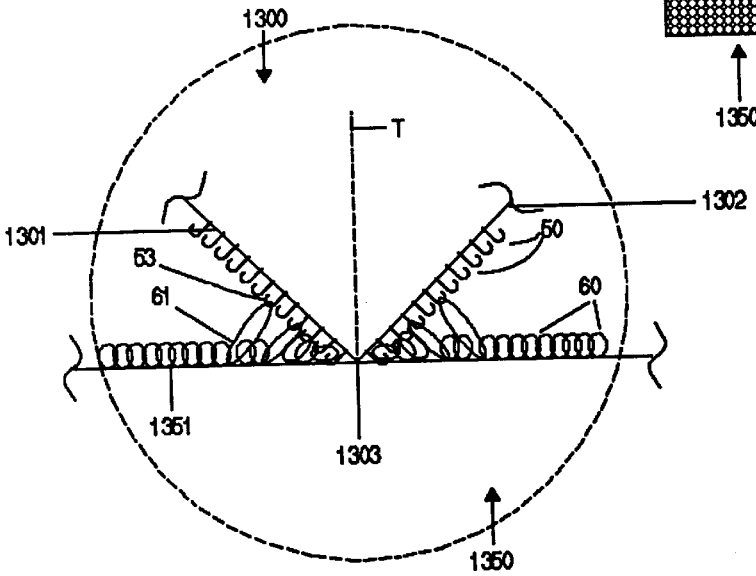
FIG. 13*c* is a magnified cross-sectional view of the circled portion of the edge-to-planar-surface connection of FIG. 13*b*, illustrating the hook and loop interaction in detail.
Figure 13D:
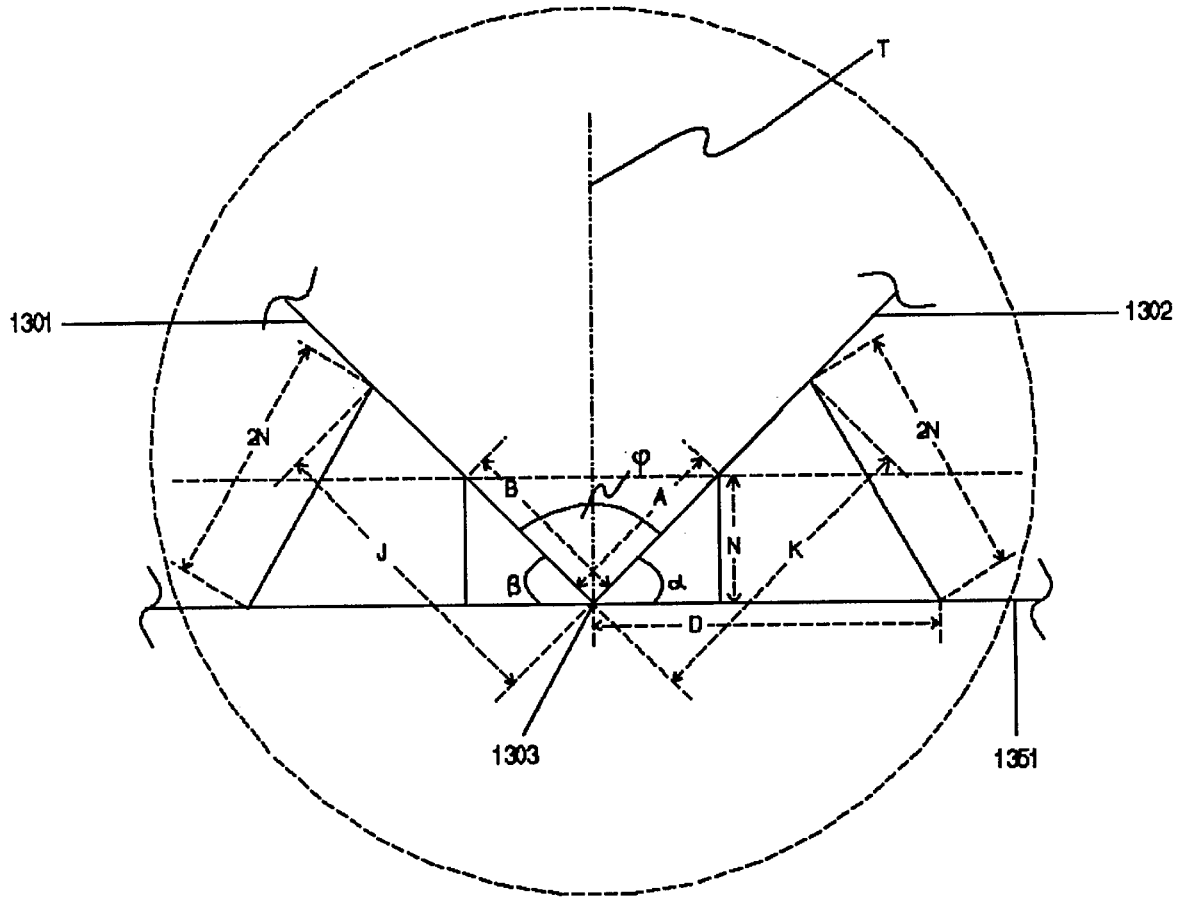
FIG. 13*d* is a diagrammatic view of the edge-to-planar-surface connection of FIG. 13*c*.

Referring to the detailed diagrammatic view in FIG. 13*d* the interior angle between the faces (1301) and (1302) is $\phi$, the angle between the hook-covered face (1302) on the right of the cube (1300) and the loop-covered planar surface (1351) is $\alpha$, the angle between the hook-covered face (1301) on the left of the cube (1300) and the loop-covered planar surface (1351) is $\beta$, and the height of the nap of the loop-covered planar surface (1351) is N. The distance A along which the hook material of the right face (1302) is in full contact with the loop material of the planar surface (1351) is given by $A=N/\sin\alpha$, and the distance B along which the hook material of the left face (1301) is in full contact with the loop material of the planar surface (1351) is given by $B=N/\sin\beta$. If the cube (1300) is in contact with the planar surface (1351) along the entire length L of the edge (1303) of the cube (1300), then the total surface area SA in contact is given by $$SA=N*L*[csc\alpha+csc\beta].$$

The performance of the pivot edge is measured by how well the cube (1300) maintains a position with respect to the planar surface (1351), and by how strongly it adheres to the planar surface (1351). It should be noted that as the cube (1300) is rotated about the edge (1303) in contact with the planar surface (1351), the area of hook material engaged on one face increases and the area of hook material engaged on the opposite face decreases. The maximum strength of adherence occurs when the area of engagement of hooks on the two faces (1301) and (1302) is equal. The force which prevents the cube (1300) from falling to the left is provided by the hooks engaged on the right-hand face (1302). As the cube (1300) is rotated towards the left-hand face (1301), $\beta$ decreases and $\alpha$ increases, the number of hooks engaged on the right-hand face (1302) is reduced, and the force preventing the cube (1300) from falling is reduced. Hence, stability is determined by hook and loop engagement on the "short side," and is maximized at the equilibrium point.

At the equilibrium point, the diagonal T is perpendicular to the loop-covered planar surface (1351), and $\alpha=\beta=(180-\phi)/2$. Since A =B in this case, the width of hook-covered surface connected to the loop-covered planar surface (1351) is $C=2\ N/\sin\alpha=2\ N/\cos(\phi/2)$, and the total surface area of the hook-covered faces (1301) and (1302) connected to the loop-covered planar surface (1351) is $SA=2N\ L/\cos(\phi/2)$.

This analysis makes several simplifying assumptions. First, it does not account for the length of the hooks. Accounting for the hook length increases the distance A which is in contact with the loop-covered planar surface (1351). Second, the analysis assumes the edge (1303) between the two faces (1301) and (1302) makes contact with the base of the loop material (60). In practice, the edge (1303) does not quite reach completely to the base of the loop pile (60). This would decrease the distance A which is in contact with the loop-covered planar surface (1351). These two effects are therefore opposing, and tend to cancel one another. Third, it has been assumed that the loops do not stretch.

However, as shown in FIGS. 13*b* and 13*c*, it is possible to engage loops outside the area of contact discussed above by pivoting or rotating the cube (1300) back and forth about the edge (1303), since the loops are elastic and can remain engaged with hooks while extending beyond the height of the loop material nap. Even a limited number of such connections provides significant additional stability to the cube (1300) standing on edge. These types of connections will henceforth be referred to as "outlier" connections. This is illustrated in FIG. 13*c* by the connection of outlier loops (61) on the planar surface (1351) to hooks (53) on the face (1301) of the cube (1300).

Although it is difficult to calculate the maximum distance which the loops will stretch, experimental observations have indicated that for some loop materials the loop fibers stretch a distance of roughly twice the height of the nap, or 2N. It will be assumed that the distance D from the pivot point (1303) the base of the farthest outliers is equal to the distance K from the pivot point (1303) to the farthest point of attachment of the outliers to the hook surface, since these two distances coincide when the cube (1300) is face-to-face with the planar surface (1351). Hence, to maximize the connections, the distance K perpendicular to the edge (1303) which must be covered is $K=N/\sin(\alpha/2)$. To maximize the number of outlier connections as the cube (1300) is pivoted, the planar surface (1351) must have sufficient loop-covered area to engage a hook-covered face; that is, the minimum rectangular area which must be covered with loop material has a width of $2\ N/\sin(\alpha/2)$ and a length L.

As an example let us assume that the cube (1300) in FIG. 13*b* has each side measuring 2 inches; the two faces (1301) and (1302) are covered with Hook 88™, manufactured by Velcro U.S.A. of Manchester, N.H.; the top planar surface (1351) of prism (1350) is surfaced with Loop 1000™, manufactured by Velcro U.S.A.; the nap height of the loop is roughly ⅛-inch; and the angle between the right-hand face (1302) and the planar surface (1351) is $\alpha=45$ degrees. Then the distance K along the right-hand face (1302) which must be covered to maximize hook and loop interactions is $K=(0.125\text{ inches})/\sin(45°/2)=0.33$ inches. Therefore to optimize pivoting performance, both faces must be substantially covered in hook material for a minimum distance of roughly 0.33 inches from the edge of intersection along the entire 2-inch length of the side. On the planar surface (1351), a minimum loop-covered rectangular area 0.66 inches wide and 2 inches long is required. In the case of a hexagonal prism the interior angle $\phi$ is 120 degrees, so $\alpha=(180-\phi)/2=30$ degrees, and for similar hook and loop material, the distances K and J are roughly ½ inch, and the minimum substantially loop-covered area on the planar surface is roughly 1 inch by 2 inches.

Figure 15A:
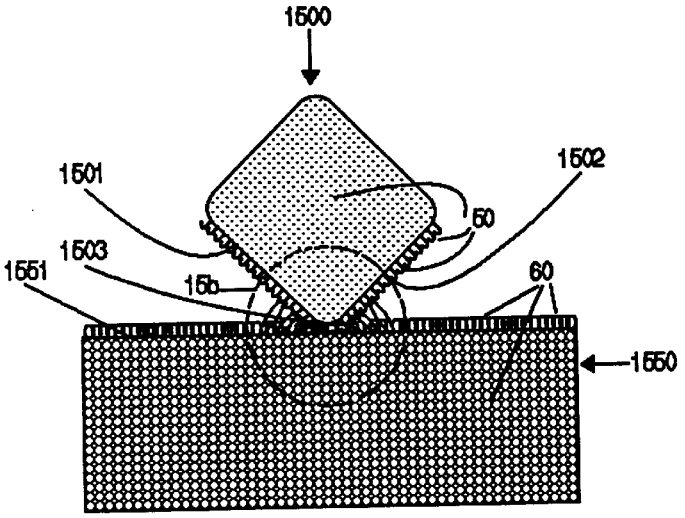
FIG. 15*a* is a front view of a rounded cube and a right rectangular prism in a rounded-edge-to-planar-surface connection.
Figure 15B:
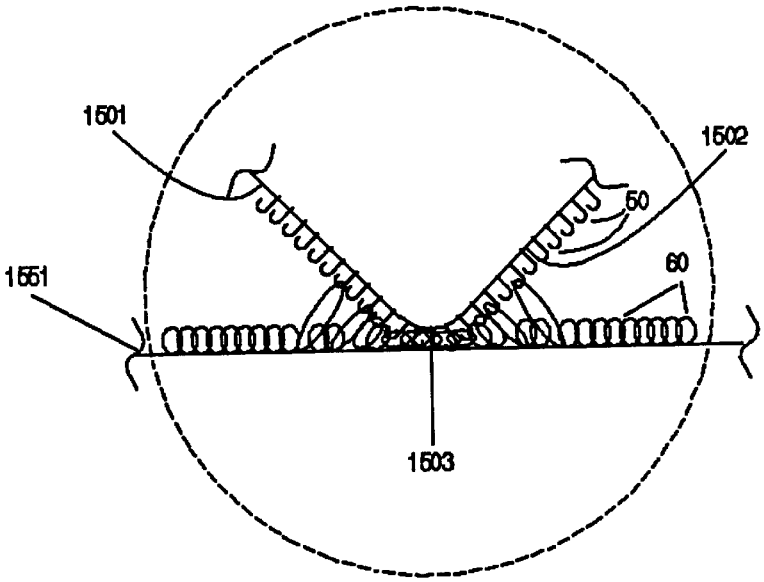
FIG. 15*b* is a magnified view of the circled portion of the rounded-edge-to-planar-surface connection of FIG. 15*a*.

As shown in the cross-sectional view of FIG. 15*b*, the performance of a pivot edge can be improved by rounding the edge (1503) between the two faces (1501) and (1502) so as to increase the amount of hook-covered surface area available for contact with the loop-covered planar surface (1551) of a prism (1550). When the rounded edge (1503) of the cube (1500) is pressed to the top surface (1551) of the prism (1550), the hooks on the cube (1500) engage with the loops on the prism (1550) resulting in a mechanical connection between the two objects. The cube (1500) can be pivoted about this rounded edge (1503) while remaining mechanically connected to the surface (1551) of the prism (1550).

Figure 16A:
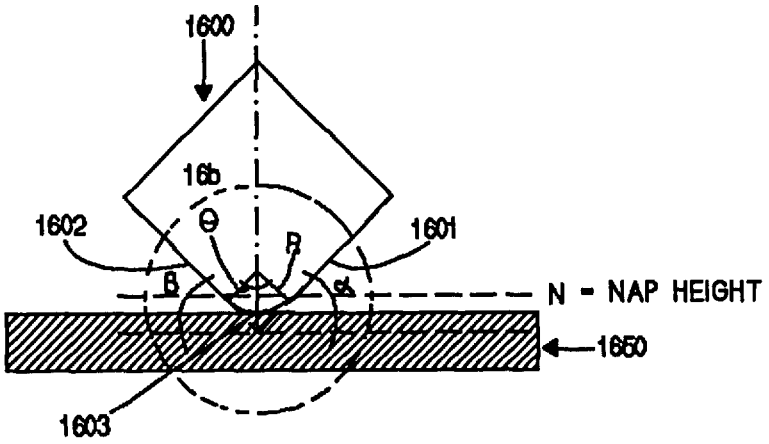
FIG. 16*a* is a diagrammatic view of the rounded-edge-to-planar-surface connection of FIG. 15*a*.
Figure 16B:
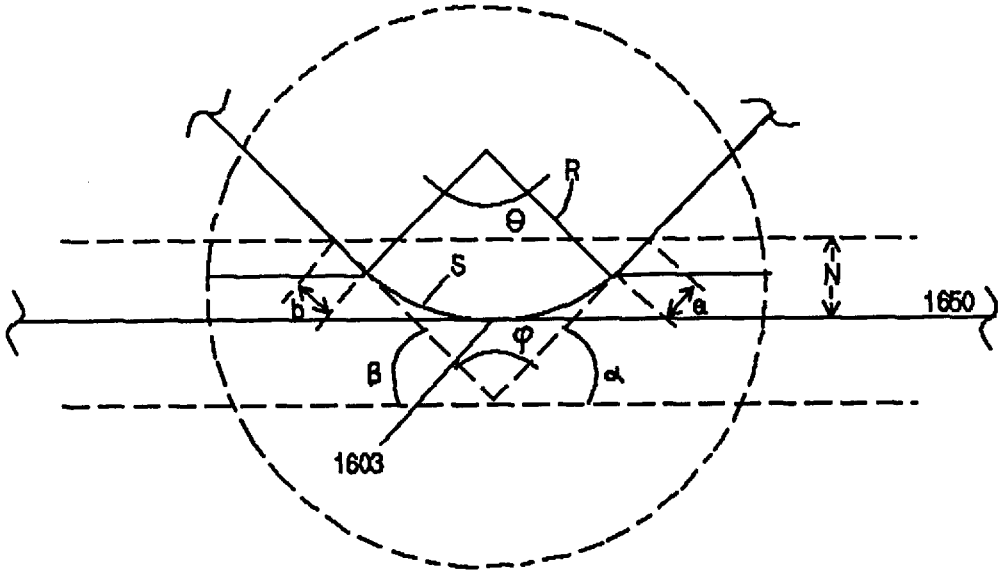
FIG. 16*b* is a magnified view of the circled portion of the rounded-edge-to-planar-surface connection of FIG. 16*a*.

Referring to FIGS. 16*a* and 16*b*, consider a prism (1600) with a rounded edge (1603) in equilibrium; that is, $\alpha=\beta=90-(\phi/2)$. The curved segment (1603) between two hook-covered faces (1601) and (1602) has a constant radius of curvature R and an angle of curvature $\theta$. The area on the hook-covered prism (1600) which is in contact with the loop-covered planar surface (1650) has a length L and a width C, which consists of three sections: the rounded edge (1603) of length S, a straight portion a of the right face (1601), and a straight portion b of the left face (1602). Therefore C=S+a+b. Pivot performance is maximized when $\alpha=\beta$, therefore a=b and, $$C=R\ \theta+2\ N/\cos(\phi/2)-2\ R[1-\cos(\theta/2,]/\cos(\phi/2),$$

where the value for the angle $\theta$ in the first term is in radians.

This relationship can be simplified by establishing certain conditions. First, the surface transition from the right face (1601) to the curved segment (1603) to the left face (1603) is a smooth continuous surface so that the pivoting motion is smooth. This occurs when the angle of curvature $\theta$ is equal to $(180-\phi)$, where $\phi$ is the angle between the two faces (1601) and (1602). Second, to maximize the total length C of the prism (1600) in full contact with the loop-covered planar surface, the entire hook-covered area within the nap height should be rounded; that is, a=b=0. In this case, $R=N/[1-\sin(\phi/2)]$, and the equation for hook-covered length within the nap region reduces to $$C=R\ \theta=N\ (\pi-\phi)/[1-\sin(\phi/2)],$$

where the angles $\theta$ and $\phi$ are taken in radians. For the case of a rectangular prism, in which the interior angle between faces $\phi$ is 90 degrees ($=\pi/2$ radians), the contact length is given by $C=N\ (\pi-\pi/2)/(1-\sin(\pi/4))$, which is approximately equal to 0.46N.

Additional surface contact can also be created by beveling an edge to create a small, additional planar face. This actually creates a slightly greater area of hook and loop engagement than is created by rounding an edge. However, the beveled edge also has the disadvantage of creating an angled surface which does not provide for smooth pivoting. Or the edge could be rounded with a small angle of curvature $0<\theta<(180-\phi)$, such that the surface is not completely smooth at the transition from the flat faces to the curved segment.

The examples of pivot edge interactions discussed above were directed to an edge between two intersecting planar faces connecting to a third planar surface. However, pivot edge interactions can take place between the intersection of any two surfaces, and a separate third surface (either planar or curved). For example, a pivot can be created when the curved edge of the intersection between the circular planar base of a cylinder and its curved lateral surface is placed in contact with another surface. Such curved-edge interactions will have reduced pivoting performance relative to straight edges, since the performance of the pivot edge is enhanced by maximizing the area of interaction, and a curved edge arcs away from the planar surface of contact, thereby reducing the available area of interaction.

Pivot Points

A pivot point, i.e., a point on an element where the surrounding area is covered with one material, can be adhered to the face of another element covered with the mating material. The mechanical interaction between the hook material and the loop material holds the point to the planar surface, but is sufficiently elastic to enable the elements to pivot about the point.

To function, all surfaces surrounding a pivot point need to be covered with one fastener material from the tip to some short distance away. For instance, the right cone (1700) illustrated in a perspective view in FIG. 17*a*, a side view in FIG. 17*b*, and a magnified diagrammatic view in FIG. 17*c*, has a curved surface (1701) which tapers to a point (1702) substantially covered in hook material. The top surface (1751) of the right rectangular prism (1750) is substantially covered in loop material. When the point (1702) of the right cone (1700) is pressed to the top surface (1751) of the prism (1750), the hooks engage with the loops, resulting in a mechanical connection between the two elements. The right cone (1700) can pivot about this point (1702) while remaining mechanically connected to the surface (1751) of the prism (1750).

The performance of the pivot point is measured by how easily the cone (1700) can be positioned in a pivoting orientation, and by how strongly it adheres to the planar surface (1751). Note that as the cone (1700) is pivoted about the pivot point (1702), the area of engaged materials in the direction of the pivot increases and the area of engaged materials in the opposite direction decreases. Since performance is enhanced when the engaged hooks are relatively evenly distributed about the cone (1700), the pivot point performance is therefore optimized when the longitudinal axis Q of the cone (1700) is perpendicular to the plane of the loop-covered face (1751).

Figure 17B:
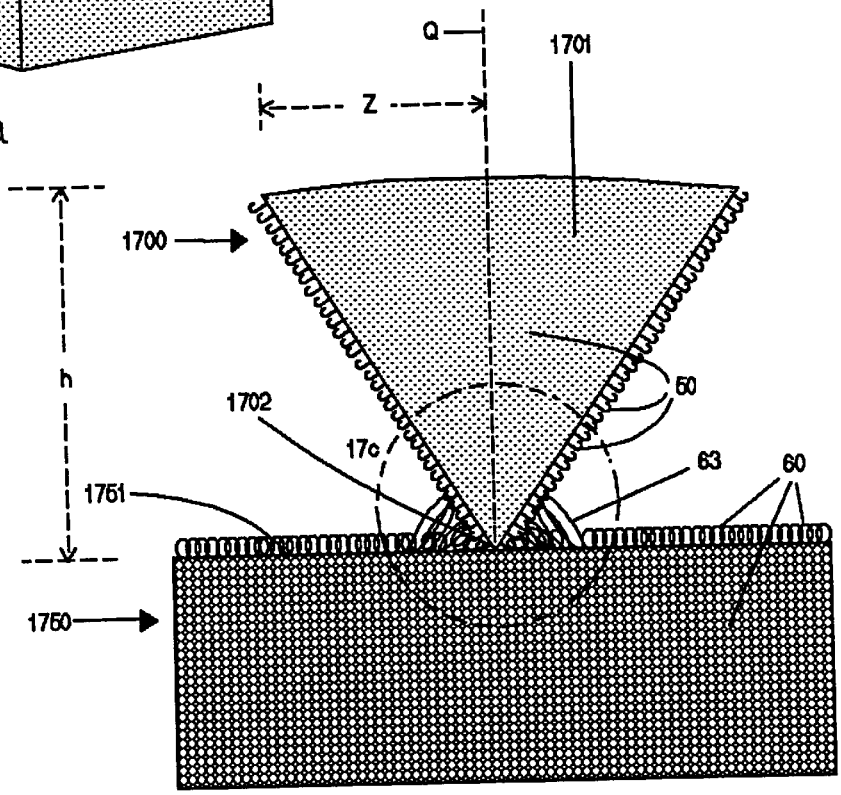
FIG. 17*b* is a front view of the point-to-planar-surface connection of FIG. 17*a*.
Figure 17C:
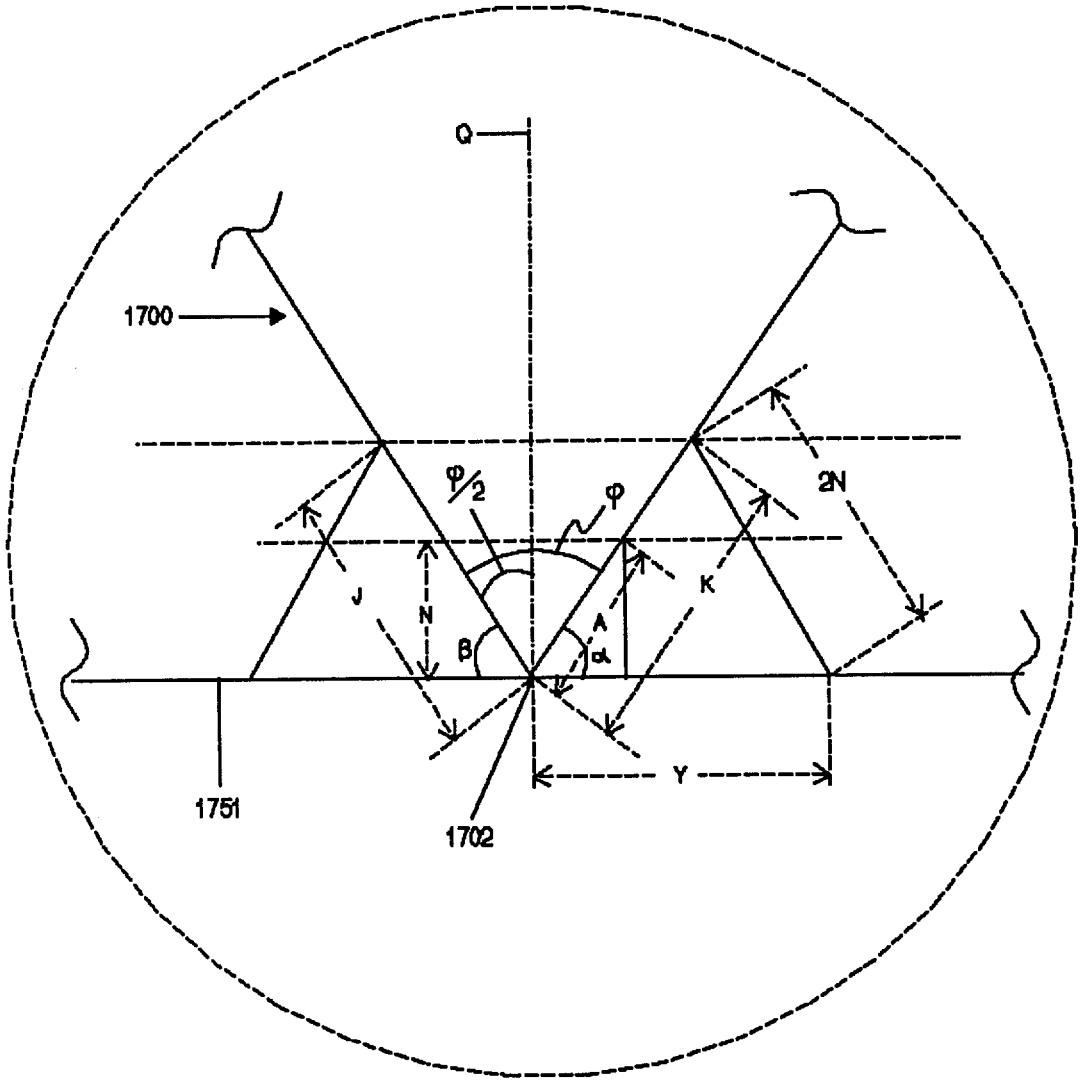
FIG. 17*c* is a magnified diagrammatic view of the circled portion of the point-to-planar-surface connection of FIG. 17*b*.

As shown in FIGS. 17*b* and 17*c*, the cone (1700) has a height h, a base with a radius Z, and an apex having an internal angle $\phi$. The cone (1700) is in an equilibrium position, with its axis Q perpendicular to the loop-covered planar surface (1751), and the angles $\alpha=\beta=(180-\phi)$. The lateral surface area of the cone (1700) which is in contact with the loop-covered planar surface (1751) is the surface area of the small cone which penetrates the loop material (60) up to the height N of the nap. The length of hook engagement along the curved lateral surface is given by $A=N/\cos(\phi/2)$, and the total hook surface area SA in contact with the loop-covered planar surface (1751) is given by $SA=\pi\,[N\tan(\phi/2)]^2/\sin(\phi/2)$.

As shown in FIG. 17*b*, some of the loops (63) of the prism surface (1751) will actually extend above the height of the nap of the loop material (60) (similar to the case for the pivot edge), providing significant additional stability to the cone (1700) standing on its point (1702). It is possible to engage such "outlier" loops by pivoting or rotating the cone (1700) about the point (1702). Although it is difficult to calculate the maximum distance which the loop material (60) will stretch, we assume that the distance Y from the pivot point (1702) to the base of the farthermost outliers on the planar surface (1751) is equal to the distance K from the pivot point (1702) to the attachment of the farthermost outliers on the hook covered surface (1701), since these two points coincide when the cone (1700) is rotated so it lies flat on the planar surface (1751). Hence, to maximize the total number of hook and loop interconnections, the cone (1700) must be surfaced with hook material at least a distance K from the pivot point (1702), with $K=N/\sin(\alpha/2)$. The lateral surface area SA is given by $$SA=\pi*N^2*\sin\alpha/\sin^2(\alpha/2).$$

To maximize the number of outlier connections (63) as the cone (1700) is pivoted, the planar surface (1751) must have a sufficiently large loop-covered area around the point of contact to engage the hook-covered surface (1701). This area required is a circle whose center is at the point of the cone (1700), with a radius of $Y=N/\sin(\alpha/2)$.

The area around the point of a cone which must be covered to optimize the pivot point interaction is independent of the size of the cone itself. However, the performance of the pivot point will depend on the size and weight of the cone used. As shown above, the greater the interior angle $\phi$, the greater the potential area for interaction between hook and loop material will be. However, a large interior angle $\phi$ decreases the arc through which the cone can be pivoted. (This is true for any element which contains a point.) Therefore, if the interior angle is too small the element will have insufficient interaction to be held in place, and if the interior angle is too large an element will not allow sufficient pivoting motion. To create a point-to-planar-surface interaction which still affords reasonable pivoting action, the interior angle $\phi$ between the surfaces leading to the point must be more than 30 degrees and less than 150 degrees, more preferably more than 60 degrees and less than 120 degrees, and most preferably between 75 degrees and 105 degrees.

The pivot point interaction is possible, for instance, with any solid which has a tip formed at the end of a curved surface converging at some angle, or with any solid having three or more planar surfaces intersecting in a point, such as a pyramid or prism. The analysis of the surfacing requirements for any pivot point is analogous to that described above for the cone. For instance, to optimize the pivot point interactions with a loop-covered planar surface, a pyramid would be surfaced in hook material to a minimum vertical distance of roughly 2N from the apex of the pyramid, where N is the loop nap thickness. Similarly, for a right rectangular prism, the three planar surfaces would be surfaced a minimum vertical distance of roughly 2N from the point in which the planar surfaces intersect.

Figure 19A:
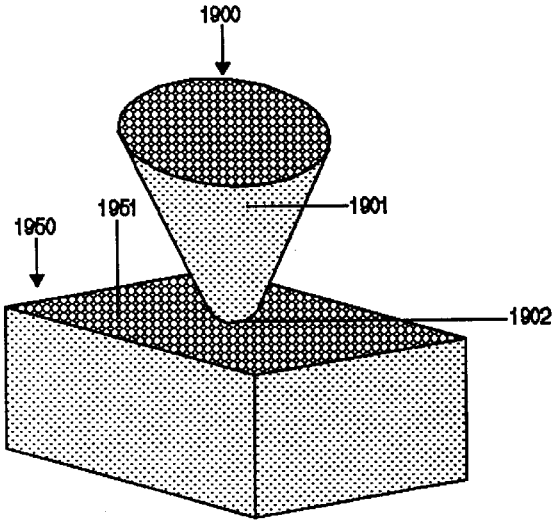
FIG. 19*a* is a perspective view of a right rectangular prism and a cone with a rounded apex in a rounded-point-to-planar-surface connection.
Figure 19B:
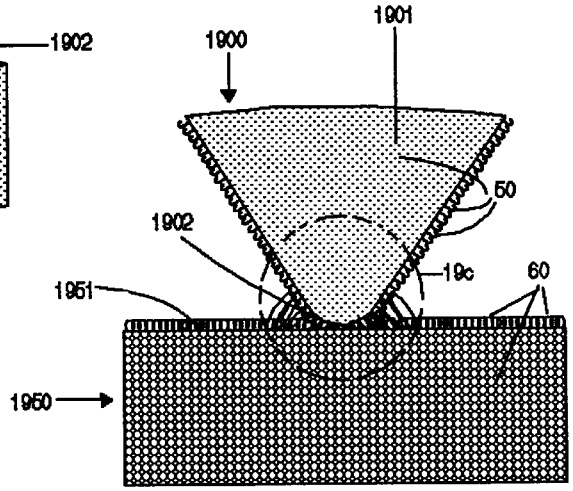
FIG. 19*b* is a side view of the rounded-point-to-planar-surface connection arrangement of FIG. 19*a*.
Figure 19C:
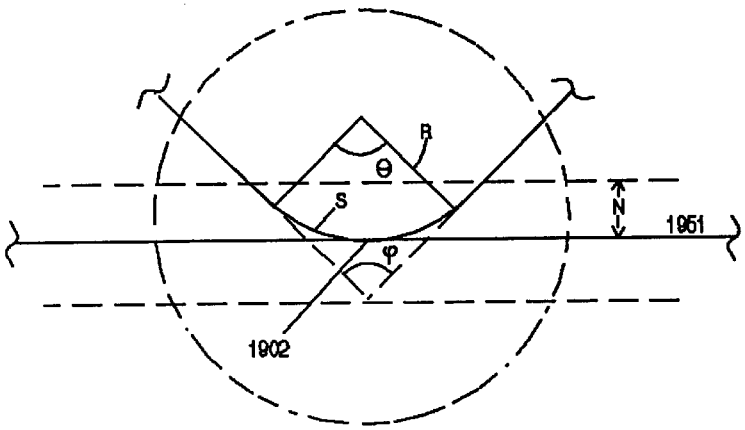
FIG. 19*c* is a magnified diagrammatic view of the circled portion of the rounded-point-to-planar-surface connection of FIG. 19*b* showing the hook and loop interaction in detail.

To improve the performance of a pivot point of a cone, the point may be rounded to provide greater surface area for contact. (Similarly, rounding of the apex of a pyramid or a corner of a prism will enhance their pivot point interactions.) A right cone (1900) with a rounded spherical apex is illustrated in perspective in FIGS. 19*a* and in a side view in FIG. 19*b*. The lateral surface (1901) is covered in hook material (50) and tapers to a rounded spherical apex (1902), and the top surface (1951) of the right rectangular prism (1950) is covered in loop material (60). When the spherical apex (1902) of the right cone (1900) is pressed to the top surface (1951) of prism (1950), the hooks of the right cone (1900) engage with the loops on the prism (1950) resulting in a mechanical connection between the two elements. The right cone (1900) can be pivoted about this apex (1902) while remaining mechanically connected to the planar surface (1951) of prism (1950). The rounded apex (1902) provides a greater area of contact than an unrounded apex, thereby improving the performance of the connection.

If the spherical surface (1902) is smooth and continuous with the lateral surface (1901) of the cone (1900), then the angle of curvature for the spherical section (1902) is given by $\theta=(180-\phi)$, where $\phi$ is the internal angle at the apex of the cone (1900). The area of contact between the cone (1900) and the loop-covered planar surface (1902) is maximized when the entire surface of the cone (1900) within the nap height is rounded, and the radius of curvature of the spherical section is given by $$R=N/[1-\sin(\phi/2)].$$

Alternatively, the point of an element may be truncated. A truncated point provides greater stability than a similarly-sized rounded point-to-planar-surface connections. However, the pivoting of a truncated point will not be as smooth as the pivoting of a rounded point.

Bond Strength

In order to provide the capability to create structures with greater or lesser structural integrity, it is necessary to be able to vary the strength of the bond between the construction elements. Hook and loop fastener material is fabricated in a variety of ways out of a variety of materials, and not all hook material and loop material combinations have the same bonding characteristics. Therefore, the strength of a bond between any two elements is dependent on the specific hook material used, the specific loop material used, and the total contact area between the hook material and the loop material (the bonding surface area).

Manufacturers of fastener material have developed parameters and standards for measuring the bond performance of various types of hook and loop material. The "tensile disengagement strength," measured in pounds per square inch (psi), is the force required to separate two objects, with the force being applied orthogonal to the plane of engagement and spread uniformly over the entire surface. The "shear strength (length-wise)," measured in pounds per square inch (psi), is the force required to disengage two engaged objects with the force being applied parallel to the plane of engagement. The "shear strength (width-wise)," measured in pounds per square inch (psi), is the force which, when applied parallel to the plane of engagement and parallel to the direction of the rows of hooks, and spread uniformly over the entire engaged surface area, just separates the two engaged objects. The "peel strength," measured in pounds per inch of width (piw), is the force required to disengage one row of fastener material (i.e., one row of hooks or one row of loops) of two engaged objects. Note that peel strength is not a direct measure of the force required to pry apart two rigid objects, since the peel strength rating assumes a flexible object which can be separated one row of fasteners at a time.

Most commonly, a person using the construction elements will concentrate the application of a tensile force to separate two objects near an edge of one of the objects, and then pry the objects apart once partial separation is achieved. Therefore the actual required separation force will be somewhat less than the tensile disengagement force (since the force will be applied at an edge, and not spread over the entire surface area), and somewhat more than the peel force (since the objects are not completely flexible). However, since construction elements will most commonly be separated by the application of a tensile force, the tensile disengagement strength rating is used in the present analysis as the indicator of fastener bond strength. Three tensile disengagement bond strength ranges have been defined for embodiments of the present invention-low (from 1 lb./in$^2$ to 5 lb./in$^2$), medium (from 5 lb./in$^2$ to 10 lb./in$^2$) and high (from 10 lb./in$^2$ to 15 lb./in$^2$).

The area of fastener material contact between two elements depends on whether the surfaces are planar or curved and on the positioning of the elements in contact. Categorization of the connections between elements include:

(i) Planar-surface-to-planar-surface attachment: the attachment of a planar surface of one element to a planar surface of a second element. The area of contact may be as large as the entire face of one element.

(ii) Straight-edge-to-planar-surface attachment: the attachment of a straight edge (formed by the intersection of two planar faces covered in the same fastener material) of one element to a planar surface of a second element substantially covered in a mating material. The area of contact is a rectangular area as described above.

(iii) Curved-surface-to-planar-surface attachment: the attachment of a curved surface of one element (such as the surface of a sphere or ellipsoid, or the lateral surface of a cylinder or cone) to a planar surface of a second element. The area of contact is given by the intersection of a plane with the curved surface. For example, the area of contact between the lateral surface of a cylinder and the face of a prism is a rectangle.

(iv) Curved-surface-to-curved-surface attachment: the attachment of a curved surface of one element (such as a sphere) to the curved surface of a second element (such as the lateral surface of a cylinder). The area of contact is roughly the intersection of the two shapes when they overlap by a distance equal to the nap height. For example, the area of interaction between two spheres is a circle.

Other attachment orientations are also possible according to the present invention. For example, the intersection of the planar base of a cone or cylinder with the curved lateral surface of a cone or cylinder creates a planar-surface-to-curved-surface attachment. Attaching such a curved edge to a planar surface creates an "curved-edge-to-planar-surface" attachment similar to the pivot edge attachment. Other attachment categories include straight-edge-to-curved-surface, curved-edge-to-curved-surface, and point-to-curved-surface.

For any given three-dimensional construction element, the maximum surface area available for making contact with a large planar surface, designated as the "maximum possible area of engagement" $a_e$, is dependent on the size and shape of the element. The following list identifies $a_e$ for several of the geometric solids which are included in the preferred embodiment of the present invention. In some cases, assumptions and minor approximations have been made to simplify the discussion. For a polyhedron, $a_e$ equals the area of the largest planar surface of the polyhedron. For a sphere, $a_e$ is the area of the circle given by $\pi\,(2\,RN-N^2)$, where R is the radius of the sphere and N is the height of the loop material nap. For a cylinder, depending on the particular dimensions, $a_e$ can either be the area of the base or a sector of the lateral surface. For the lateral surface of a right cylinder, $a_e$ is a rectangular area given by $2\,H\,(2\,RN-N^2)^{1/2}$, where R is the radius of the cylinder, H is the length of the cylinder, and N is the height of the loop material nap. For a cone, depending on the particular dimensions, $a_e$ can either be the area of the base of the cone or a sector of the lateral surface. For the lateral surface of a right cone, $a_e$ is a triangular area given by $(H^2+R^2)^{1/2}*(2\,RN-N^2)^{1/2}$, where R is the radius of the base of the cone, H is the height of the cone, and N is the height of the loop material nap. The above formulae for $a_e$ for the lateral surface of right cones and right cylinders can be easily generalized to other cones and cylinders.

For any two construction elements, the tensile force required to disengage one element from the other, $t_d$, is given by $t_d=a_c*t$, where $a_c$ is the area of fastener material in contact between the two elements, and t is the rated tensile disengagement strength of the fastener material. The maximum tensile disengagement force, $t_{dmax}$, required to detach a construction element which is fully engaged over its maximum available contact area is then given by $t_{dmax}=a_e*t$. The maximum tensile disengagement force, $t_{dmax}$ must be kept within reasonable limits to ensure that a user can separate any two elements, and also to ensure that structures created with the construction elements meet the objectives for structural integrity.

The strength of the bonds between three-dimensional construction elements can be varied by either: using hook and loop materials with different tensile disengagement strength ratings on the surfaces of the elements, or varying the amount of fastener material deposited on the surfaces of the elements. Both of these means are used in embodiments of the present invention to ensure that $t_{dmax}$ between any two elements is such that the performance objectives of the invention are met.

The maximum desired bond strength, $t_{dmax}$, for a surface is a parameter fixed by the construction element designer to ensure that each surface of an element has application-appropriate bond strength characteristics. When each surface is substantially covered in fastener material, fastener material with a tensile disengagement strength rating of $t_i$ is selected to be deposited on each surface $S_i$, such that $$t_{dmax}=a_e*t_i,$$

where i runs from 1 to N for an N surface element. Referring back to the right rectangular prism (100) in FIG. 1, consider the case where the large rectangular top (101) is substantially surfaced with hook material (50) with a tensile disengagement strength rating $t_1$, and the short rectangular side (102) is substantially surfaced with hook material (50) with a tensile disengagement strength rating $t_2$. By choosing appropriate values for $t_{dmax}$, $t_1$, and $t_2$, it is possible to ensure that, if the large rectangular top (101) is fully engaged with a surface of equal or larger size substantially covered in loop material, it may be easily disengaged; and if the short rectangular side (102) is fully engaged with a surface of equal or larger size, the bond is strong enough to maintain structural integrity.

Figure 2A:
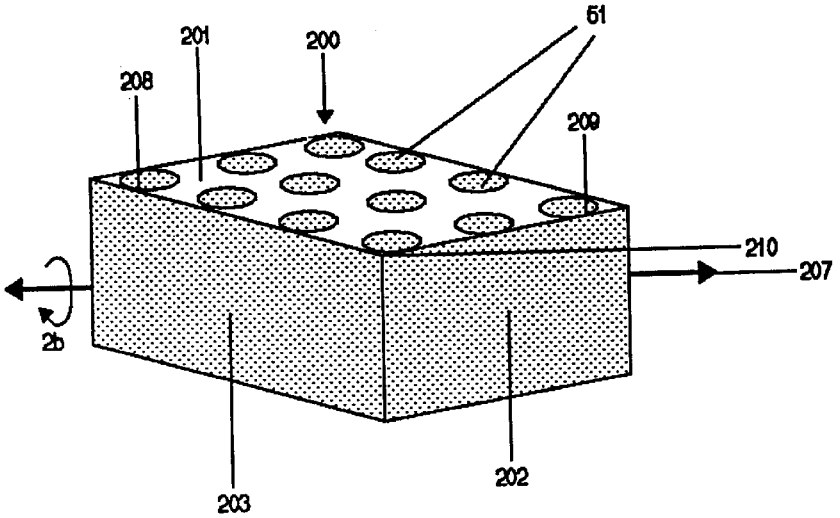
FIGS. 2*a* and 2*b* are perspective views of a right rectangular prism construction element showing partial coverage of a surface with fastener material.
Figure 2B:
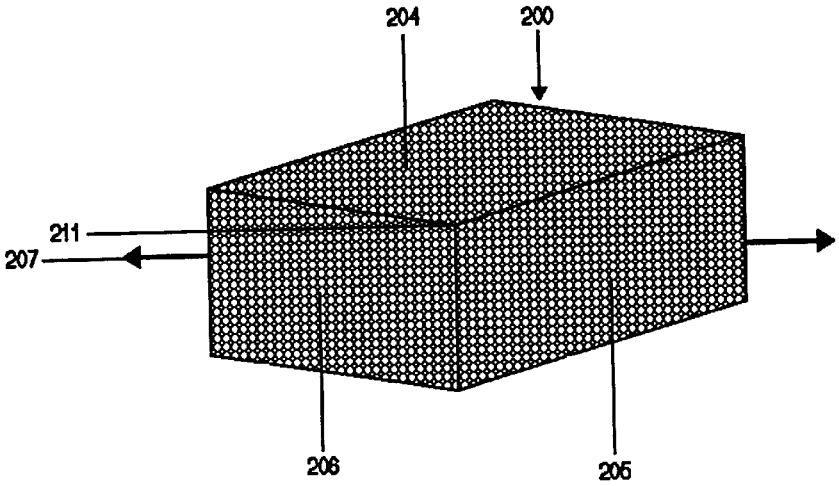

The other means of varying bond strength, i.e., "partial fastener material deposition," is illustrated in FIGS. 2*a* and 2*b*, where two orientations of a right rectangular prism construction element (200) are shown. The orientation of FIG. 2*b* is achieved by a rotation of the right rectangular prism (200) of FIG. 2*a* by 180 degrees about the horizontal axis (207). Hook material is shown to be deposited on three surfaces (201), (202), and (203) which intersect at a point (210). Loop material is shown to be deposited on the opposite three surfaces (204), (205), and (206) which intersect at an opposing point (211). The largest surface (201) designated to receive hook material is not completely covered. Instead, small circular pieces of hook material (51) are deposited uniformly over the large surface (201). It should be noted that some of the circular pieces of hook material (51) are deposited tangent to the long hook material edge (208) and the short hook material edge (209) of the right rectangular prism (200) to allow for edge-to-surface connections to be made, as has been discussed previously. Although circular pieces of hook material (51) are shown in FIG. 2*a*, the shape of the small pieces of hook material (51) is not significant, and may be varied. The maximum total area of hook material uniformly deposited on the large surface (201) must be less than $t_{dmax}/t$ if the large surface (201) is to be easily disengaged when attached to a loop covered planar surface of equal or larger size. Alternatively, loop material could be partially deposited over a surface, in combination with substantially covering other surfaces in hook material, to achieve the same objective.

Multiple Subtrates

One of the major objectives of the present invention is to allow elements having widely varying physical properties to be attached to one another as the means for creating structures with unique characteristics. The physical characteristics of the construction elements which comprise the present invention are determined by both the substrate material used and by the method of construction used to create the element from the specified substrate. The aforementioned objective is achieved by combining different elements with substrates having different physical characteristics.

Rigid elements, i.e., elements which retain their shape under pressure, may have a solid or a hollow core, and may be constructed from rigid materials, such as injection molded plastic, polystyrene, acrylic, etc. If rigid elements are formed by casting or molding, protruding filaments could be integrally formed into the surfaces of the construction element to form the hook material having similar specifications to the hook material which is separately attached to other construction elements within a set.

Figure 21:
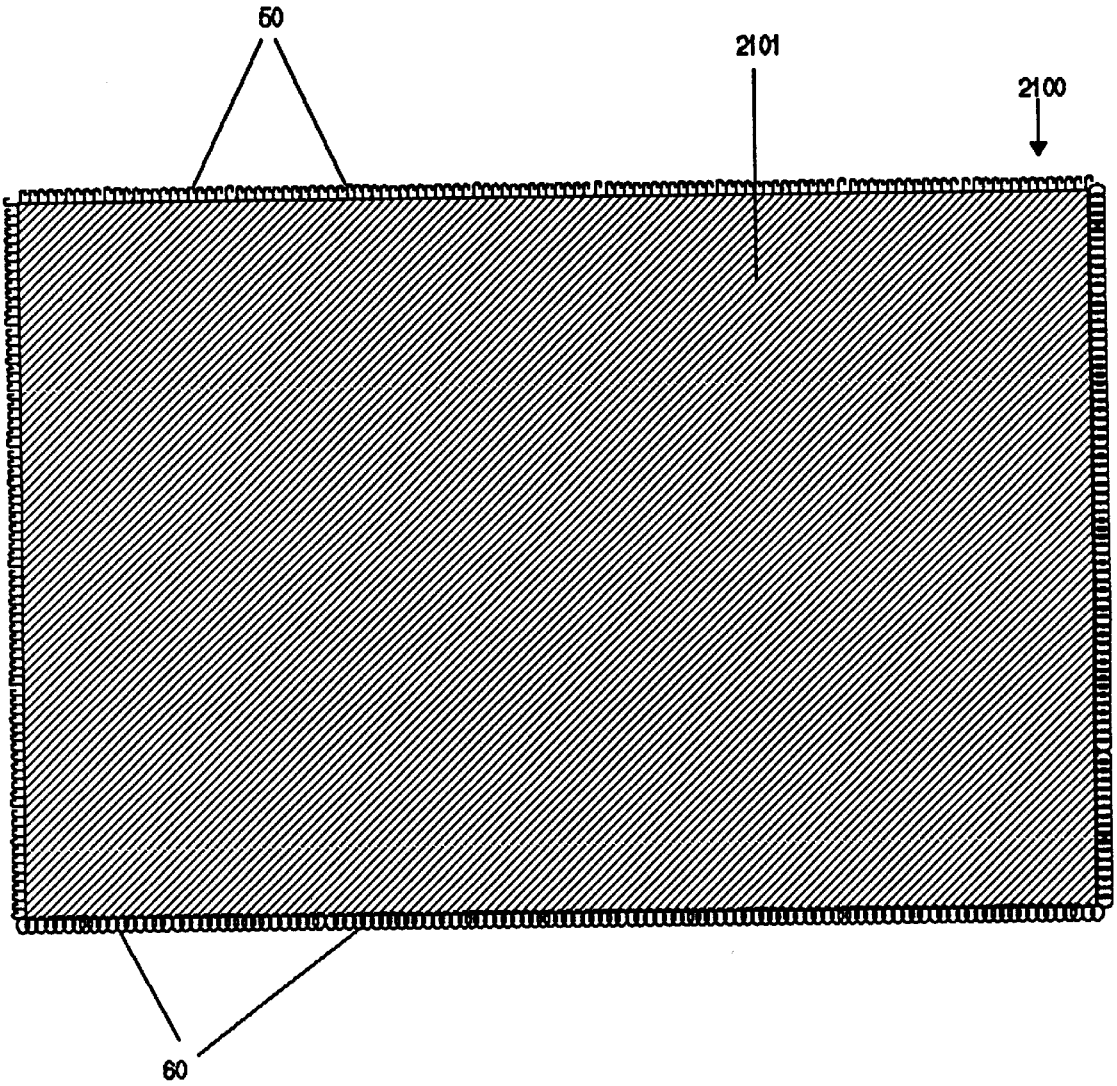
FIG. 21 is a cross-sectional view of a solid construction element comprised of a rigid substrate covered with hook-and-loop fastener material.

An example of the fabrication of a construction element with a solid core is illustrated by the cross-sectional view of a solid core right rectangular prism (2100) in FIG. 21. The solid core (2101) of the prism (2100) is formed of a rigid material such as cast acrylic, wood, or plastic. The surfaces of the prism (2100) are substantially covered with hook material (50) and loop material (60) by cutting the material into sections having the shapes of the element surfaces and adhering the sections to the surfaces with a high strength chemical adhesive, or by other permanent bonding means.

Figure 22:
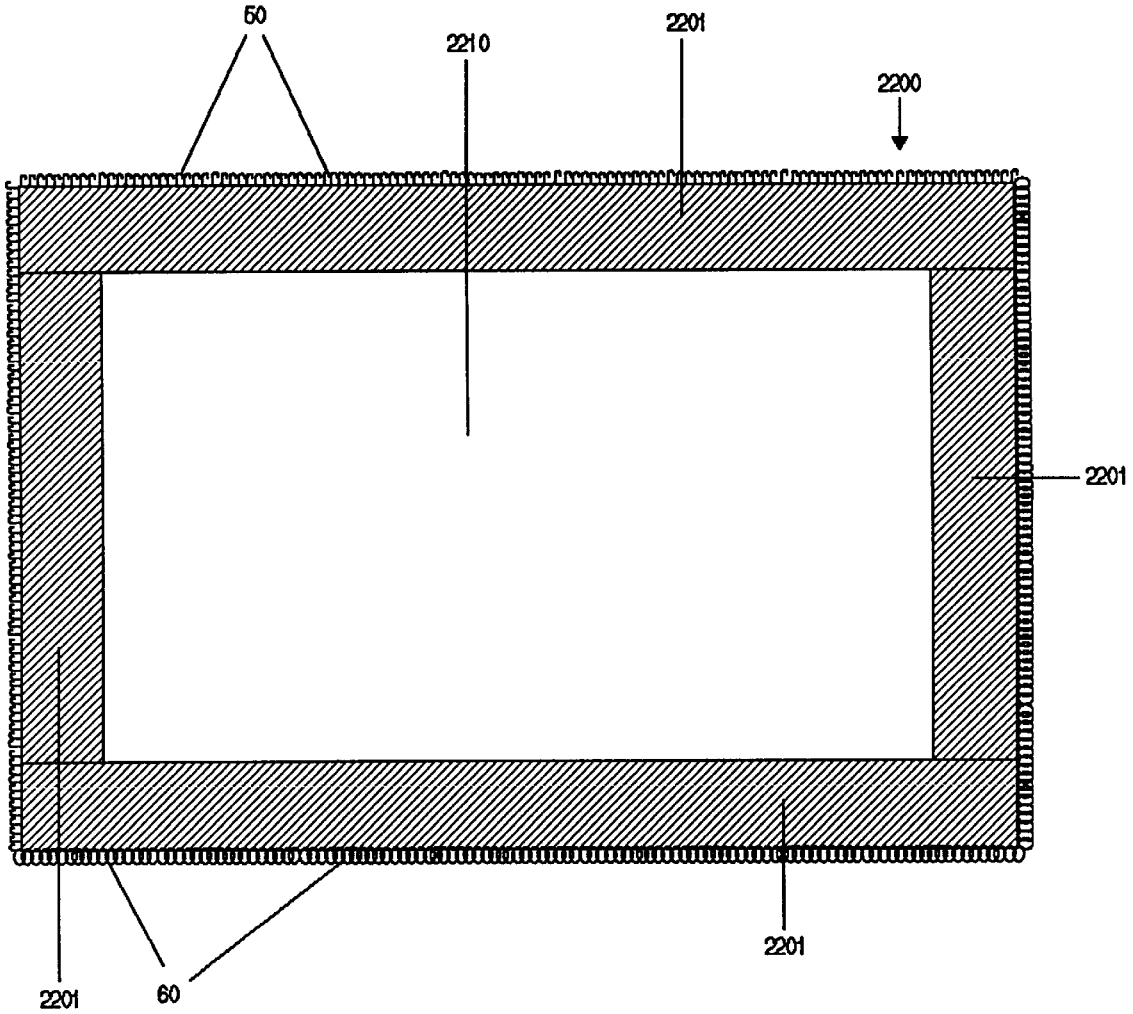
FIG. 22 is a cross-sectional view of a hollow construction element having a rigid substrate covered with hook-and-loop fastener material.

An example of the fabrication of a construction element with a hollow core is illustrated by the cross-sectional view of a hollow core right rectangular prism (2200) in FIG. 22. The hollow core (2210) of the prism (2200) is formed by cutting a sheet of rigid material (2201) into six rectangles having the dimensions of the faces of the prism, and bonding the individual pieces together (using an adhesive or chemical bonding system) to form the prism (2200). The surfaces of the prism (2200) are then substantially covered with hook material (50) and loop material (60) by cutting the material into sections having the dimensions of the prism surfaces, and adhering the sections to the surfaces with a high strength chemical adhesive, or by other permanent bonding means.

Semi-rigid elements, i.e., elements which deform under pressure but return to their original shape upon release of pressure, may be fabricated by molding or cutting materials such as high-density foam. Hook and loop material can then be cut to have the shapes of the faces of the element and adhered to the surface with a high strength chemical adhesive or by other permanent bonding means. A three-dimensional element formed from a semi-rigid material may have a solid construction, as depicted in FIG. 21, and yet still remain relatively lightweight.

Figure 20A:
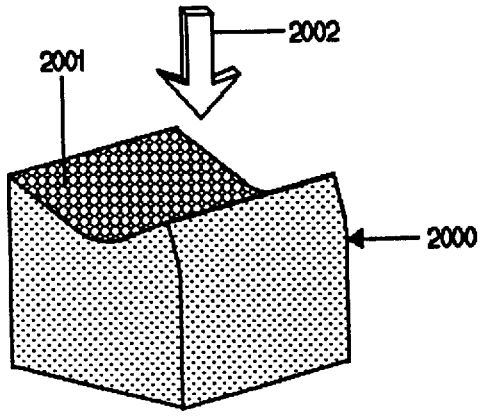
FIG. 20*a* is a perspective view illustrating the deformation of a resilient construction element.

"Resilient" elements are elements which are much softer and have less structural integrity than semi-rigid elements. FIG. 20*a* shows a resilient core cube (2000) when a downward force (2002) is applied to the top surface (2001. When the force (2002) on the top surface (2001) of the cube (2000) is released, the cube (2000) will return to its original form. Resilient elements may be fabricated by:

- cutting hook and loop material into panels, sewing the panels together to form three-dimensional shells, and stuffing the shells with a resilient material, such as shredded polyester fiberfill; or
- low-density foam (like that used for Nerf™ Ball, manufactured by Kenner, a division of Tonka Corporation of Cincinnati, Ohio) or light sponge material could be formed to the shape of the element, and fastener material could be cut into the shapes of the faces of the element and either sewn onto the surfaces or adhered to the surfaces with a high strength chemical adhesive, or other permanent bonding means.

Figure 23:
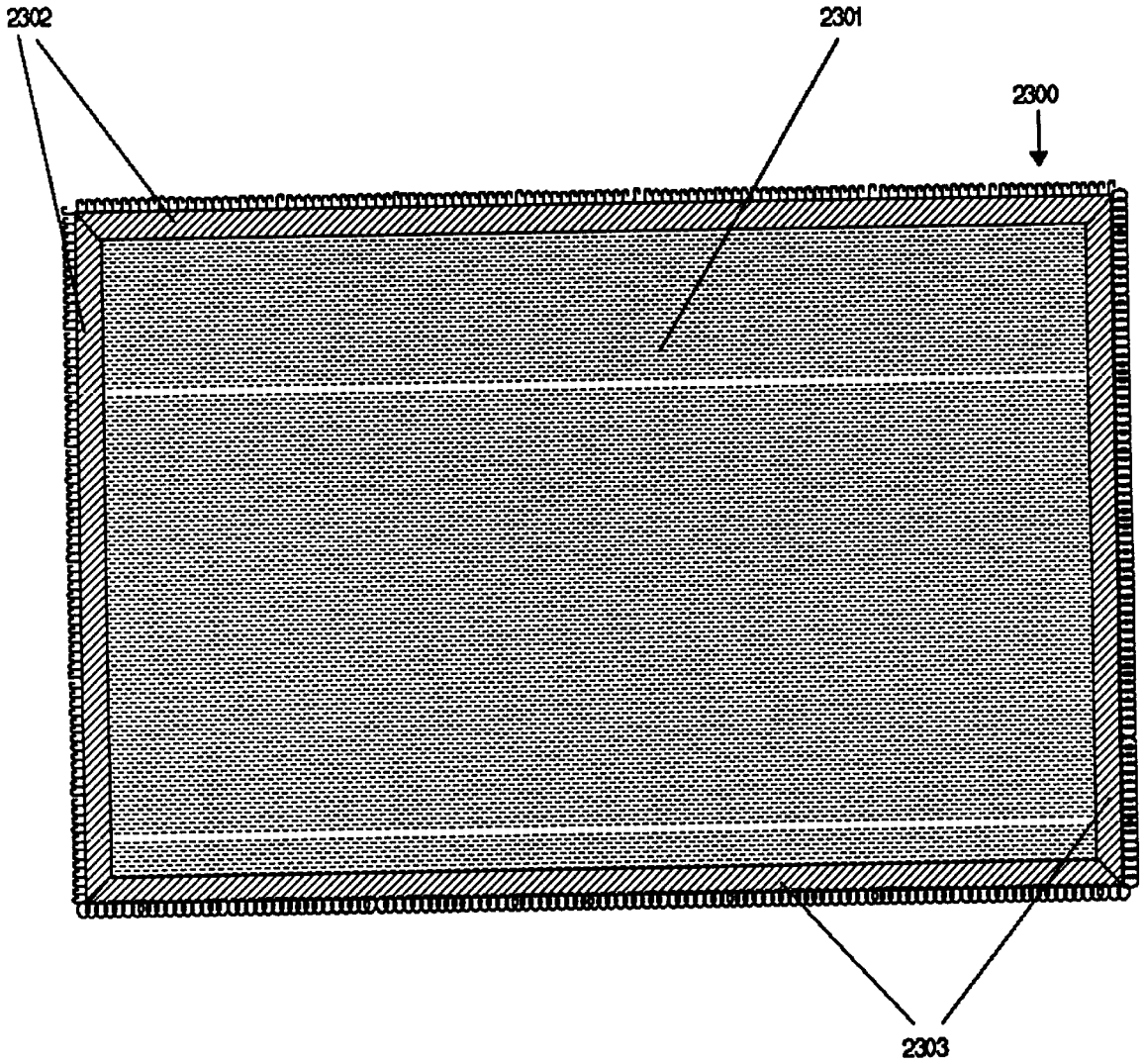
FIG. 23 is a cross-sectional view of a resilient construction element covered with hook-and-loop fastener material.

One means of construction for an element with a resilient-core is illustrated by the cross-sectional view of a resilient core right rectangular prism (2300) in FIG. 23. The prism (2300) is formed by cutting sheets of hook material (2302) and loop material (2303) into six appropriately sized rectangles for the faces of the prism, and sewing the rectangles together. Prior to closing the final seam, the interior of the prism (2300) is stuffed with a resilient material (2301) such as polyester fiber fill.

Figure 24:
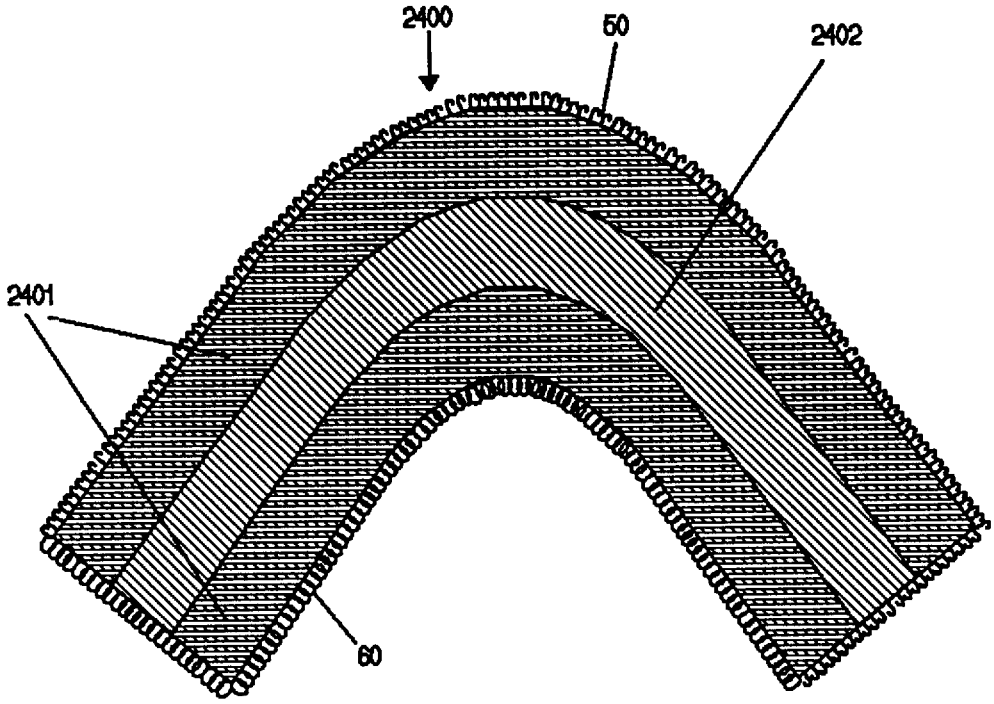
FIG. 24 is a cross-sectional view of a poseable construction element covered with hook-and-loop fastener material.

Poseable construction elements (i.e., elements that yield under manual pressure and retain their altered shape) may have a malleable core (such as metal or other pliable material) surfaced with a soft plastic, and may be either solid or hollow. An exemplary poseable construction element is illustrated by the cross-sectional view of FIG. 24 where a right cylinder (2400) is bent at approximately a right angle. The cylinder (2400) is formed by molding a soft plastic material (2401) around a solid, cylindrical malleable metal core (2402). The surfaces of the cylinder (2400) are covered with hook (50) and loop (60) material by cutting the material to fit the shapes of the surfaces, and adhering the material to the surfaces with a high strength chemical adhesive, or by other permanent bonding means.

Figure 20B:
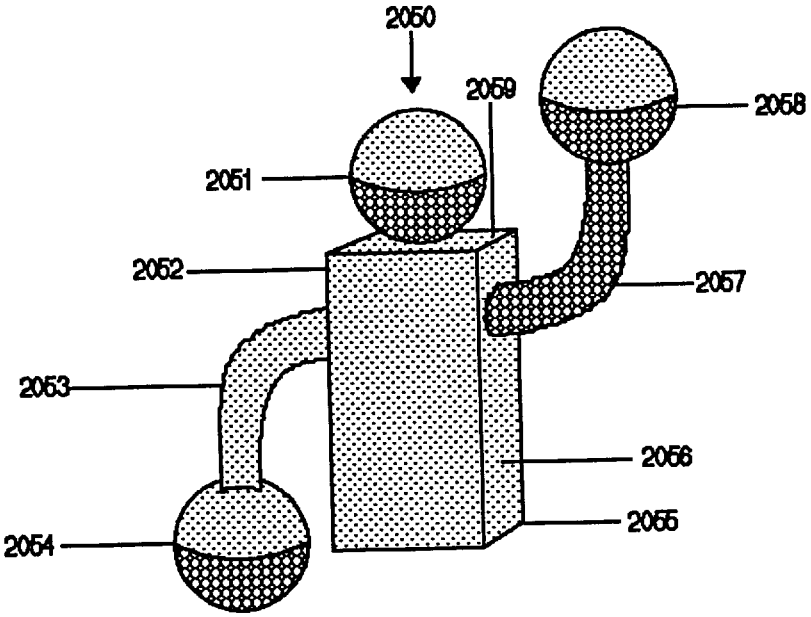
FIG. 20*b* is a perspective view of a structure constructed with poseable elements.

FIG. 20*b* illustrates a structure (2050) created by combining construction elements fabricated from different substrate materials. The structure (2050) is comprised of a rigid right rectangular prism (2055), two poseable right cylinders (2053) and (2057), and three resilient spheres (2051), (2054) and (2058). The right rectangular prism (2055) is oriented such that its long dimension is vertical. The two poseable cylinders (2053) and (2057) are attached to the right rectangular prism (2055) at points on opposite narrow faces (2056) and (2052—the numeric designator lead line ends at the right edge of the narrow faces since it is hidden from view) about three-quarters of the way to the top of the prism (2055). The cylinder (2053) attached to the left side of the prism (2055) is bent at approximately 90 degrees in the downward direction, and the cylinder (2057) attached to the right side of the prism (2055) is bent at approximately 90 degrees in the upward direction. Spheres (2054), (2058) and (2051) are attached to the ends of the downward and upward bent cylinders (2053) and (2057), and to the top surface (2059) of the prism (2055).

Kits

The construction elements which constitute the preferred embodiment of the present invention are intended to be grouped into "kits." A kit may include any combination of elements, fabricated from any one or combination of substrates, surfaced with hook and loop material in any surfacing pattern described herein, and using color as discussed herein. All the elements in a kit may have the preferred surfacing patterns, or a number less than, but not substantially less than, the total number of elements in a kit, i.e., the cardinality of the kit, may have the preferred surfacing patterns, and the remainder of the elements may have deviations from the preferred surfacing patterns. Preferably, 75% of more of the elements in a kit have preferred surfacing patterns, more preferably 85% or more of the elements in a kit have preferred surfacing patterns, and even more preferably 95% or more of the elements in a kit have preferred surfacing patterns. The collection of rigid right rectangular prisms, right triangular prisms, right cylinders, and right cones which comprise the frame (1200) and jet airplane (1250) of FIG. 12 is one example of a kit. Or, a kit may be comprised solely of some number of cubes identical to the resilient cube (2000) of FIG. 20*a*. A third example of a kit is shown in FIG. 20*b*, where the construction elements that make up the structure (2050) are fabricated from a variety of substrate materials, all surfaced in hook and loop material as described herein.

According to the present invention, the construction elements described above can be used in combination with decorative blocks which are partially surfaced in hook and loop fastener material. The decorative blocks may have the shapes of the above-described geometric solids. The decorative blocks can be used as structural elements in combination with the standard fully-surfaced elements to add realistic detail, or provide whimsical or functional features. For instance, the faces of the decorative blocks not surfaced in hook and loop material may display a solid color or a printed design, or a have a mechanically operable feature, such as a door.

Figure 27:
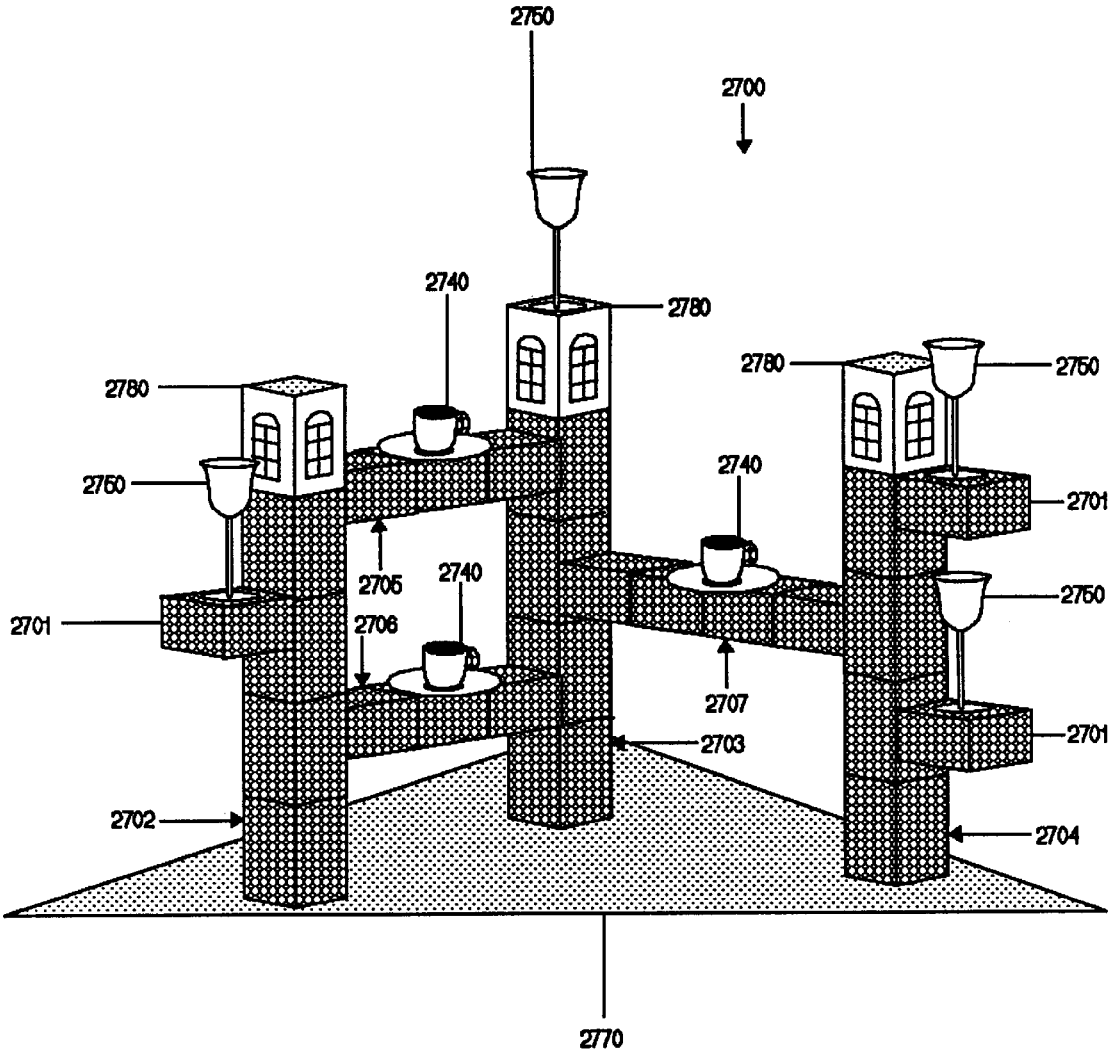
FIG. 27 is a perspective view of a display structure constructed using the elements of the present invention.

A simple, artful structure (2700) for displaying merchandise is shown in FIG. 27 as a fourth example of a kit. The structure (2700) consists of right square prisms and right rectangular prisms covered with hook and loop material in the preferred 3-Point surfacing pattern in combination with decorative blocks (2780) which are not completely surfaced. The three columns (2702), (2703) and (2704) of the structure (2700) are each topped with a decorative block (2780). Each decorative block (2780) has loop material substantially covering one end surface and hook material substantially covering the opposite end surface, while a decorative pattern surfaces the four vertical faces. The three columns (2702), (2703) and (2704) are adhered to a large planar base (2770) completely surfaced in hook material for stability. Wine glasses (2750) are shown to be displayed on cantilevered right rectangular prisms (2701), and cups with saucers (2740) are shown to be displayed on the cross members (2705), (2706), and (2707).

The base surface (2770) may be flexible, semi-rigid, or rigid, and may be surfaced with either hooks or loops. While flexible and semi-rigid bases provide the advantage that they can be rolled up or folded up for storage, rigid and semi-rigid bases lend additional stability to the structure.

As shown in FIG. 12, according to the present invention two-dimensional non-structural, decorative elements (1280) can be used in combination with three-dimensional elements. In general, two-dimensional decorative elements may be any planar shape, but will most commonly consist of geometric shapes such as circles, squares, triangles, rectangles, and other polygons. The face of the decorative element may display a solid color or a printed design. Alternatively, the two-dimensional element may have a three-dimensional manufactured figure attached to it. The reverse side of each two-dimensional element is substantially surfaced with either hook material or loop material.

Use of Color

According to the present invention, color may be used to easily identify surfaces which will adhere to one another, and/or to indicate the bonding strength of a fastener material. A kit may contain an index or color map that will specify which of the rules described below apply to it, and what the specific color assignments are.

In one preferred embodiment, first color surfaces mate to second color surfaces. In the case of the prism (100) illustrated in FIG. 1, faces (101), (102), and (103) are surfaced with hook material (50) and have a first color, and faces (104), (105), and (106) are surfaced with loop material (60) and have a second color.

In another preferred embodiment, a single color h is assigned to the hook material of all the elements. The loop material can be any color other than the hook material color h, but only one color of loop material is used to surface any one element. Therefore, surfaces with the color h will always mate to any surface not covered in the color h, but not to any surface covered in the color h. (Of course the same color scheme can be applied to the inverse surfacing, i.e., one color 1 is assigned to the loop material and the hook material can have any set of colors which doesn't include l.)

Several other methods of using color to indicate mating surfaces are possible. One alternative is to assign a set of colors h to the hook material, and another set of colors 1 to the loop material. Surfaces with color(s) h always mate to surfaces with color(s) 1, but not to other surfaces with color(s) h.

Color may also be used to indicate the range of strengths in which the resulting bond between two surfaces will fall. In one preferred embodiment, a different color h is assigned to each strength range of hook material. The colors not assigned to be used for hook material may be used for loop material. For example, weak hook material may have color 1 and strong hook material may have color 2. The loop materials are all the same (except for color) and have any colors other than colors 1 and 2. Loop surfaces mated to hook surfaces of color 1 will result in weaker bonds, while loop surfaces mated to hook surfaces of color 2 will result in stronger bonds. (Also within the scope of the invention is the inverse color assignment: specific colors could be assigned to each strength range of loop material, while there is a single type of hook material, and colors not assigned to be used for loop material may be used for hook material.)

Alternatively, a plurality of colors h can be assigned to hook materials which fall within certain ranges of bond strength, and a second plurality of colors 1 can be assigned to loop materials which fall within certain ranges of bond strength. The colors on a surface then indicates both the mating materials for that surface and the strength of bonds to that surface. For example, if weak hook is color 1, strong hook is color 2, weak loop is color 3, and strong loop is color 4, then the strongest bond will be achieved between surfaces of color 2 and color 4, the weakest bond between surfaces of color 1 and color 3.

Additional Embodiments

The preferred embodiment of the present invention is optimized for use with mechanical adhesive systems having two different mating materials, such as Velcro™ hook and loop fastener material manufactured by Velcro U.S.A. of Manchester, N.H. However, there is a second type of mechanical adhesive system where a single type of material bonds with itself. Examples of this type of mechanical adhesive system are the Dual Lock™ locking stem fasteners manufactured by 3M of St. Paul, Minn., and "universal" hook and loop material, such as OmniTape manufactured by Velcro U.S.A. For this second type of mechanical adhesive, all surfaces of the three-dimensional construction elements are substantially covered in the one fastener material subject to disengagement strength constraints. As in the preferred embodiment, only one side of the two-dimensional decorative elements would be substantially covered in the fastener material. Although color would not be used to indicate mating surfaces, color could still be used to indicate bond strength ranges as described herein. The performance of pivot edges and pivot points depends on the specific fastener material choice. However, rounded pivot edges and rounded pivot points function to some extent with nearly any choice of mechanical adhesive of this type.

As previously discussed, hook and loop fastener materials are fabricated with a wide range of characteristics by various manufacturers. A preferred embodiment of the present invention uses a Velcro™ brand hook material known as HTH™ line, and a Velcro™ brand loop material known as VELTEX™. HTH™ is manufactured by a molding process rather than the conventional method of weaving nylon filaments and cutting them to form hooks. This allows for customized design of the hook, resulting in a hook material with controllable bonding and durability characteristics. An advantage of the HTH™ hook materials is that they are less abrasive to the touch than many other types of hook materials, and therefore well suited to the present invention.

VELTEX™ loop material is a laminated loop fabric. The fabric is smooth and soft to the touch and has excellent cleaning characteristics. This makes it an ideal choice for embodiments which are to be used by small children, such as construction elements fabricated from resilient materials as described herein and illustrated by the cube (2000) in FIG. 20*a*.

CONCLUSIONS AND RAMIFICATIONS

It can be readily understood from the preceding detailed description that the described construction elements can be of arbitrary size and shape, and can be easily and quickly adhered to one another, even by very young children or individuals with limited manual dexterity, to create a virtually infinite variety of structures (including overhanging structures, under-hanging structures and side-hanging structures) simply by pressing an element to the structure at the desired location. The elements provide no restrictions on the orientation of attachment, given that contact is made between mating surfaces. There are no special attachment elements required. The construction elements described also provide the following advantages:

(i) They optimize the number of ways three-dimensional elements can be joined to one another while minimizing the number of element variants.

(ii) They can be connected in partial-surface-to-partial-surface orientations.

(iii) They can be connected in edge-to-surface orientations which allow for a pivoting motion about the edge of connection.

(iv) They can be connected in point-to-surface orientations which allow for a pivoting motion about the point of connection.

(v) They allow for the creation of structures composed of elements with a common interconnect mechanism but with different physical characteristics, e.g., elements can be rigid, semi-rigid, resilient or poseable.

(vi) Three-dimensional structures created can be lifted or arbitrarily oriented without falling apart.

(vii) The strength of attachment between elements can be reliably varied for specific applications, allowing the creation of structures which can support the weight of small children, or which are extremely easy to pull apart (for very young children, or the elderly).

(viii) They allow mating surfaces and bond strengths to be easily visually identified through the use of color.

These features provide construction elements which are safe and fun, and which provide continuing creative and/or educational play for individuals of a wide range of ages and abilities.

Although the above description contains many specificities, these should not be construed as limiting the scope of the invention, but as merely providing illustrations of some of the preferred embodiments of this invention. Many variations are possible and are to be considered within the scope of the present invention.

For instance, many other surfacing patterns which do not fully comply with the general surfacing guidelines provided above, but which still have beneficial attributes are within the scope of the present invention. Some of these alternative surfacing patterns include:

(i) For prisms with n faces, where n is an odd number, face $F_{(n+1)/2}$ is split vertically in half, with half the face covered in hook material and half the face substantially covered in loop material. One base is substantially hook covered, one base is substantially loop-covered, faces $F_1$ to $F_{(n-1)/2}$ are substantially hook-covered, and faces $F_{(n+3)/2)}$ to $F_n$ are substantially loop covered. The advantage of this surfacing is that there are equal areas of hook and loop surfaces.

(ii) For a pyramid, the base is either hook-covered or loop-covered, and the faces are covered alternatingly with hook and loop. That is, $F_1$ is hook, $F_2$ is loop, $F_3$ is hook, $F_4$ is loop, etc.

(iii) For a pyramid, the base is divided diagonally into two equal areas, one covered in hook material and the other covered in loop material. The faces adjacent to the hook-covered portion of the base are covered in hook material, and the faces adjacent to the loop-covered portion of the base are covered in loop material.

(iv) For a cylinder, one circular base is hook-covered and the other circular base is loop-covered. The curved lateral surface is divided into two equal cylindrical sections, each about half the height of the cylinder. The cylindrical section adjacent to the first base is covered with hook material, and the cylindrical surface section adjacent to other base is covered in loop material.

(v) For a cone, the base is substantially covered in hook material. The lateral curved surface is divided into two sections, each covering the entire 360 degrees of circumference and each roughly half the height of the total cone.

The lower section is substantially covered in hook material, and the upper section is substantially covered in loop material. The intersection between the two sections forms a circle which is parallel to the base of the cone.

(vi) For a sphere, the surface is divided into multiple, equally-sized longitudinal spherical sectors extending from pole to pole, with the sectors alternately being surfaced with hook material and loop material.

Many other variations are also to be considered within the scope of the present invention. For example: not all elements in a kit need have the preferred surfacing patterns, for instance, a majority of the elements in a kit might have the preferred surfacing patterns and the remaining elements might have deviations from the preferred surfacing patterns; any preferred surfacing pattern or coloring scheme may be inverted by substituting hook material for loop material and vice versa; surfaces may be substantially covered rather than completely covered with fastener material; other decorative patterns and features may be applied to the two-dimensional decorative elements; more, less or different bond strength ranges could be defined; other methods of construction and other substrate materials could be used; elements of a kit may have characters or symbols, such as those forming a brand name or trademark, embossed or otherwise imprinted onto or into the fastener material on one or more surfaces of the elements; elements of a kit may have a void left in the fastener material on any or all faces for the purposes of imprinting or otherwise displaying information, such as brand names or trademarks; the elements may be relatively large and specially designed to be assembled as parts of a structure in which children can actually play, such as elements of a castle or a fort; the elements may be specially shaped as parts of a geometric puzzle; the construction elements may have components placed in their interior to create a variety of sounds, possibly as part of a game or other structured activity; the construction elements may be made to glow in the dark for night-time amusement; a kit may include a flexible mat (of either hook or loop material) which may be attached to a wall and used as a means of storing construction elements, or displaying structures as three-dimensional wall decorations; a flexible container, such as a net, may be used as a means of storage; the elements may be interfaced with a means of generating motion, such as an electric, spring-powered, or solar-powered motor; the set of construction elements may include specially designed elements, such as functioning doors, windows and furnishings for creating a model house, or elements with themes appropriate for holiday decorations; the construction elements may be adorned in a wide variety of colorful and decorative ways; a hollow construction element may have a removable surface portion to allow access to the interior for storage or other amusement purposes.

Thus the scope of the invention should be determined not by the examples given herein, but rather by the appended claims and their legal equivalents.

What is claimed is:

1. A construction kit comprising a set of elements of a first cardinality, said set of elements including a subset of elements of a second cardinality equal to or less than, but not much less than, said first cardinality, elements of said subset of elements each having a number of surfaces, each of said surfaces having a surface area, each of said surfaces being substantially covered in only one type of mechanical adhesive material selected from the group of two types of mechanical adhesive consisting of a first type of mechanical adhesive and a second type of mechanical adhesive, surfaces of a first type being substantially covered in said first type of mechanical adhesive and surfaces of a second type being substantially covered in said second type of mechanical adhesive, said first type of mechanical adhesive being removably adherable to said second type of mechanical adhesive, for each of said elements of said subset of elements said surfaces of said first type being contiguous and said surfaces of said second type being contiguous, and for each of said elements of said subset of elements a first sum of said surface areas of said surfaces of said first type being approximately equal to a second sum of said surface areas of said surfaces of said second type.

2. The construction kit of claim 1 wherein said subset of elements are covered in said two types of mechanical adhesive according to a 3-point derivative surfacing pattern.

3. The construction kit of claim 2 wherein said subset of elements includes a cube having a first cube group of three contiguous cube faces substantially covered in said first type of mechanical adhesive and a second cube group of three contiguous cube faces substantially covered in said second type of mechanical adhesive, said first cube group of three contiguous cube faces meeting at a first cube corner, and said second cube group of three contiguous cube faces meeting at a second cube corner opposite said first cube corner.

4. The construction kit of claim 2 wherein said subset of elements includes a right rectangular prism having a first rectangular prism group of three contiguous right rectangular prism faces substantially covered in said first type of mechanical adhesive and a second rectangular prism group of three contiguous right rectangular prism faces substantially covered in said second type of mechanical adhesive, said first rectangular prism group of three contiguous right rectangular prism faces meeting at a first rectangular prism corner, and said second rectangular prism group of three contiguous right rectangular prism faces meeting at a second rectangular prism corner opposite said first rectangular prism corner.

5. The construction kit of claim 4 wherein said subset of elements includes a triangular prism having a first triangular prism triangular base and a second triangular prism triangular base, and first, second and third triangular prism rectangular faces, said first triangular prism triangular base and said first and second triangular prism rectangular faces being substantially covered with said first type of mechanical adhesive material, and said second triangular prism triangular base and said third triangular prism rectangular face being substantially covered with said second type of mechanical adhesive material.

6. The construction kit of claim 5 wherein surface areas of said first and second triangular prism rectangular faces are less than that of said third triangular prism rectangular face.

7. The construction kit of claim 4 wherein said subset of elements includes an element with a curved surface.

8. The construction kit of claim 7 wherein said elements with said curved surfaces include a spherical element, said spherical element having a first hemisphere substantially covered with said first type of mechanical adhesive and a second hemisphere substantially covered with said second type of mechanical adhesive.

9. The construction kit of claim 7 wherein said elements with said curved surfaces include an ellipsoidal element divided along a plane into a first ellipsoid half and a second ellipsoid half, said first ellipsoid half being substantially covered with said first type of mechanical adhesive and said second ellipsoid half being substantially covered with said second type of mechanical adhesive.

10. The construction kit of claim 1 wherein an element which is in said set of elements but not in said subset of elements is a cylindrical element having first and second cylinder bases and a lateral cylinder surface, said first and second cylindrical bases being substantially covered with said first type of mechanical adhesive, and said lateral cylinder surface being substantially covered with said second type of mechanical adhesive.

11. The construction kit of claim 6 wherein said element with said curved surface is a cylindrical element having first and second cylinder bases and a lateral cylinder surface, said lateral cylinder surface being divided along a plane bisecting said first and second cylinder bases into first and second lateral cylinder sections, said first cylindrical base and said first lateral cylinder section being substantially covered with said first type of mechanical adhesive, and said second cylindrical base and said second lateral cylinder section being substantially covered with said second type of mechanical adhesive.

12. The construction kit of claim 11 wherein said element with said curved surface is a conical element having a cone base, a cone apex, and a lateral cone surface, said lateral cone surface being divided along a plane bisecting said cone bases and passing through said cone apex into first and second lateral conical sections, said cone base and said first lateral cone surface being substantially covered with said first type of mechanical adhesive, and said second lateral cone surface being substantially covered with said second type of mechanical adhesive.

13. The construction kit of claim 5 wherein said subset of elements includes a right prism element having first and second right prism bases and right prism faces, a first contiguous group of said right prism faces having a third cardinality and being substantially covered with said first type of mechanical adhesive, a second contiguous group of said prism faces having a fourth cardinality within unity of said third cardinality and being substantially covered with said second type of mechanical adhesive, said first right prism base being substantially covered with said first type of mechanical adhesive, and said second right prism base being substantially covered with said second type of mechanical adhesive.

14. The construction kit of claim 3 wherein said subset of elements includes a pyramidal element having a pyramid base and pyramid faces, a first contiguous group of said pyramid faces having a third cardinality and being substantially covered with said first type of mechanical adhesive, a second contiguous group of said pyramid faces having said third cardinality and being substantially covered with said second type of mechanical adhesive, and said base being substantially covered with said first type of mechanical adhesive.

15. The construction kit of claim 4 wherein said elements include a pyramidal element having a pyramid base and pyramid faces, a first contiguous group of said pyramid faces having a third cardinality and being substantially covered with said first type of mechanical adhesive, a second contiguous group of said pyramid faces having a fourth cardinality equal to said third cardinality plus one, said second contiguous group of said pyramid faces being substantially covered with said second type of mechanical adhesive, and said base being substantially covered with said first type of mechanical adhesive.

16. The construction kit of claim 1 wherein said subset of elements includes a right rectangular prism having first, second and third contiguous right rectangular prism faces substantially covered in said first type of mechanical adhesive, and fourth, fifth, and sixth contiguous right rectangular prism faces substantially covered in said second type of mechanical adhesive, said first contiguous right rectangular prism face meeting said second contiguous right rectangular prism face at a first edge of said second contiguous right rectangular prism face, said third contiguous right rectangular prism face meeting said second contiguous right rectangular prism face at a second edge of said second contiguous right rectangular prism face opposite said first edge of said second contiguous right rectangular prism face, said fourth contiguous right rectangular prism face meeting said fifth contiguous right rectangular prism face at a third edge of said fifth contiguous right rectangular prism face, and said sixth contiguous right rectangular prism face meeting said fifth contiguous right rectangular prism face at a fourth edge of said fifth contiguous right rectangular prism face opposite said third edge of said fifth contiguous right rectangular prism face.

17. The construction kit of claim 2 wherein said elements are shaped as right rectangular prisms, spheres, and cylinders.

18. The construction kit of claim 2 wherein a ratio of said second cardinality to a sum of said first cardinality and said second cardinality is greater than 75%.

19. The construction kit of claim 2 wherein a ratio of said second cardinality to a sum of said first cardinality and said second cardinality is greater than 85%.

20. The construction kit of claim 2 wherein a ratio of said second cardinality to a sum of said first cardinality and said second cardinality is greater than 95%.

21. The construction kit of claim 2 wherein said elements include a substantially two-dimensional element.

22. The construction kit of claim 21 wherein said substantially two-dimensional element has a first face substantially surfaced with said first type of mechanical adhesive.

23. The construction kit of claim 22 wherein said substantially two-dimensional element has a second face bearing a decorative image.

24. The construction kit of claim 1 wherein said elements include a second subset of elements having a substrate material of a first substrate type, and a third subset of elements having a substrate material of a second substrate type.

25. The construction kit of claim 24 wherein said first type of substrate material is a rigid material.

26. The construction kit of claim 24 wherein said first type of substrate material is a semi-rigid material.

27. The construction kit of claim 24 wherein said first type of substrate material has a hollow core.

28. The construction kit of claim 24 wherein said first type of substrate material is a resilient material.

29. The construction kit of claim 24 wherein said first type of substrate material is a poseable material.

30. The construction kit of claim 2 wherein said surfaces of said first type have colors selected from a first set of colors, and said surfaces of said second type have colors selected from a second set of colors, said first and second sets of colors having no colors in common.

31. The construction kit of claim 2 wherein for any first selected surface on any of said elements substantially covered with said first type of mechanical adhesive, and any second selected surface on any other of said elements substantially covered with said second type of mechanical adhesive, a product of a rated bond strength of mating of said first and second types of mechanical adhesive on said first and second selected surfaces, respectively, and an area of contact of said first and second selected surfaces is less than an upper bond-strength bound and greater than a lower bond-strength bound.

32. The construction kit of claim 31 wherein said rated bond strength is less than 15 lb./in$^2$ and greater than 1 lb./in$^2$.

33. The construction kit of claim 32 wherein said rated bond strength is less than 10 lb./in$^2$ and greater than 5 lb./in$^2$.

* * * * *